US010398612B2

(12) United States Patent
Iida et al.

(10) Patent No.: US 10,398,612 B2
(45) Date of Patent: Sep. 3, 2019

(54) CAREGIVING BED

(71) Applicant: WELLCARE BED CORP., Tokyo (JP)

(72) Inventors: Kazuyoshi Iida, Tokyo (JP); Junji Ajioka, Shiojiri (JP); Shigeki Miyamoto, Tokyo (JP); Koichi Sugita, Yokohama (JP)

(73) Assignee: WELLCARE BED CORPORATION, Tokyo (JP)

( * ) Notice: Subject to any disclaimer, the term of this patent is extended or adjusted under 35 U.S.C. 154(b) by 141 days.

(21) Appl. No.: 14/368,401

(22) PCT Filed: Dec. 22, 2012

(86) PCT No.: PCT/JP2012/083370
§ 371 (c)(1),
(2) Date: Jun. 24, 2014

(87) PCT Pub. No.: WO2013/094765
PCT Pub. Date: Jun. 27, 2013

(65) Prior Publication Data

US 2014/0310875 A1 Oct. 23, 2014

(30) Foreign Application Priority Data

Dec. 24, 2011 (JP) ..... 2011-282530
Sep. 10, 2012 (JP) ..... 2012-198617

(51) Int. Cl.
*A47B 13/00* (2006.01)
*A61G 7/015* (2006.01)
(Continued)

(52) U.S. Cl.
CPC ..... *A61G 7/015* (2013.01); *A61G 1/01* (2013.01); *A61G 7/0005* (2013.01); *A61G 7/012* (2013.01);
(Continued)

(58) Field of Classification Search
CPC ..... A61G 7/10; A61G 7/057; A61G 7/005; A61G 7/05; A61G 7/00; A61G 7/012;
(Continued)

(56) References Cited

U.S. PATENT DOCUMENTS 1,874,826 A * 8/1932 Staudt ..... A61G 7/1003 5/83.1
3,401,410 A * 9/1968 Welborn ..... A61G 7/1015 5/607
(Continued)

FOREIGN PATENT DOCUMENTS

JP 53-13386 U 2/1978
JP S60-119948 A 6/1985
(Continued)

OTHER PUBLICATIONS

May 2, 2016 Notice of Allowance issued in Japanese Patent Application No. 2012-280358.
(Continued)

*Primary Examiner* — Nicholas F Polito
*Assistant Examiner* — Morgan J McClure
(74) *Attorney, Agent, or Firm* — Hauptman Ham, LLP

(57) ABSTRACT

Provided is a caregiving bed having a variety of usage aspects. A caregiving bed includes a bed main body, and one support platform and another support platform. The bed main body includes a rectangular pad part. Each of the support platforms is provided with an elevator device connected to the pad part to raise and lower the bed main body. Each of the support platforms is provided with a pair of support columns extending upward. A beam member is provided between the support columns of the one support platform and between the support columns of the other support platform. The distance between the pad part and the attachment part decreases when the bed main body is raised
(Continued)

by the elevator devices, whereas the distance between the pad part and the attachment part increases when the bed main body is lowered.

19 Claims, 33 Drawing Sheets

(51) Int. Cl.

| | |
|---|---|
| ***A61G 1/01*** | (2006.01) |
| ***A61G 7/00*** | (2006.01) |
| ***A61G 7/012*** | (2006.01) |
| ***A61G 7/02*** | (2006.01) |
| ***A61G 7/10*** | (2006.01) |
| ***A61G 10/00*** | (2006.01) |
| *A61G 7/057* | (2006.01) |

(52) U.S. Cl.
CPC ..... *A61G 7/02* (2013.01); *A61G 7/1003* (2013.01); *A61G 10/005* (2013.01); *A61G 7/00* (2013.01); *A61G 7/057* (2013.01)

(58) Field of Classification Search
CPC ..... A61G 7/02; A61G 7/015; A61G 7/1003; A61G 1/01; A61G 10/005
See application file for complete search history.

(56) References Cited

U.S. PATENT DOCUMENTS 3,557,392 A * 1/1971 Schmidt ..... A61G 7/0005 4/547
3,584,321 A * 6/1971 Buchanan ..... A61B 6/0442 5/601
3,613,127 A * 10/1971 Bond ..... A61G 7/0005 4/596
3,692,028 A * 9/1972 Etten ..... A61G 7/1003 4/573.1
3,693,200 A * 9/1972 Stafford ..... A61G 7/015 5/617
3,701,170 A * 10/1972 Bond ..... A47K 3/001 4/570
3,924,281 A * 12/1975 Gibbs ..... A61G 7/1015 5/88.1
3,965,501 A * 6/1976 Bucher ..... A61G 7/02 4/547
4,057,240 A * 11/1977 Damico ..... A61G 13/0018 5/611
4,109,329 A * 8/1978 Tupper ..... A61G 7/1015 5/607
4,167,793 A * 9/1979 Vago ..... A47K 3/06 4/562.1
4,318,195 A * 3/1982 Reppas ..... A47B 85/00 312/240
4,669,136 A * 6/1987 Waters ..... A61G 7/00 177/144
4,843,665 A * 7/1989 Cockel ..... A61G 7/0005 5/81.1 R
4,970,736 A * 11/1990 Koizumi ..... A61G 7/0005 4/535
4,982,462 A * 1/1991 Wada ..... A61G 7/0005 4/546
5,005,233 A * 4/1991 Toivio ..... A61G 7/1015 4/585
5,054,136 A * 10/1991 Inagaki ..... A61G 7/0005 4/546
5,173,978 A * 12/1992 Kassai ..... A61G 7/0005 4/547
5,235,712 A * 8/1993 Smith ..... A61G 7/0005 4/585
5,239,713 A * 8/1993 Toivio ..... A61G 7/1019 177/144
5,341,820 A * 8/1994 Hammett ..... A61G 7/0005 4/564.1
5,406,658 A * 4/1995 Olkkonen ..... A61G 7/005 5/83.1
5,544,371 A * 8/1996 Fuller ..... A61G 7/0005 5/85.1
6,088,848 A * 7/2000 Waterlyn ..... A61G 7/0005 4/585
6,321,398 B1 * 11/2001 Wang ..... A61G 7/001 212/901
7,716,762 B2 * 5/2010 Ferraresi ..... A61G 7/0573 5/607
7,895,688 B1 * 3/2011 Rowes ..... A61G 7/001 5/607
9,220,649 B2 * 12/2015 Westermann ..... A61B 5/1115
9,248,065 B1 * 2/2016 Tu ..... B62B 3/022
2005/0077859 A1 * 4/2005 Nagaoka ..... H02P 7/03 318/625
2005/0188462 A1 * 9/2005 Heimbrock ..... A61G 7/0507 5/425
2005/0283911 A1 * 12/2005 Roussy ..... A47C 19/045 5/611
2007/0157385 A1 * 7/2007 Lemire ..... A61G 7/005 5/600
2007/0245496 A1 * 10/2007 Chinn ..... A61G 1/04 5/710
2007/0296600 A1 * 12/2007 Dixon ..... A61G 7/05 340/573.1
2009/0307841 A1 * 12/2009 James ..... A61G 7/001 5/88.1
2010/0071129 A1 * 3/2010 Yokota ..... A61G 7/0005 5/83.1
2012/0259245 A1 * 10/2012 Receveur ..... A61G 7/05769 600/587
2013/0061385 A1 * 3/2013 Al-Madi ..... A61G 7/0005 4/546

FOREIGN PATENT DOCUMENTS

| | | | |
|---|---|---|---|
| JP | B2-61-36938 | | 8/1986 |
| JP | 64-50828 | U | 3/1989 |
| JP | 2-77039 | U | 6/1990 |
| JP | 5-62240 | U | 8/1993 |
| JP | 3000688 | U | 6/1994 |
| JP | H08-52179 | A | 2/1996 |
| JP | A-9-19462 | | 1/1997 |
| JP | 9-253150 | A | 9/1997 |
| JP | A-11-206822 | | 8/1999 |
| JP | A-2000-5263 | | 1/2000 |
| JP | A-2000-5264 | | 1/2000 |
| JP | 2000-60930 | A | 2/2000 |
| JP | 2000-126266 | A | 5/2000 |
| JP | 2002-186656 | A | 7/2002 |
| JP | 2005-270301 | A | 10/2005 |
| JP | 3132903 | U | 6/2007 |
| JP | A-2011-125484 | | 6/2011 |

OTHER PUBLICATIONS

International Search Report issued in International Application No. PCT/JP2012/083370 dated Apr. 9, 2013.
Written Opinion of the International Searching Authority issued in International Application No. PCT/JP2012/083370 dated Apr. 9, 2013.
Oct. 21, 2015 Office Action issued in Japanese Patent Application No. 2012-280358.
May 23, 2017 Office Action issued in Japanese Patent Application No. 2016-109340.
Office Action in JP Application No. 2017-180154, dated Dec. 12, 2017, 11pp.

* cited by examiner

CAREGIVING BED

FIELD

The present invention relates to a caregiving bed, more specifically, a caregiving bed that enables the raising and lowering of the bed with a simple structure, enables excrement disposal and bathing without moving a care-receiver from the caregiving bed, and enables easy cleaning.

BACKGROUND

In related art, caregiving beds have the function of raising and lowering the bed part on which a care-receiver lies. Raising and lowering the bed part enables the care-receiver to easily move between the bed and a wheelchair. A lowered position of the bed while the care-receiver is in the bed makes the care-receiver feel easy. Raising the bed when a caregiver provides care enables the caregiver to easily provide care.

In care for care-receivers, in particular, bedridden care-receivers due to great age or physical disability, caregivers dispose excrement of the care-receivers and bathe or help them take a shower. When care-receivers are cared for at home, in many cases the care-givers are family members of the care-receivers, such as a spouse and a relative. In recent years, aged people of a similar age to care-receivers provide care in an increasing ratio, and a care-giver has to provide care by him/herself in increasing cases. Thus, care such as excrement disposal and bathing for care-receivers requires heavy labor, and imposes much mental and physical fatigue and stress on not only care-receivers but also caregivers.

In view of the actual circumstances of care as described above, there are cases where the nation establishes a nursing care insurance system, or care service providers such as private care helpers assist care-givers. However, nursing care insurance systems have limits to their application, and requesting care service providers for help requires high cost.

To assist such caregivers, Patent Literature 1 as follows discloses an invention relating to a caregiving bed that can be used as a bathtub and a toilet, and is suitable for people requiring care. The caregiving bed has a structure in which side walls are vertically rotatably disposed in peripheral edge portions of a base, an upper surface of the base including the side walls is covered with a waterproof sheet, a drooping portion of the waterproof sheet drooping down from the base is attached to the side walls, an excretion hole extending from an upper surface of the waterproof sheet to a part under the base is formed, and a lid is detachably attached to the excretion hole. With the caregiving bed disclosed in Patent Literature 1, when the side walls are turned upward and fixed, the drooping portion of the waterproof sheet is raised together with the side walls above the base to form a dam. This structure enables bathing by supplying hot water to the part surrounded by the dam, enables excretion by removing the lid from the excretion hole, and thus enables various types of care without moving the care-receiver from the bed. Thus, the caregiving bed imposes less burden on both the care-receiver and the caregiver.

Patent Literature 2 as follows discloses an invention of a versatile bed for a person sick in bed that enables excretion of excrement and bathing using the bed. With this bed, an excretion hole for excrement is made in a central portion of a drainboard-like mat and a support board, and a blowing port of a supply tube for blowing out washing water and drying warm air is attached to an upper surface of an excrement receiver disposed on a lower surface of the support board. This structure enables the person lying in the bed to excrete in a lying position without sitting up in the bed, and enables washing thereafter. The bed with the above structure enables sanitary disposal such as washing and drying even for severely handicapped people or seriously ill people. In addition, when the support board is removed after supplying hot water into the bath set, it is possible to directly bathe the person ill in the bed in a state of lying on the drainboard-like mat.

CITATION LIST

Patent Literature

Patent Literature 1: JP-A-11-206822
Patent Literature 2: JP-B-61-036938

SUMMARY

Technical Problem

However, the beds disclosed in above Patent Literature 1 and 2 themselves are submerged in water in bathing. Thus, even when each of these beds is waterproofed or water-resistant, care-givers' labor is required for cleaning or maintaining the bed, which involves high costs for maintenance. In addition, because the bed comes into contact with hot water during bathing, unwanted bacteria may propagate on the bed. It is difficult to remove propagation of all bacteria simply by antibacterial treatment, and such bacteria may cause infectious diseases. When part of the care-receiver's body is to be washed, for example, the care-receiver's hair, parts around the hips, or legs, it is necessary to make preparation for washing the part, which requires time and labor of the care-receiver and the caregiver. Because the bed has a structure for using a bath that is different from a structure for disposing excrement, the bed has a complicated structure and is expensive. In addition, the bed that requires complicated operations is difficult to use for the caregiver, and the care-receiver may be injured when the bed is erroneously operated.

The inventors have made various studies to solve the above problem in related art, and have made the present invention, by simplifying a structure for raising and lowering the bed part of the caregiving bed to reduce the burden on the caregiver who provides care for the care-receiver such as excretion disposal and bathing at home, and providing the caregiving bed to be used by the care-receiver with a water tank, and covering the bed part corresponding to the water tank with a detachable mat divided into a plurality of parts, to enable selection of the range of removing the mat according to the mode of use for care. This structure enables the caregiver to wash the care-receiver's body in excretion disposal, wash the care-receiver's hair and/or legs, bathe the care-receiver's legs, and wash the water tank. Furthermore, a caregiving bed that adopts a structure of pulling up and down the care-receiver simply by raising and lowering the bed enables the caregiver to not only easily bathe the care-receiver, but also easily exchange the mat and clean the water tank. In addition, adopting a structure that enables addition of functions of the bed provides a bed having functions according to the care state of the care-receiver. Specifically, even if the care-receiver is not in a bedridden state at present, the required care level of the care-receiver may increase in the future. In such a case, for example, a bathing function may be added to the bed to care the bedridden care-receiver. In addition, the function of easily pulling up the care-receiver can be added to the bed to enable a caregiver to provide care by him/herself. Based on the above findings, the inventors have made the present invention.

Specifically, an object of the present invention is to provide a caregiving bed with a simple structure to reduce the burden on the caregiver to care the care-receiver. The caregiving bed enables care at home such as excretion disposal and bathing, even when the care-receiver becomes bedridden, with a simple structure, low manufacturing cost, and easy maintenance. The caregiving bed also enables flexible addition of necessary structures according to the care level of the care-receiver, and the caregiving bed can be developed from the currently used state.

Solution to Problem

To solve the above problem, a caregiving bed according to a first aspect of the present invention is a caregiving bed including a bed main body, and one support platform and another support platform supporting both longitudinal ends of the bed main body, the bed main body including a rectangular pad part having a predetermined area and thickness allowing a care-receiver to lie thereon, each of the one and the other support platforms being provided with an elevator device connected to the pad part to raise and lower the bed main body;

each of the one and the other support platforms being provided with a pair of support columns located at a predetermined interval in a short direction of the bed main body and extending upward;

a beam member being provided between the pair of support columns of the one support platform and between the pair of support columns of the other support platform;

at least one of each of the support columns and the beam members being provided with an attachment part to which a suspension member is detachably attached; and a distance between the pad part and the attachment part decreasing when the bed main body is raised by the elevator devices, whereas the distance between the pad part and the attachment part increasing when the bed main body is lowered.

A caregiving bed according to a second aspect is the caregiving bed according to the first aspect, in which the suspension member is a pair of belt members forming a lifting member to lift up the care-receiver;

the belt members are attached along a longitudinal direction between the attachment part of the one support platform and the attachment part of the other support platform; and a distance between the bed main body and the lifting member decreases when the bed main body is raised by the elevator devices, whereas the distance between the bed main body and the lifting member increases when the bed main body is lowered.

A caregiving bed according to a third aspect is the caregiving bed according to the second aspect, in which each of the belt members is divided into an attachment belt member attached to the attachment part, and a lifting belt member united with the lifting member, and the attachment belt member and the lifting belt member are detachably connected.

A caregiving bed according to a fourth aspect is the caregiving bed according to the second aspect, in which each of the belt members is divided into an attachment belt member attached to the attachment part, and a lifting belt member united with the lifting member, an end part of the lifting belt member connected with the attachment belt member is formed in a ring shape, and end parts of the attachment belt member are detachably coupled, such that the attachment belt member is wound around the attachment part of at least one of the support columns and the beam member and inserted through the ring-shaped end part of the lifting belt member to form a ring.

A caregiving bed according to a fifth aspect is the caregiving bed according to the second aspect, in which one longitudinal end part and the other longitudinal end part of the pad part is provided with pad part attachment parts to which the belt members are attached.

A caregiving bed according to a sixth aspect is the caregiving bed according to the fifth aspect, in which each of the belt members is divided into an attachment belt member attached to the attachment part, and a lifting belt member united with the lifting member, and the attachment belt member and the lifting belt member are detachably connected.

A caregiving bed according to a seventh aspect is the caregiving bed according to the first aspect, in which the suspension member is a pair of bar-shaped members detachably attached to at least one lifting member to lift up the care-receiver, the bar-shaped members are attached to extend in a longitudinal direction between the attachment part of the one support platform and the attachment part of the other support platform, and a distance between the bed main body and the lifting member decreases when the bed main body is raised by the elevator devices, whereas the distance between the bed main body and the lifting member increases when the bed main body is lowered.

A caregiving bed according to an eighth aspect is the caregiving bed according to any of the first to seventh aspects, in which the pad part has an opening part, the opening part is provided with a box-shaped water tank detachably supported and fixed to the pad part, the water tank being opened to the opening part and having a bottom part provided with a drain that is openable and closable, and a frame that is divided into a plurality of parts is detachably disposed on the water tank to cover the opening part, and a mat is detachably placed on the frame.

A caregiving bed according to a ninth aspect is the caregiving bed according to the eighth aspect, in which the bed main body includes side surface parts formed to droop downward from edge sides of the pad part, and support members supporting the water tank are provided inside the side surface parts.

A caregiving bed according to a tenth aspect is the caregiving bed according to the first aspect, in which the pad part is provided with a detachable frame that is divided into a plurality of parts, and a mat is detachably placed on the frame, the suspension member is a connection member attached to the support columns provided in one of the pair of support platforms, an opposite side of the connection member that is opposed to a side attached to the support columns is attached to both side end parts of the frame, and when the bed main body is lowered by the elevator devices, the support columns, to which the connection member is attached, are raised with respect to the bed main body, and the connection member pulls up the frame to incline the frame.

A caregiving bed according to an eleventh aspect is the caregiving bed according to the first aspect, in which the pad part is provided with a detachable frame that is divided into a plurality of parts, and a mat is detachably placed on the frame, the support columns are formed to have a long side, the bar-shaped members connecting the support columns of the one support platform with the support columns of the other support platform are attached to the attachment parts of the long support columns along a longitudinal direction of the bed main body, coupling members coupled with end parts of the frame are attached to the bar-shaped members; and the support columns are raised by the elevator devices; the frame, to which the coupling members are attached, is pulled up together as the bar-shaped members are raised; and the frame is inclined.

A caregiving bed according to any of a twelfth aspect is the caregiving bed according to the second, fifth, seventh, tenth, or eleventh aspect, in which each of the pair of support platforms is provided with a transmission mechanism that interlock the bed main body with the support columns, each of the transmission mechanisms includes a rotational member including one end and the other end, the one end being rotatably coupled with a lower end part of an extending member extending downward from the bed main body, and the other end being rotatably coupled with a lower end part of the support column piercing the support platform, the rotational member is attached to a fixed member fixed inside the support platform such that the rotational member is rotatable around a predetermined position, and the extending member extending from the bed main body is raised and the support column is lowered by rotation of the rotational member when the bed main body is raised by the elevator devices, whereas the extending member extending from the bed main body is lowered and the support column is raised by rotation of the rotational member when the bed main body is lowered.

A caregiving bed according to a thirteenth aspect is the caregiving bed according to the twelfth aspect, in which each of the rotational members is provided with a pair of slide grooves formed at respective longitudinal end parts of the rotational member, the slide grooves being parallel with a longitudinal direction of the rotational member, a first fulcrum formed in a lower part of the support column and a second fulcrum formed in a lower part of the extending member extending downward from the pad part of the bed main body or a lower part of the side surface part are slidably engaged with the respective slide grooves, and the first fulcrum and the second fulcrum are slid while rotating in the slide grooves when the rotational member is rotated.

A caregiving bed according to a fourteenth aspect is the caregiving bed according to the first aspect, in which the pad part is provided with a detachable frame that is divided into a plurality of parts, and a mat is detachably placed on the frame, and reclining mechanisms that incline part of the frame and enable reclining are provided on both side surfaces of the bed main body.

A caregiving bed according to a fifteenth aspect is the caregiving bed according to the fourteenth aspect, in which the each of the reclining mechanisms includes a base member provided on a lower surface of the bed main body, a cam plate formed of a substantially triangular plate member having a first vertex part, a second vertex part, and a third vertex part, an actuator provided on a side surface of the support platform, an operating post that is put in and out by the actuator, a link beam of a plate member that is rotatably provided between a distal end part of the operating post and the base member, a link plate of a plate member that is rotatably provided between the distal end part of the operating post and the second vertex part of the cam plate, a movement groove formed with a curved shape between the first vertex part and the third vertex part of the cam plate, and a bar-shaped shaft having a moving shaft that moves in the movement groove and projecting from an upper surface of the bed main body, the cam plate includes a cam fulcrum formed close to the first vertex part and rotatably attached to the base member, and the cam plate rotates around the cam fulcrum by movement of the link plate and the shaft is pushed out by movement of the moving shaft in the movement groove when the operating post is pulled in by the actuator, whereas the shaft is retracted when the operating post is pulled out.

A caregiving bed according to a sixteenth aspect is the caregiving bed according to any of the tenth, eleventh, fourteenth, or fifteenth aspect, in which the pad part has an opening part, the opening part is provided with a box-shaped water tank detachably supported and fixed to the pad part, the water tank being opened to the opening part and having a bottom part provided with a drain that is openable and closable, and the frame is detachably disposed on the water tank to cover the opening part.

A caregiving bed according to a seventeenth aspect is the caregiving bed according to the sixteenth aspect, in which the bed main body includes side surface parts formed to droop downward from edge sides of the pad part, and support members supporting the water tank are provided inside the side surface parts.

A caregiving bed according to an eighteenth aspect is the caregiving bed according to the first aspect, in which the bed main body is provided with a headboard and a footboard covering the one and the other support members, upper surfaces of the headboard and the footboard have an equal height and are higher than a surface of the pad part, and the support columns pass through the upper surfaces of the headboard and the footboard.

A caregiving bed according to a nineteenth aspect is the caregiving bed according to the first aspect, in which each of the support columns is dividable into a part exposed from the bed main body and a part driven in the support platform.

A caregiving bed according to a twentieth aspect is the caregiving bed according to the first aspect, in which the elevator devices provided in the air of support platforms operate together.

A caregiving bed according to a twenty-first aspect is the caregiving bed according to the first aspect, in which the bed main body, the support platforms, and the support columns are formed of any of wood, leather, metal, synthetic resin, or a combination thereof.

A caregiving bed according to a twenty-second aspect is the caregiving bed according to any of the first, eighteenth, or twenty-first aspect, in which the support columns are formed to have a long side, the bar-shaped members connecting the support columns of the one support platform with the support columns of the other support platform are attached to the attachment parts of the long support columns along a longitudinal direction, and daily commodities are placed on the long support columns and the bar-shape members.

A caregiving bed according to a twenty-third aspect is the caregiving bed according to the first aspect, further including a safety device provided with a control unit controlling operation of the elevator devices, and at least one sensor inputting a signal to stop the elevator devices to the safety device.

Advantageous Effects of Invention

The caregiving bed according to the first aspect includes the bed main body being raised and lowered together with the raising and lowering of the elevator devices, and includes the support columns that move contrary to the raising and lowering of the bed main body, and the beam members extending between the support columns, and the support columns and the beam members are provided with the attachment parts to which suspension members are attached. Thus, with the caregiving bed according to the first aspect, it is possible to provide a caregiving bed that allows various usages, by attaching, for example, bar-shaped members or belt members for lifting the lifting member, and connection members for reclining the bed main body to the suspension members. In addition, because the bed main body can be raised and lowered, the bed main body is changed to a lowered state when the care-receiver lies on the bed, to prevent the care-receiver from falling from the caregiving bed, and enables the care-receiver to easily stand or move to a wheelchair or the like. When care is required, the bed main body is changed to a raised state to enable the caregiver in a standing state to easily care the care-receiver. The support columns may be provided on side surfaces of the support platforms, or upper sides of the support platforms. In the case where the support columns are provided on upper sides of the support platforms, the pad part may be provided with through holes through which the support columns extend.

With the caregiving bed according to the second aspect, because the lifting member including belt members serving as the suspension member is attached to at least one of the support columns and the beam members of the one support platform and the other support platform, the care-receiver can be lifted up by lowering the bed main body in a state in which the care-receiver is laid on the lifting member. In this manner, it is possible to easily change the bedding or the mat placed on the pad part and clean the pad part.

With the caregiving bed according to the third aspect, the belt members divided into parts suppress the fear that long belt members of the lifting member may hit or twine around the care-receiver, and enhances safety.

With the caregiving bed according to the fourth aspect, because the attachment belt members formed in a ring shape are attached to the support columns or the beam members of the caregiving bed, it is unnecessary to provide the support columns or the beam members with any special structure, except for parts for preventing the ring-shaped attachment belt members from being displaced. In addition, the attachment belt members can be easily attached and detached.

The caregiving bed according to the fifth aspect enables the structure in which the belt members are attached to pad part attachment parts of the pad part, and the lifting member is placed via the beam members extending between the support columns. This structure broadens the width of design of the caregiving bed.

With the caregiving bed according to the sixth aspect, the belt members divided into parts suppresses the fear that long belt members of the lifting member may hit or twine around the care-receiver, and enhances safety.

With the caregiving bed according to the seventh aspect, because the bar-shaped members serving as the suspension member is attached to at least one of the support columns and the beam members of the one support platform and the other support platform, and the lifting member is suspended by the bar-shaped members. In this manner, the care-receiver can be lifted up by lowering the bed main body in a state in which the care-receiver is laid on the lifting member. It is thus possible to easily change the bedding or the mat placed on the pad part and clean the pad part.

With the caregiving bed according to the eighth aspect of the present invention, because the pad part of the bed main body is provided with the water tank, the care-receiver can excrete to the water tank provided under the opening part through the gaps of the frame, and easily perform excretion without moving, by removing the mat for the hip part of the care-receiver provided in the part of the bed main body in which the opening part is formed. The caregiver can easily dispose excrement through the drain and the drainpipe by flushing away the excrement in the water tank with water of a portable shower or the like, and wash the water tank clean. The caregiver can also easily wash the hip part of the care-receiver, by removing the mat for the hip part of the care-receiver. It is also possible to easily wash the care-receiver's face and hair by removing the mat for the head part of the care-receiver. The wastewater collected in the water tank can be easily drained by connecting a simple pump or the like to a distal end of the drainpipe provided for the water tank and opening the drain, and it is unnecessary to rebuild the house or perform pipe laying. When the lifting member is used, the care-receiver is lifted up by lowering the bed main body in a state in which the care-receiver is laid on the lifting member, all the mats and the frames on the pad part are removed, the water tank under the pad part is filled with hot water, and then the bed main body is raised. In this manner, the care-receiver can be easily put into the hot water in the water tank through the opening part of the pad part, and the care-receiver's whole body can be easily bathed. It is also possible to shower the care-receiver's whole body using a portable shower or the like, by changing the caregiving bed to a state where all the mats are removed and all the frames are placed.

With the caregiving bed according to the ninth aspect, because the water tank is supported by not only the lower part of the pad part of the bed main body but also the support members provided inside the side surface parts, the water tank can withstand a heavy weight.

With the caregiving bed according to the tenth aspect, the frame can be inclined in accordance with the raising and lowering of the bed main body, and the care-receiver can be disposed in a reclined state with a simple structure.

With the caregiving bed according to the eleventh aspect, the bar-shaped members extend between the long support columns and run along a longitudinal direction of the bed main body, coupling members couple the bar-shaped members with the frame to be reclined, whereby the support columns and the bar-shaped members are raised when the bed main body is lowered. In this manner, the coupling members are pulled up and the frame is pulled up together, to enable reclining. Thus, reclining can be performed with a simple structure, and the manufacturing cost for the caregiving bed is reduced.

With the caregiving bed according to the twelfth aspect, because the transmission members provided in the bed main body are coupled with the support columns provided in the one support platform and the other support platform via the rotational members, the support columns are moved together with the raising and lowering of the bed main body. Specifically, the support columns are lowered when the bed main body is raised. In contrast, the support columns are raised when the bed main body is lowered. Thus, the distance of movement of the support columns increases even when the bed main body is raised and lowered with a small distance, that is, even when the elevator devices are moved with a small distance. In this manner, large raising and lowering can be performed even when the caregiving bed is formed in a low position. When the care-receiver lies on the bed, the caregiving bed can be set in a lowered position to remove the care-receiver's uneasiness. When the care-receiver is cared, the caregiving bed can be raised to a high position to enable the caregiver to easily provide care.

In the case of using conventional transmission mechanisms, when the conventional transmission mechanisms rotate, rotational parts coupled to the transmission mechanisms extend to the width of the rotational members in accordance with rotation, and thus the support columns are required to be capable of reciprocating. In contrast, the caregiving bed according to the thirteenth aspect adopts transmission mechanisms in which sliding grooves are formed in the rotational members coupled with the rotational parts. Because each rotational part is slid in the sliding grooves, the rotational parts such as the support columns only have to vertically move, and are not required to have a structure for reciprocating motion. Thus, with the caregiving bed according to the thirteenth aspect, rotational members with a simple structure can simultaneously control the vertical movement of the bed main body and the reverse vertical movement of the support columns. It is possible to change the ratio of the distance of vertical movement of the support columns to the distance of the vertical movement of the bed main body, by changing the position where the fixing member of the transmission mechanism is disposed and the position where the rotational member of the transmission mechanism is pivotally supported.

With the caregiving bed according to the fourteenth aspect, the caregiving bed can be provided with reclining mechanisms, and it is possible to provide a caregiving bed that can be comfortably used by the care-receiver, and enables the caregiver to easily provide care.

With the caregiving bed according to the fifteenth aspect, many members of each reclining mechanism provided in the caregiving bed are plate-shaped members, and each reclining mechanism is formed of a combination of the members. This structure reduces the space for placing the reclining mechanisms on both sides of the bed main body, and reduces the size of the caregiving bed.

With the caregiving bed according to the sixteenth aspect, the bed main body provided with the water tank enables a mode of use in which the water tank is used in combination with the reclining. For example, reclining is performed in a state in which the mat and the frame for the leg part of the care-receiver are removed, whereby the care-receiver can sit with knees bent in a state of being provided with a backrest. In this manner, this aspect provides a caregiving bed that can be used in a state where the care-receiver sits in a chair.

With the caregiving bed according to the seventeenth aspect, because the water tank is supported by not only the lower part of the pad part of the bed main body but also support members provided inside the side surface parts, the water tank can withstand a heavy weight.

With the caregiving bed according to the eighteenth aspect, it is possible to provide a caregiving bed having similar effect, even with a headboard and a footboard.

With the caregiving bed according to the nineteenth aspect, each support column can be divided into a part exposed from the bed main body and a part driven in the support platform, and thus the part exposed from the bed main body can be removed when the support column is not in use. In this manner, the caregiver can easily provide care, and the appearance of the caregiving bed is simplified.

With the caregiving bed according to the twentieth aspect, because the elevator device provided in the one support platform and the elevator device provided in the other platform operate together, the bed main body can be raised and lowered in parallel with the floor surface, and the care-receiver is prevented from being inclined and having an unnatural posture.

With the caregiving bed according to the twenty-first aspect, the external appearance of the caregiving bed can be formed of any one of wood, leather, metal, and synthetic resin, or a combination thereof. Such material provides a warm appearance and a sense of luxury. Thus, the caregiving bed can be placed as interior furniture without discomfort, and provides the care-receiver and the caregiver with ease. Japanese cypress and Japanese cedar can be used as the wood material, and it is possible to use the wood material impregnated or coated with resin. The material may be subjected to surface treatment with leather or the like. A synthetic resin material may be processed to have the grain.

With the caregiving bed according to the twenty-second aspect, it is possible to place daily commodities such as a television, a mirror, and a shelf, which are difficult to place in a caregiving bed of related art, and articles necessary for care of the caregiver can be placed. Such a structure provides a caregiving bed that makes the care-receiver comfortable, and enables the caregiver to provide care easily. The caregiving bed may store rehabilitation tools as well as daily commodities, and enables rehabilitation in the caregiving bed.

With the caregiving bed according to the twenty-third aspect, when a signal that is different from a supposed signal is input to the sensor provided in the caregiving bed, the controller of the safety device can stop the operation of the elevator devices of the caregiving bed, and thus safety is enhanced. The controller of the safety device can also control operations of elements other than the elevator devices. For example, the controller can control the reclining, or stop the operation and sound the alarm such as a buzzer, when the care-receiver is drowning in bathing or almost falling from the bed main body.

BRIEF DESCRIPTION OF DRAWINGS

FIG. 100 is an enlarged view of an XC part of FIG. 10B.

DESCRIPTION OF EMBODIMENTS

An embodiment of the present invention will be explained hereinafter with reference to drawings. However, the following embodiment illustrates an example of a caregiving bed for materializing a technical idea of the present invention, and is not aimed at specifying the present invention to it. The present invention is equally applicable to other embodiments included in the claims.

Embodiment 1

Figure 1:
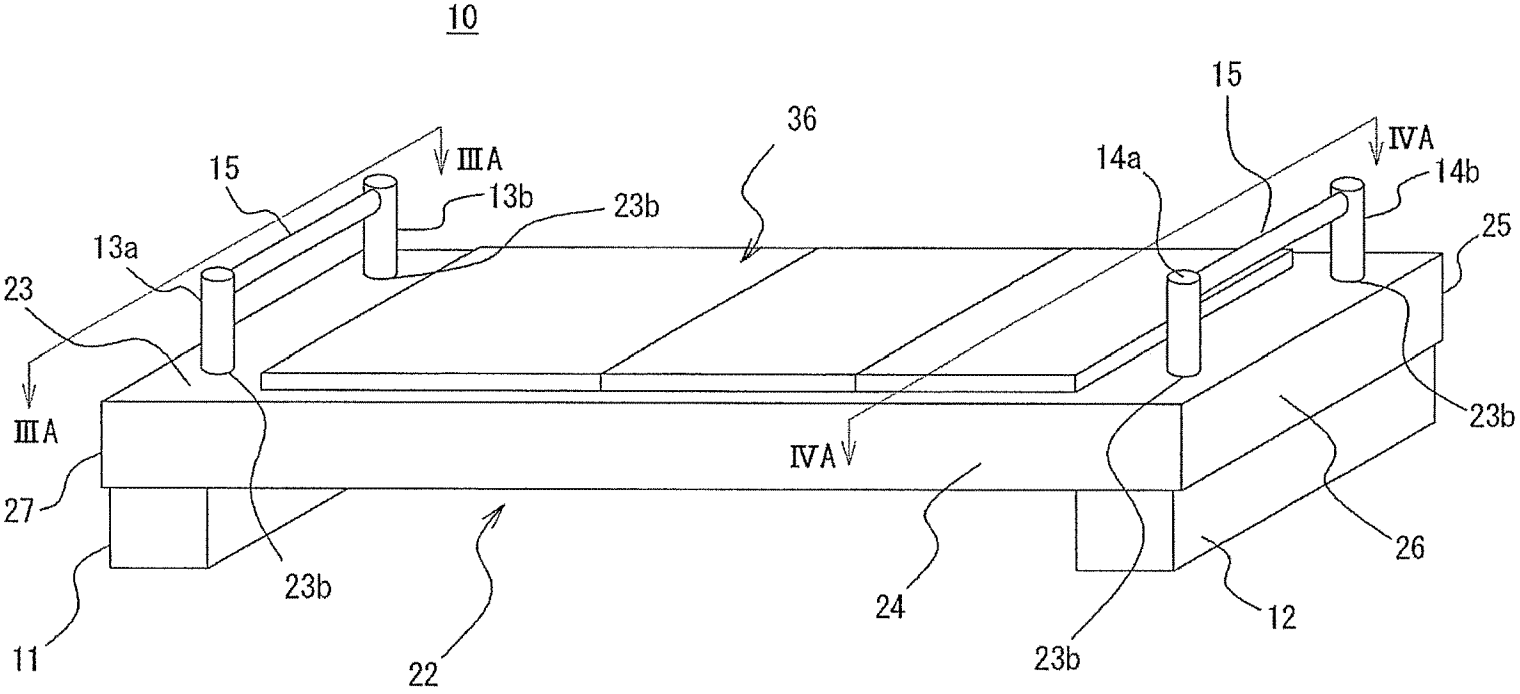
FIG. 1 is a perspective view of a caregiving bed according to Embodiment 1.
Figure 2:
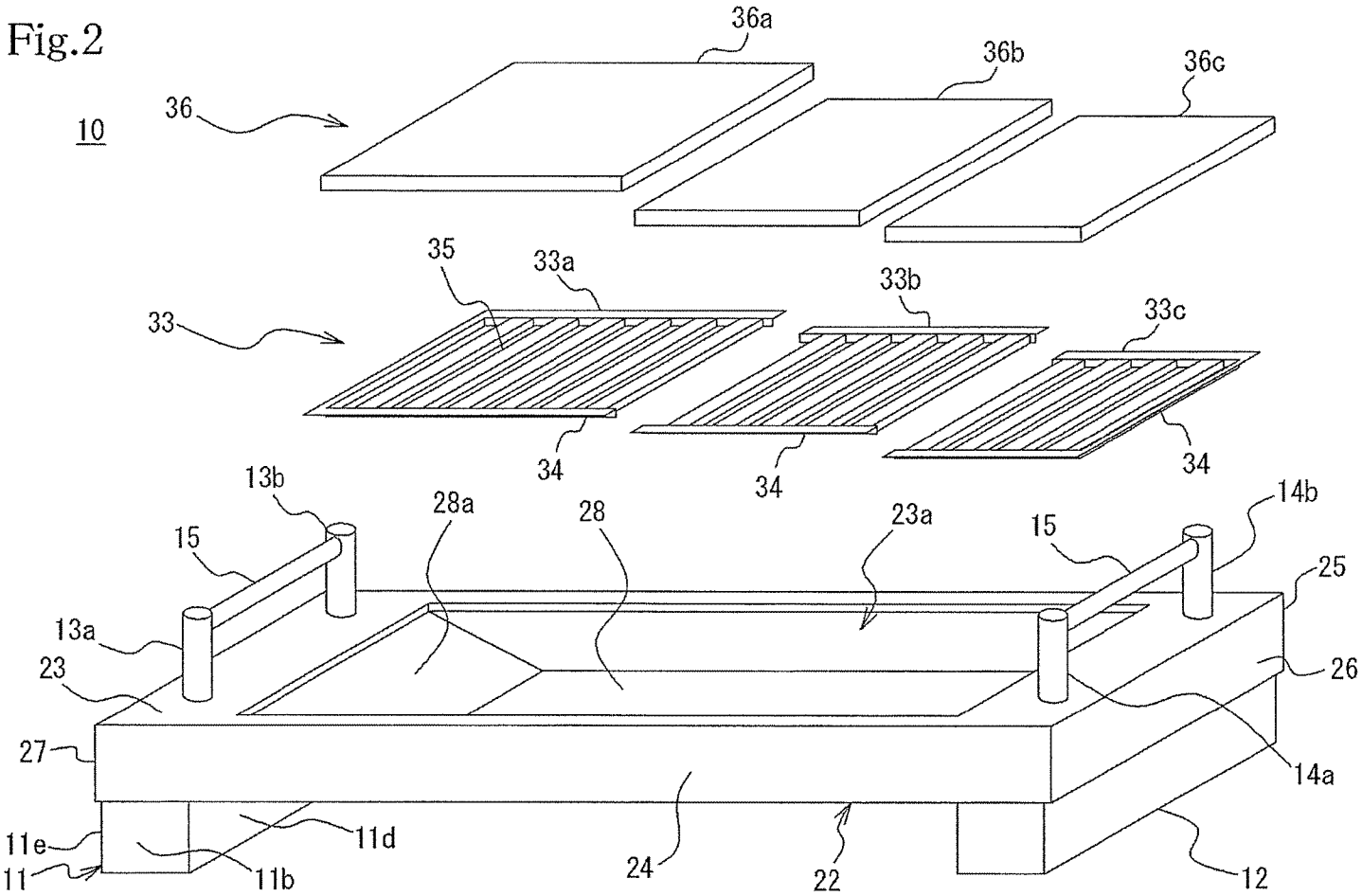
FIG. 2 is an exploded view of the caregiving bed according to Embodiment 1.

A caregiving bed 10 according to Embodiment 1 will be explained with reference to FIG. 1 to FIG. 4. As illustrated in FIG. 1 and FIG. 2, the caregiving bed 10 of Embodiment 1 includes a bed main body 22 on which a care-receiver lies, pair of support platforms 11 and 12 that support the bed main body 22 and are disposed at both longitudinal ends of the bed main body 22, a latticed frame 33, and a mat 36.

As illustrated in FIG. 3, each of the support platforms 11 and 12 is provided with an elevator device 16 that raises and lowers the bed main body 22. Each elevator device 16 includes a publicly known electric actuator. As each elevator device 16, it is possible to use a device that can raise and lower the bed main body 22, such as a jack and a winch mechanism. The jack and the winch mechanism may be electrically driven or manually operated. An electric device enables the caregiver to easily raise and lower the bed main body, and a manual device can be manufactured at low cost. It is also possible to use a device that can be both electrically driven and manually operated, to manually operate the device when the device cannot be electrically driven, such as in power failure. Because the actuator, the jack, and the winch mechanism are publicly known, detailed explanations thereof are omitted. The following describes each of the constituent elements.

First, the support platforms 11 and 12 will be explained hereinafter. The support platforms 11 and 12 are arranged at both longitudinal ends of the bed main body. Because the support platforms 11 and 12 have the same structure, one support platform 11 (hereinafter simply referred to as "support platform") will now be explained as a representative.

As illustrated in FIG. 2 and FIG. 3, the support platform 11 is formed of a rectangular parallelepiped. The rectangular parallelepiped has a length substantially equal to a width of the bed main body 22 that is perpendicular to the longitudinal length of the bed main body 22, and has an inside space that can contain the elevator 16 that raises and lowers the bed main body 22. A rectangular upper surface 11*a* of the rectangular parallelepiped is provided with a pair of upper-surface through holes $\mathbf{11}a_1$, through which support columns 13*a* and 13*b* described later extend vertically move. An opening $\mathbf{11}a_2$ including a movable part that is coupled to the bed main body 22 located above the elevator device 16 is formed in a substantially center part of the upper surface of the support platform 11.

Side surfaces 11*b*, 11*c*, 11*d*, and 11*e* are formed at respective peripheral sides of the rectangular upper surfaces 11*a*, and a bottom surface 11*f* is disposed on the lower side of the side surfaces 11*b* to 11*e* which is opposed to the upper surface. The bottom surface 11*f* is a part that is placed on the floor surface in the room. Thus, the bottom surface may be provided with some legs $\mathbf{11}f_1$ in portions contacting the floor surface. The provided legs $\mathbf{11}f_1$ suppress damage to the floor surface.

Each of a pair of support columns 13*a* and 13*b* provided on the support platform 11 is formed of a column member. In a direction in which the support columns are opposed to each other, a beam member 15 is provided in parallel with the width direction of the bed main body to extend between upper parts of the support columns 13*a* and 13*b*. Upper end parts $\mathbf{13}a_1$ and $\mathbf{13}b_1$ of the support columns 13*a* and 13*b* are provided with attachment parts $\mathbf{13}a_3$ and $\mathbf{13}b_3$ (see FIG. 9), to which bar-shaped members 37 are attached. The bar-shaped member 37 is provided along the longitudinal direction of the bed main body to extend between upper ends of one support column 13*a* of one support platform 11 and one support column 14*a* of the other support platform 12 (see FIG. 9). Details of the elevator device 16 provided inside the support platform 11 will be described later.

The support columns may be configured to be detachable in accordance with the mode of use of the caregiving bed 10 (see FIG. 30). In addition, it is preferable that the support platforms 11 and 12 and the support columns 13*a*, 13*b*, 14*a*, and 14*b* be antibacterially treated. Antibacterial support platforms and support columns are kept clean, and suppress infection to the care-receiver and bad smell from the support platforms and the support columns.

Next, the bed main body 22 will be explained hereinafter with reference to FIG. 2 and FIG. 4. The bed main body 22 has a pad part 23 formed in a rectangular shape with a predetermined area and thickness that allow a person to lie thereon, and an opening part 23*a* is provided in an center part of the pad part 23. The pad part 23 is also provided with pad-part through holes 23*b*, through which the support columns 13*a*, 13*b*, 14*a*, and 14*b* provided in the support platforms 11 and 12 extend, to correspond to the respective support columns 13*a*, 13*b*, 14*a*, and 14*b*. The latticed frame 33 and the mat 36 are detachably provided on the opening part 23*a* formed in the pad part 23.

On the other hand, edge sides of the rectangular pad part 23 are provided with side surface parts 24, 25, 26, and 27 drooping downward to surround the pad part 23 and cover the support columns 11 and 12. The side surface parts 24, 25, 26, and 27 have a downward length enough to cover the whole or substantially half of each support platform when the bed main body 22 is in the lowered position, and cover the upper part of each support platform when the bed main body 22 is in the raised position. In particular, the side surface parts 24 to 27 have an effect of making the appearance of the caregiving bed 10 fine, and are configured to cover the support platforms 11 and 12 and the water tank 28. The side surface parts 24 to 27 may be provided with various decoration that does not obstruct the care-receiver or the caregiver, or have a shape with fine appearance. The bed main body 22 may be preferably subjected to an antibacterial treatment. Antibacterial treatment keeps the bed main body clean, and suppresses infection to the care-receiver and smell from the bed main body.

Because the bed main body 22 and the support platforms 11 and 12 are configured as separate members, repair and exchange can be performed for each of the bed main body or the support platforms, and it is unnecessary to repair or exchange the whole caregiving bed. This structure reduces manufacturing and repairing cost. In addition, because the support platforms having the same structure are used, the manufacturing cost can be reduced.

The water tank 28 is provided inside the bed main body 22, and formed in a box shape having an upper part that is opened to correspond to the opening part 23*a* of the pad part 23. The opened part of the water tank 28 is provided with a plate-shaped support fixing part 29 projecting toward the outside of the opening, along the outer periphery thereof. The support fixing part 29 is supported and fixed to a lower part 23*c* of the pad part 23. A support plate member 30 is provided between the side surface parts 24 and 25 opposed in the longitudinal direction of the bed main body 22, to support the lower part of the water tank 28 and extend between the side surface parts 24 and 25, such that the support plate member 30 can support the load of the water tank 28 (see FIG. 4A). The water tank 28 may be detachably provided inside the bed main body (see FIG. 31). In such a case, the water tank is detached after the pad part of the bed main body is removed. By adopting such a structure, the water tank can be replaced when the water tank is damaged, or can be replaced with another water tank having another function. In addition, a water tank can be attached later.

The water tank 28 is provided with a drain 31 provided with a plug member 31*a* that can be opened and closed. The plug member 31*a* is configured to be closed when the water tank 28 is filled with liquid such as water and hot water, and the plug member 31*a* is opened when the water is drained (see FIG. 16G). The drain 31 is connected with a drainpipe 32, and the drainpipe 32 is connected to a drain tank to perform drainage. The drainpipe 32 may be directly connected to a sewer pipe that enables drainage in the house. The water tank 28 also includes an inclined part 28*a* (see FIG. 2) to incline the head part of the care-receiver when the care-receiver is bathed. When water is to be supplied, a water-supply tank having the same capacity as the drainage, such as 5 to 30 liters, is installed, whereby water supply such as shower can be performed via a small pump provided on the water-supply tank. Using a water-supply tank like this removes the necessity for pipe laying such as a water pipe.

Because the caregiving bed 10 is sometimes used as a toilet, the water tank 28 may be provided with a coating that is difficult to soil or easy to wash even when soiled, such that excretion can be washed out. The water tank 28 is supported and fixed inside the bed main body 22, and preferably formed of a material that can withstand the weight of the filling water and the weight of the care-receiver and is also lightweight, such as a synthetic resin and metal such as stainless steel, because the care-receiver is bathed therein. A synthetic resin material is easily provided with a coating for preventing contamination, while a stainless steel material provides a water tank with high strength. The strength of the water tank can be further improved by forming the water tank of such material with a rippled shape. The water tank is preferably subjected to an antibacterial treatment. Antibacterial treatment keeps the water tank clean, and suppresses infection to the care-receiver and smell from the water tank.

Next, as illustrated in FIG. 2, the latticed frame (hereinafter simply referred to as "frame") 33 is configured to cover the opening part 23*a* formed in the pad part 23 of the bed main body 22, and cover the water tank 28, and is locked on the bed main body 22 by locking parts 34 provided on the outer periphery of the frame 33. The frame 33 is divided into a plurality of parts. For example, in Embodiment 1, the frame 33 is divided into three parts, that is, a frame 33*a* for the upper half part of the body of the care-receiver, a frame 33*b* for the hip part, and a frame 33*c* for the leg part. Because the frame is divided like this, the caregiver can easily handle the frame.

Because the frame 33 is frequently exposed to liquid such as water according to the mode of use of the caregiving bed 10, the frame 33 is preferably formed of a material that can support the weight of the care-receiver, is resistant to rust and corrosion, and lightweight to enable easy detachment, for example, a synthetic resin material such as reinforced plastic, stainless steel, and aluminum alloy. A lattice part 35 of the frame 33 is preferably formed having a width that prevents the care-receiver from being caught in the lattice part 35 even when the care-receiver directly gets on the lattice part 35 of the frame 33. The lattice of the frame 33*b* for the hip part may be provided with an opening part 33*b*' to enable excrement disposal through this part, or the part for the hip part may have a shape that enables easy excretion, such as a toilet seat (not illustrated). Adopting such structures reduces the possibility that excrement adheres to the frame in excretion, and enables excretion at ease.

As illustrated in FIG. 2, the mat 36 is a part on which the care-receiver lies, and is detachably provided and placed to cover the upper part of the latticed frame 33. The mat 36 is provided and divided into a plurality of parts like the above-described latticed frame 33. For example, in Embodiment 1, the mat 36 is divided into three parts, that is, a mat 36*a* for the upper half of the care-receiver's body, a mat 36*b* for the hip part, and a mat 36*c* for the leg part. Dividing the mat like this enables the caregiver to easily handle the mat. The number of divided parts of the mat is not limited to three. For example, the number may be four by dividing the upper half part into two, or more.

Figure 5A:
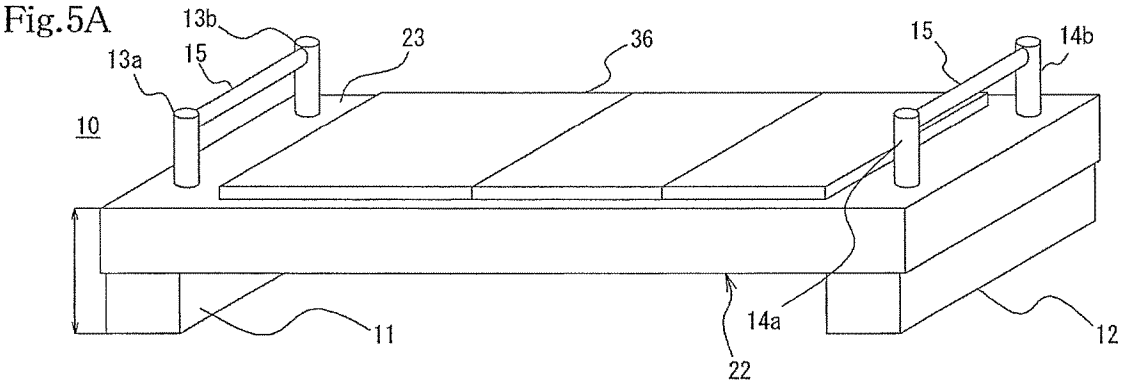
FIG. 5A is a perspective view illustrating a mode of use of the caregiving bed according to Embodiment 1.
Figure 5B:
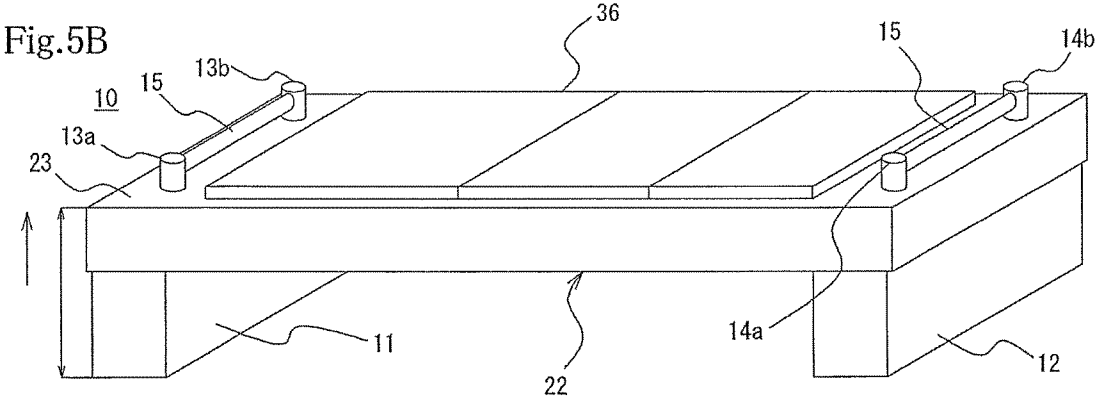
FIG. 5B is a perspective view illustrating a flow following FIG. 5A.

The following describes a mode of use of the caregiving bed of Embodiment 1. The caregiving bed 10 of Embodiment 1 illustrated in FIG. 5 is in a state in which the care-receiver lies thereon. Specifically, the bed main body 22 provided on the support platforms 11 and 12 is in a state in which the whole opening part 23*a* of the pad part 23 is covered with the frame 33 and the mat 36. In this state, as illustrated in FIG. 5A and FIG. 5B, the elevator devices 16 are operated to change the height of the bed main body 22, whereby the height is changed to a height at which the caregiver can easily care the care-receiver. For example, the height of the bed main body 22 should be set low when the care-receiver lies thereon or moves between a wheelchair and the caregiving bed. In addition, when the care-receiver sleeps, the bed main body should be provided with a fall-preventing fence 39 as illustrated (see FIG. 29A). The mode of use of the elevator devices provided inside the support platforms 11 and 12 will be described later.

Because the mat 36 provided on the bed main body 22 is divided, each divided part of the mat can be exchanged for a mat of a different material or the different touch in accordance with the care-receiver's taste. For example, it is possible to select a mat having a different coefficient of restitution, a mat having good air permeability, a mat having waterproofing property, and a mat suitable for the sick region. Because the mat 36 is divided into parts, the mat 36 can be easily washed and dried. Adopting such a structure have good influence on not only the care-receiver's comfort in lying but also caregiver's easy care. The mat 36 is preferably subjected to an antibacterial treatment. Antibacterial treatment keeps the mat clean, and suppresses infection to the care-receiver and smell from the mat.

Figure 6A:
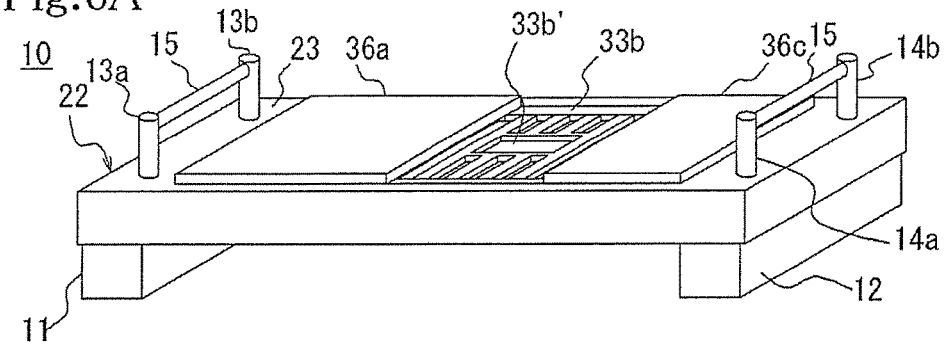
FIG. 6A is a perspective view illustrating another mode of use of the caregiving bed according to Embodiment 1.
Figure 7A:
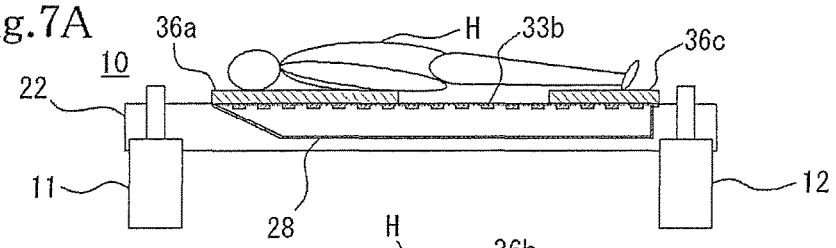
FIG. 7A to FIG. 7E are side views of the caregiving bed, part of which is cross-sectioned, illustrating a mode of use thereof including a care-receiver.

As another mode of use of the caregiving bed 10, in the caregiving bed 10 illustrated in FIG. 6A and FIG. 7A, only the mat 36*b* disposed at the hip part of a care-receiver H is removed, to expose the latticed frame 33*b* at the hip part. In this manner, liquid such as water can be poured into the water tank 28 located under the frame 33*b* for the hip part. Such a mode of use enables the care-receiver to excrete. After excretion, the water tank 28 can be washed with water or hot water, using a simple pump or the like. It is also possible to change the care-receiver's diaper, and wash the care-receiver's hip part when the hip part is soiled. Using a paper diaper that can be flushed with water enables easy disposal of excrement adhering to the paper diaper, and further reduces the burden on the caregiver.

Easy washing of the hip part is effective not only for the care-receiver's physical health but also mental health, and suppresses bed sore. In addition, because the hip part of the care-receiver can be easily washed, burden on the caregiver and the care-receiver is reduced even when the number of times of washing is increased, and consequently the level of unpleasant smells can be reduced. Because the caregiver can easily perform washing, the caregiver can easily provide care. The amount of use of paper diapers for the care-receiver can be reduced, because the care-receiver can readily excrete and the hip part can be easily washed.

In addition, because the mat 36 is divided, the mat 36 can be removed simply by lifting part of the care-receiver's body and pulling out the mat 36, and thus burden on the caregiver is reduced. The lattice is preferably subjected to an antibacterial treatment. Antibacterial treatment keeps the lattice clean, and suppresses infection to the care-receiver and smell from the lattice.

Figure 4A:
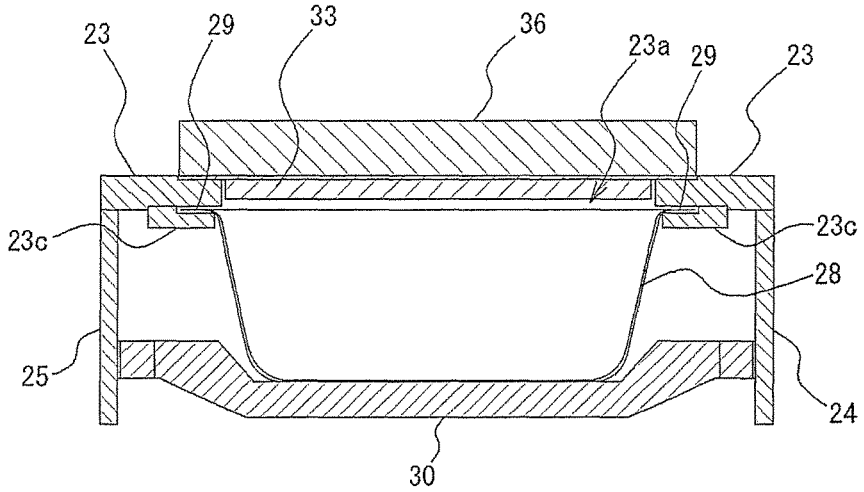
FIG. 4A is a cross-sectional view taken along line IVA-IVA in FIG. 1.
Figure 4B:
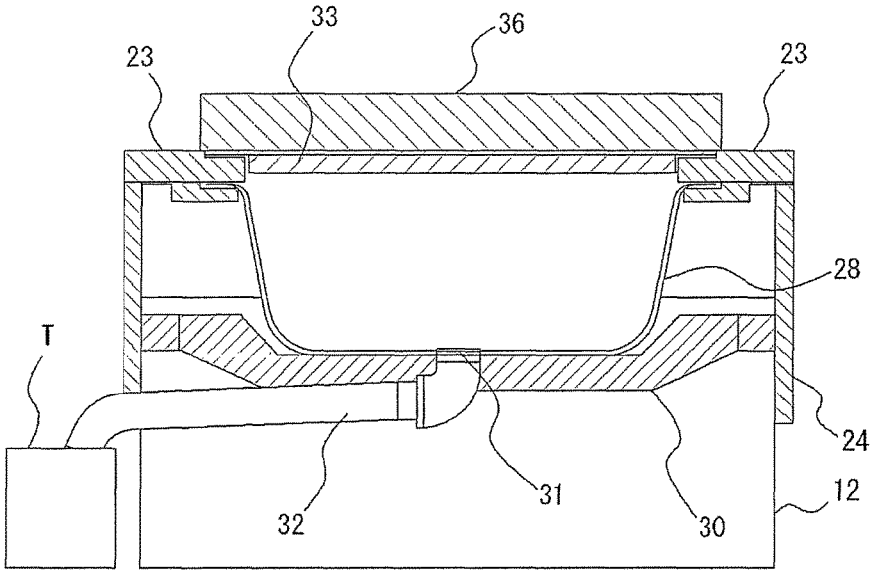
FIG. 4B is a cross-sectional view illustrating a state of use following FIG. 4A.

Drainage of the water tank 28 will be explained hereinafter with reference to FIG. 4B. The water tank 28 is provided with the drain 31 as described above, and the drain 31 is configured to be opened and closed. The drainpipe 32 is connected with the drain 31. The drainpipe 32 is disposed inside the bed main body 22, and an end part thereof is oriented toward the outside of the bed main body 22. The end part of the drainpipe 32 is provided with, for example, a drainage tank for drainage. The waste water collected in the water tank 28 passes through the drain 31 and the drainpipe 32 and is collected in a drainage tank T or the like, by natural drop due to gravity, because the bed main body is disposed above. Thereafter, the drainage tank T is drained from a household toilet or the like to a sewer. The drainpipe 32 is configured to be slightly inclined to smoothly perform drainage. The drainpipe 32 may be directly connected to a sewer without temporarily collecting water in a drainage tank or the like. Although a simple pump may be used, it is necessary to care about maintenance of the simple pump, such as pump clogging, when the simple pump is used. The drain, the drainpipe, and the drainage tank are preferably subjected to an antibacterial treatment. Antibacterial treatment keeps the water tank clean, and suppresses infection to the care-receiver and smell from the water tank.

Figure 6B:
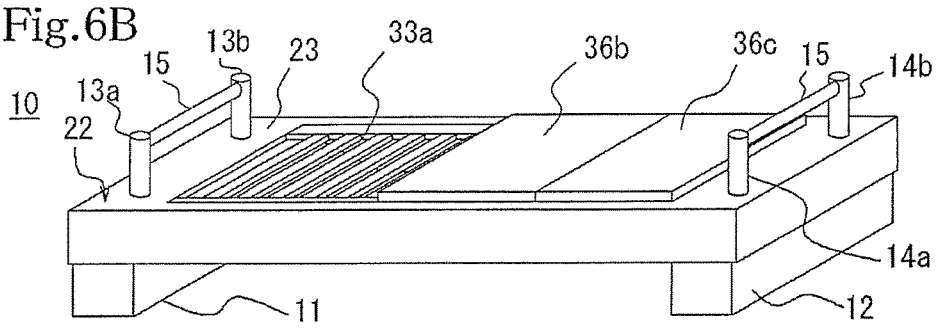
FIG. 6B is a perspective view illustrating a mode of use different from FIG. 6A.
Figure 6C:
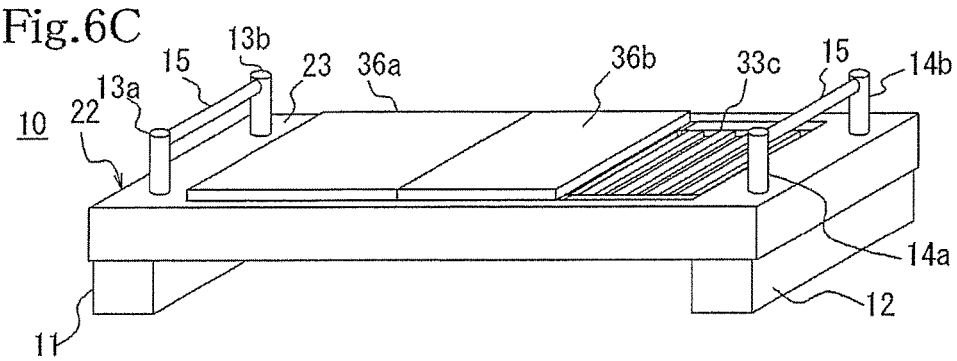
FIG. 6C is a perspective view illustrating a mode of use different from FIG. 6A, and FIG. 6D and FIG. 6E illustrate other examples of a frame.
Figure 6D:
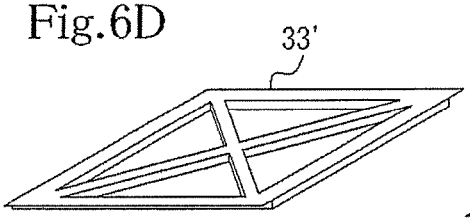
Figure 6E:
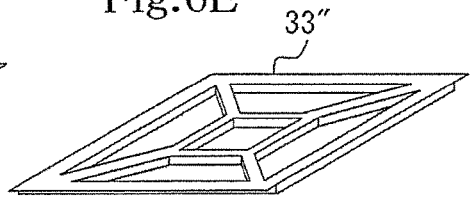
Figure 7B:
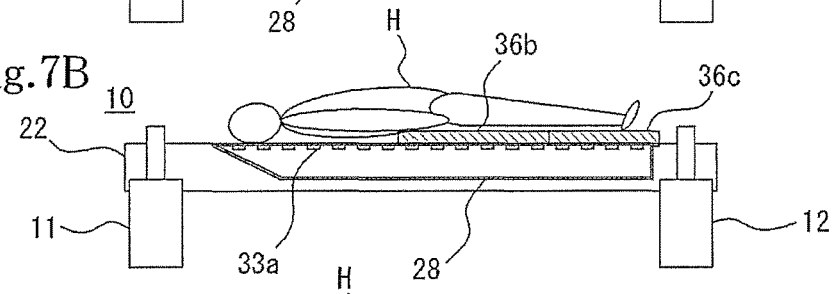
Figure 7C:
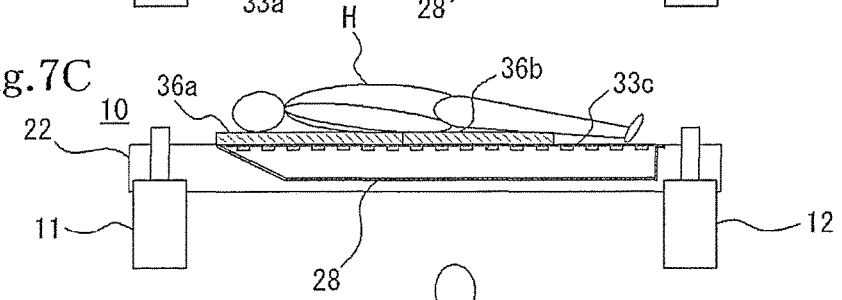
Figure 7D:
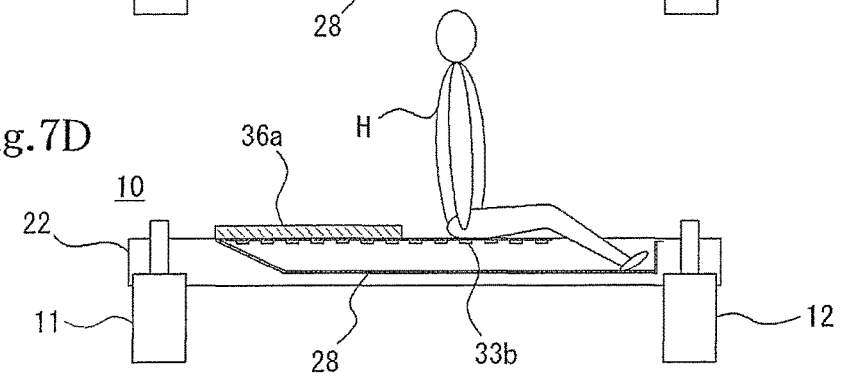
Figure 7E:
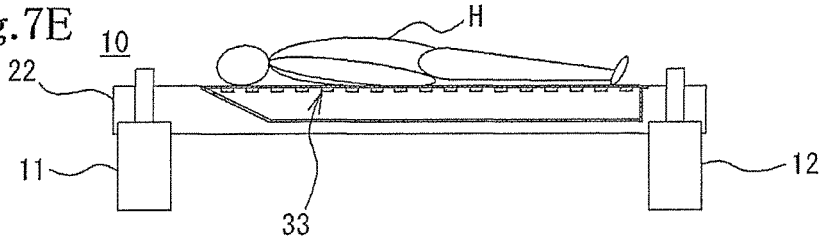

As well as the hip part, the mat 36*a* for the upper half part of the mat 36 can be removed to wash hair (see FIG. 6B and FIG. 7B), and the mat 36*c* for the leg part can be removed to wash the legs (see FIG. 6C and FIG. 7C). In addition, the legs can be bathed by removing the mat 36*c* and the frame 33*c* for the leg part (see FIG. 2) and filling the water tank 28 with hot water. As illustrated in FIG. 7D, the legs can also be bathed by removing the mats for the hip part and the leg part and seating the care-receiver on the frame. As illustrated in FIG. 7E, all the mats can be removed. An example of the mode of use in which all the mats are removed will be described later. As the frame, it is possible to use a frame 33' in which beam members are formed on the diagonal lines in a frame as illustrated in FIG. 6D, or a frame 33" in which a square or rectangular beam member is provided in the center as illustrated in FIG. 6E, as well as the latticed frame used in the embodiment.

Figures 8A, 8B, 8C:
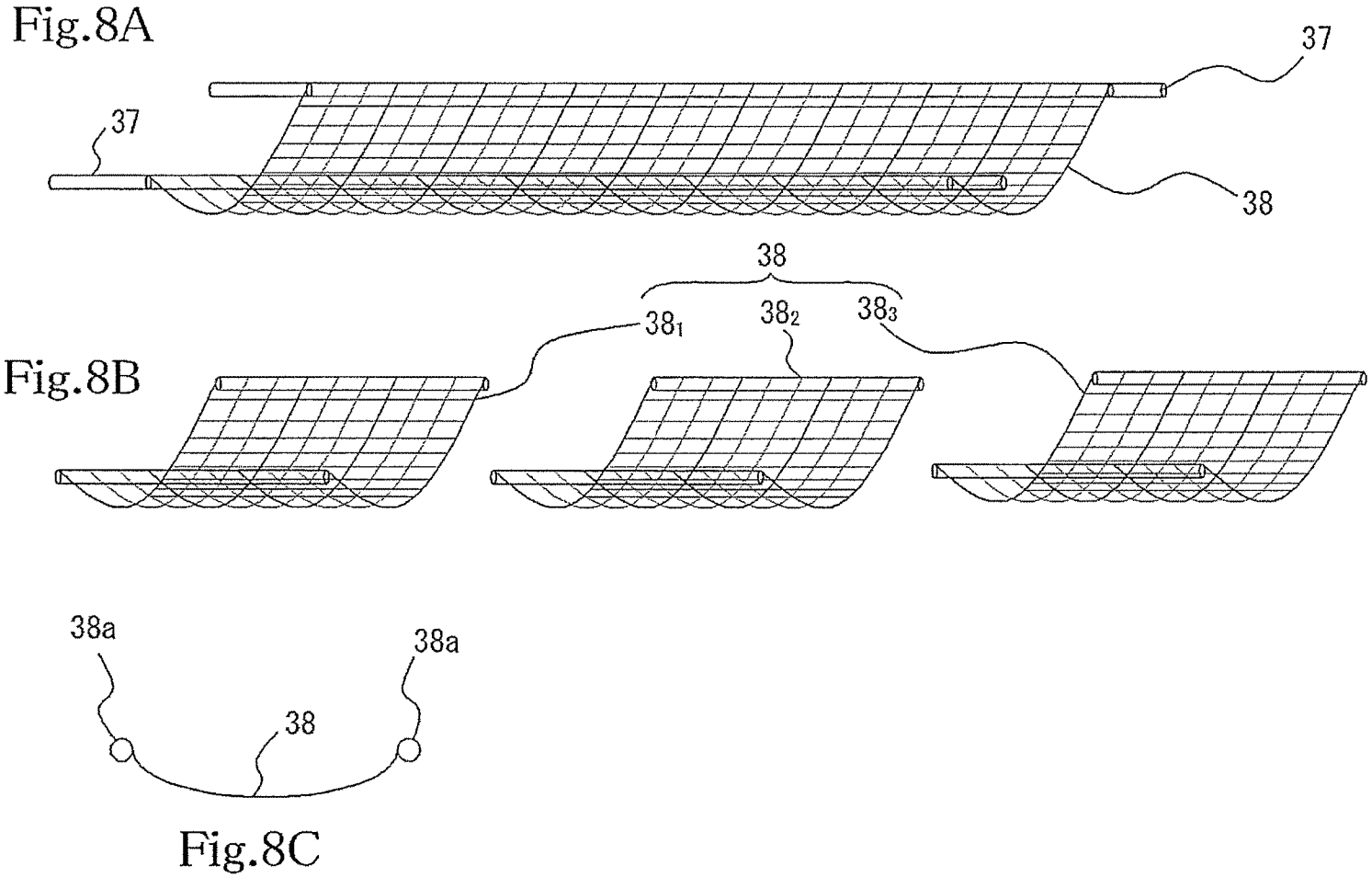
FIG. 8A is a perspective view illustrating a state in which a hammock is attached to bar-shaped members.
FIG. 8B is a perspective view of the hammock in a divided state.
FIG. 8C is a side view of the hammock.
Figure 9A:
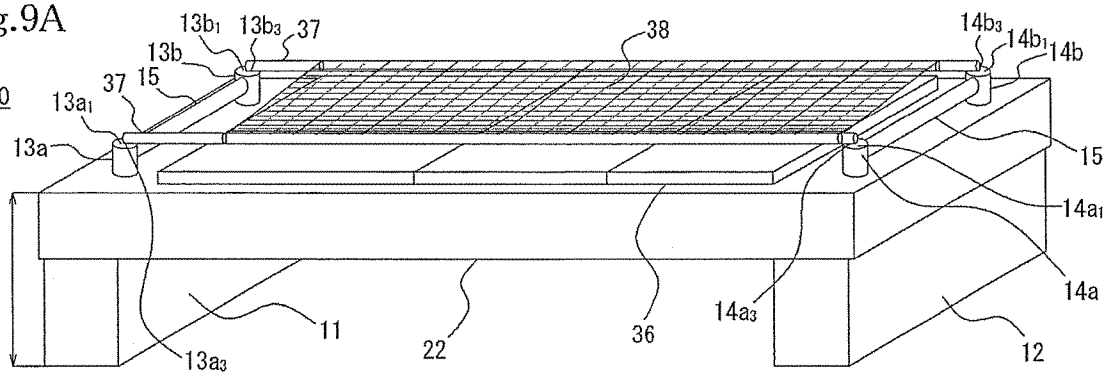
FIG. 9A is a perspective view illustrating a mode of use for using a shower of the caregiving bed, and illustrating a flow following FIG. 5B.

Next, explained hereinafter is a mode of use of the caregiving bed 10, in which a hammock 38 serving as a lifting member is attached to the caregiving bed 10, and how to exchange the mat 36 and the bedding and a bed sheet (not illustrated) placed on the pad part 23 of the bed main body 22. First, the bed main body 22 on which the care-receiver lies is raised from a lowered state illustrated in FIG. 5A to an upper position as illustrated in FIG. 5B using the elevator devices 16, and a hammock 38 serving as a lifting member is disposed under the care-receiver. Then, as illustrated in FIG. 8A and FIG. 9A, a pair of bar-shaped members 37 are attached to the upper end parts $\mathbf{13}a_1$, $\mathbf{13}b_1$, $\mathbf{14}a_1$, and $\mathbf{14}b_1$ of the support columns provided on the support platforms 11 and 12, in parallel with the longitudinal direction of the bed main body 22, to extend between the support columns 13*a* and 13*b* of the support platform 11 and the support columns 14*a* and 14*b* of the other platform 12. The attachment can be performed by providing the upper end parts of the support columns with attachment parts $\mathbf{13}a_3$, $\mathbf{13}b_3$, $\mathbf{14}a_3$, and $\mathbf{14}b_3$, such as projecting locking projections, providing the bar-shaped members with locking grooves engaged with the locking projections, and fitting the locking projections with the locking grooves.

The hammock 38 serving as a lifting member has a length exceeding the height of the care-receiver, to lift the care-receiver. The hammock is formed of a resistant material that enables lifting the care-receiver. For example, woven nylon and glass fiber can be used. As illustrated in FIG. 8B, the hammock 38 is divided into a plurality of parts, and is configured to be used as a hammock when the hammocks $\mathbf{38}_1$ to $\mathbf{38}_3$ are attached to the bar-shaped members 37.

After the hammock 38 is attached to the above-described bar-shaped members 37, the bar-shaped members 37 are attached to the support columns 13*a*, 13*b*, 14*a*, and 14*b*. During attachment, the hammock 38 is attached to the bar-shaped member 37, by making loops 38*a* that allow the bar-shaped members 37 to extend through the longitudinal ends of the hammock 38, and inserting the bar-shaped members 37 through the loops 38 (see FIG. 8C). Although the loops 38*a* formed at the hammock 38 are formed of the same material as that of the hammock and formed to be strong enough to support the weight of the care-receiver, the loops 38*a* can be flattened when load is applied onto the loops, because the loops 38*a* are hollow.

The hammock 38 can be attached to the bar-shaped members 37 after the bar-shaped members are attached to the support columns. In such a case, the parts of the hammock 38 to be attached to the bar-shaped members should be made particularly strong to prevent the care-receiver from falling. For example, metal hooks may be used as the parts. The bar-shaped members 37 also need to have a sufficient strength to support the weight of the care-receiver lifted by the hammock 38, and is light enough that the caregiver can detach and attach the bar-shaped members 37. For example, the bar-shaped members 37 can be formed of a metal material or a synthetic resin material with a long pipe shape, or a hard wood material. The bar-shaped members 37 are configured to bend in a longitudinal direction or be elastic, at the upper end parts $\mathbf{13}a_1$, $\mathbf{13}b_1$, $\mathbf{14}a_1$, and $\mathbf{14}b_1$ provided with the attachment parts $\mathbf{13}a_3$, $\mathbf{13}b_3$, $\mathbf{14}a_3$, and $\mathbf{14}b_3$ in the support columns 13*a*, 13*b*, 14*a*, and 14*b*, and thereby bend and arch to absorb load on the mechanism due to the care-receiver's weight when the care-receiver is lifted by the hammock.

Because the hammock can be attached in a divided state as illustrated in FIG. 8, the hammock can be partly used. For example, when the hip part is washed, the hammock is attached to the hip part to lift only the care-receiver's hip part. When the legs are washed, the hammock is attached to the leg part and used. The hammock and the bar-shaped members are preferably subjected to an antibacterial treatment. Antibacterial treatment keeps the hammock and the bar-shaped members clean, and suppresses infection to the care-receiver and smell from the hammock and the bar-shaped members. The hammock can be suspended in the longitudinal direction (not illustrated), by setting bar-shaped members attached to the upper ends of the support columns in parallel with a short direction of the bed main body. This structure prevents the longitudinal bar-shaped members and the belt member of the hammock attached to the bar-shaped members from obstructing the care work of the care-giver, and enables more stable care work.

A curtain can be suspended by the bar-shaped members, as well as the hammock. By adopting a structure in which a curtain can be provided, a shower curtain can be provided in shower, and a blind or sunshade curtain can be provided when the care-receiver is asleep.

Next, as illustrated in FIG. 9A, the hammock 38 on which the care-receiver lies is attached to the bar-shaped members 37, and the bar-shaped members 37 are attached to the support columns 13*a*, 13*b*, 14*a*, and 14*b*. Because the hammock has not been stretched yet in the attachment, the bar-shaped members 37 can be easily attached. In addition, disposing the bed main body 22 in an upper position brings the upper end parts $\mathbf{13}a_1$, $\mathbf{13}b_1$, $\mathbf{14}a_1$, and $\mathbf{14}b_1$ of the support columns 13*a*, 13*b*, 14*a*, and 14*b* relatively close to the pad part 23 of the bed main body 22, thus shortens the distance of lifting up the bar-shaped members 37, and facilitates attachment of the bar-shaped members 37.

Figure 9B:
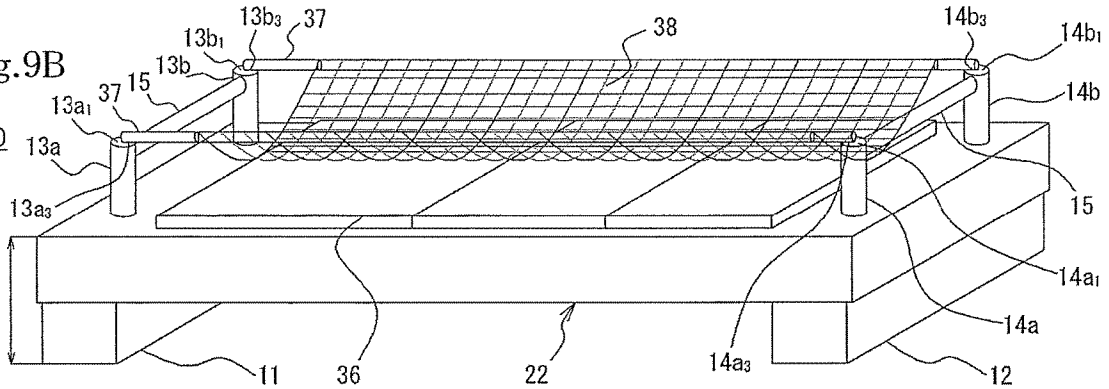
FIG. 9B is a perspective view illustrating a flow following FIG. 9A.

Thereafter, as illustrated in FIG. 9B, the bed main body 22 is lowered using the elevator devices 16. In this manner, the support columns 13*a*, 13*b*, 14*a*, and 14*b* of the support platforms 11 and 12 are raised with the lowering of the bed main body 22, and the bar-shaped members 37 are relatively raised together with the support columns 13*a*, 13*b*, 14*a*, and 14*b* to stretch the hammock 38. When the hammock 38 becomes a stretched state, the care-receiver on the hammock 38 is lifted. In this state, the beam members 15 provided between the support columns 13*a*, 13*b*, 14*a*, and 14*b* prevents the support columns from being bent due to the care-receiver's weight.

By using the lifting member and the elevator devices of the caregiving bed of Embodiment 1, the care-receiver can be easily lifted from the mat, the mat and the sheet put on the mat can be easily changed, and the bed can be kept clean.

Figure 3A:
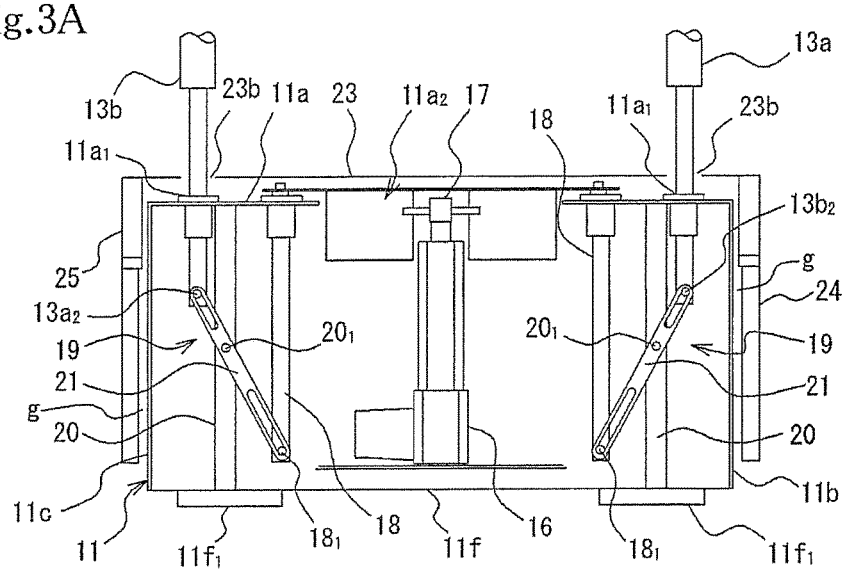
FIG. 3A is a cross-sectional view taken along line IIIA-IIIA in FIG. 1.
Figure 3B:
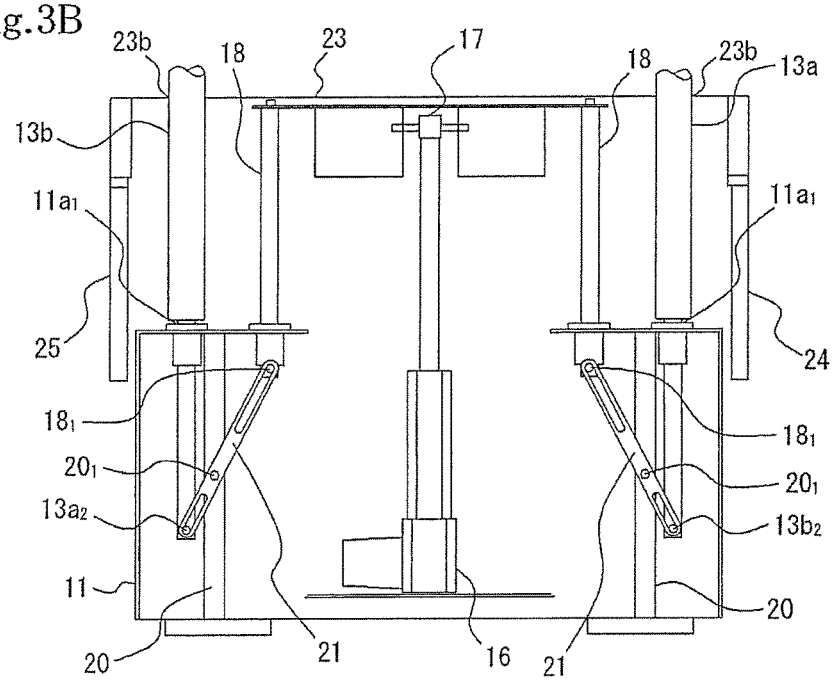
FIG. 3B is a cross-sectional view illustrating a state of use following FIG. 3A.

The raising and lowering of the bed main body 22 will be explained hereinafter, with reference to FIG. 3A and FIG. 3B. In the caregiving bed 10 of Embodiment 1, each of the support platforms 11 and 12 is provided with the elevator device 16, and the bed main body 22 can be raised and lowered by the elevator devices 16. In the caregiving bed 10 of Embodiment 1, the support platforms 11 and 12 are provided with the support columns 13*a*, 13*b*, 14*a*, and 14*b*, and the length of the support columns 13*a*, 13*b*, 14*a*, and 14*b* projecting from the bed main body 22 are changed by raising and lowering the bed main body 22. The support platform 11 will be explained in the same manner, as a representative of the structure of the bed main body 22, the support columns 13*a*, 13*b*, 14*a*, and 14*b* and the elevator device 16. An actuator 16 serving as the elevator device 16 and being vertically movable is provided inside the support platform 11 and in a center position of the support platform 11.

An upper end of an operating part 17 of the actuator 16 is coupled with the pad part 23 of the bed main body 22, to vertically move the bed main body 22 in accordance with vertical movement of the operating part 17 of the actuator 16. The bed main body 22 is provided with extending members 18 that extend downward from the pad part 23 of the bed main body 22. On the other hand, transmission mechanisms 19 are provided inside the support platform 11. Each transmission mechanism 19 is formed of a fixing member 20 fixed to the support platform 11, and a rotational member 21 that pivotally supports a central portion $\mathbf{20}_1$ of the fixing member 20 and is rotatably attached. The support platform 11 is provided with the support columns 13*a* and 13*b* extending through respective upper-surface through holes $\mathbf{11}a_1$ of the upper surface 11*a* of the support platform 11 and respective pad-part through holes 23*b* of the pad part 23 of the bed main body 22.

Both end parts of each rotational member 21 are rotatably connected to a second fulcrum $\mathbf{18}_1$ in a lower part of the extending member 18, and a first fulcrum $\mathbf{13}a_2$ or $\mathbf{13}b_2$ of in a lower part of the support column 13*a* or 13*b*. A pair of extending members 18, a pair of transmission mechanisms 19, and a pair of support columns 13*a* and 13*b* are provided symmetrically with respect to the actuator 16 serving as the center. In this manner, when the actuator 16 vertically moves, the bed main body 22 also vertically moves in accordance with the movement of the operating part 17 of the actuator, and the vertical movement of the bed main body 22 is transmitted to the extending members 18 extending from the pad part 23, to vertically move the extending members 18. In this manner, the rotational members 21 pivotally supported by the fixing members 20 are rotated around the pivotally supported parts, and the rotational movement is transmitted to the support columns 13*a* and 13*b*.

When the bed main body 22 is raised, the support columns 13*a* and 13*b* are lowered. In contrast, when the bed main body 22 is lowered, the support columns 13*a* and 13*b* are raised. When the transmission mechanisms 19 are provided as described above, the raising and lowering of the bed main body 22 and the raising and lowering of the support columns 13*a* and 13*b* are reversed to each other. Thus, a movement of the actuator 16 with a small distance generates a large relative displacement between the bed main body 22 and the support columns 13*a* and 13*b*.

Because the elevator device 16 is provided in each of the support platform 11 and the support platform 12, the bed main body 22 can be raised and lowered in parallel. Because the support columns 13*a*, 13*b*, 14*a*, and 14*b* are also raised and lowered in parallel, the bar-shaped members 37 attached to the attachment parts $\mathbf{13}a_3$, $\mathbf{13}b_3$, $\mathbf{14}a_3$, and $\mathbf{14}b_3$ of the upper end parts $\mathbf{13}a_1$, $\mathbf{13}b_1$, $\mathbf{14}a_1$, and $\mathbf{14}b_1$ of the support columns 13*a*, 13*b*, 14*a*, and 14*b* can be raised and lowered in parallel, and the care-receiver on the hammock 38 attached to the bar-shaped members 37 can be stably raised and lowered in safety. In this operation, the elevator device 16 of one support platform 11 should be operated together with the elevator device 16 of the other support platform 12, whereby the bed main body can be raised and lowered without being inclined, which makes the care-receiver feel relieved and further enhances safety. A guide rail (not illustrated) may be provided between the inside of the bed main body 22 and each of the support platforms 11 and 12, for example, in a gap g. The guide rails provided reduces the shaking of the bed main body when the bed main body is raised and lowered. Because the bed main body can be lowered to the height of the thickness of the bathtub, the bed main body can be lowered to a low position. The pad part of the bed main body can be further lowered by designing the bathtub to have a small thickness, and such a structure prevents an injury of the care-receiver caused by falling.

Each support column may be formed as a long member, or may be divided into two parts. For example, each support column may be detachably divided into a part exposed out of the bed main body and a part that is driven inside the support platform, and the part exposed out of the bed main body may be detached and attached when necessary. In the mode in which support columns are out of use, when the bed main body is raised and lowered, the support columns are also raised and lowered, and may be an obstacle to the caregiver. In this manner, by adopting the above structure, the part exposed out of the bed main body is configured to be detachable, whereby the caregiver can easily provide care. The attachment may be preferably performed by screwing. The beam members extending between the support columns prevent the support columns from being rotated and being easily removed, and thus enhances safety during use. In addition, because the support columns can be attached later, another function can be easily added.

Although a case is explained where the caregiving bed 10 of Embodiment 1 is provided with transmission mechanisms that interlock the raising and lowering of the bed main body with the raising and lowering of the support columns, the caregiving bed 10 is not limited to it, but may be configured to be provided with no transmission mechanisms. Specifically, although such an example has a common structure in which the bed main body vertically moves by the operation of the actuators, the support columns are fixed on the upper surfaces of the support platforms, whereby the support columns do not vertically move although the bed main body vertically moved. Thus, because the positions of the upper end parts of the support columns are not changed, the pad part of the bed main body is brought close to the positions of the upper end parts of the support columns, when the bed main body is raised. On the other hand, when the bed main body is lowered, the pad part of the bed main body moves away from the positions of the upper end parts of the support columns. This operation generates a relative displacement between the pad part of the bed main body and the upper end parts of the support columns. This structure removes the need for lifting up the hammock on which the care-receiver lies to a high position, and suppresses scaring the care-receiver.

In addition, when no transmission mechanisms are provided, it is unnecessary to connect the support columns to transmission mechanisms, and thus the support columns can be provided on side surfaces of the support platforms, or in positions apart from the bed main body. Thus, it is unnecessary to form through holes in the pad part of the bed main body, and the manufacturing process is simplified. It is also possible to adopt various layouts, for example, a layout in which one support column passes through the pad part and the other support column is disposed in a position apart from the bed main body. It is possible to provide a caregiving bed suitable for the mode of care of the care-receiver.

In the case where no transmission mechanisms are provided, although it is necessary to increase the distance of vertical movement of the operating part of the actuator, the manufacturing cost can be reduced because the structure is simplified. In addition, two actuators may be provided on both sides of each support platform, instead of providing an actuator in the center part of each support platform. Using two actuators enables more stable raising and lowering. In addition, because smaller actuators can be adopted in comparison with the case of using an actuator, each support platform can be made compact. In the case of providing two actuators, the two actuators should be configured to move up and down together.

A structure of another hammock will be explained hereinafter with reference to FIG. 10A to FIG. 10C. Although the hammock 38 described above is lifted up and lowered by attaching the bar-shaped members 37 to the attachment parts 13$a_3$, 13$b_3$, 14$a_3$, and 14$b_3$ of the upper end parts 13$a_1$, 13$b_1$, 14$a_1$, and 14$b_1$ of the support columns 13*a*, 13*b*, 14*a*, and 14*b* of the support platforms 11 and 12, and raising and lowering the support platforms, this hammock is configured to be lifted up and lowered by attaching belt members forming the hammock to the attachment parts 13$a_3$, 13$b_3$, 14$a_3$, and 14$b_3$, without using the bar-shaped members. The hammock 138 illustrated in FIG. 10A has a length larger than the height of the care-receiver, and formed of a resistant material that enables lifting up the care-receiver. For example, woven nylon or glass fiber can be used. Both longitudinal ends of the hammock are provided with belt members 138*a*.

A pair of slide members 50 are attached to respective longitudinal sides of the hammock 138 on which the care-receiver lies. Each slide member 50 is formed of a fixed sheet part 50*a* that is attached onto the hammock 138, and a slide sheet part 50*b* that is provided above the fixed sheet part 50*a* and is formed longer than the fixed sheet part 50*a*. These parts can be formed of a material such as nylon taffeta. Each slide member 50 is attached in a state in which longitudinal ends of the fixed sheet part 50*a* are joined to respective longitudinal ends of the slide sheet part 50*b*. Thus, when the fixed sheet part 50*a* is in a stretched state, the slide sheet part 50*b* is in a loose state.

The following describes attachment of the slide members 50 to the hammock 138. First, connection members, for example, detachable first tape members 51 are attached onto the belt members 138*a* provided on both the longitudinal sides of the hammock 138, and onto a pair of longitudinal axis lines 138*c*, each located close to the belt member 138*a* beyond a longitudinal center line 138*b* of the hammock 138. Detachable second tape members 52 are attached to the fixed sheet parts 50*a* located in positions corresponding to the first tape members 51 attached to the belt members 138*a* on both sides of the hammock 138 and the axis lines 138*c*, in the slide members 50. The hammock 138 and the fixed sheet parts 50*a* are detachably attached to each other by putting the first tape members 51 and the second tape members 52 together (see FIG. 10B and FIG. 10C).

In this operation, the fixed sheet parts 50*a* of the slide members 50 are attached in a stretched state onto the hammock 138. Then, the slide sheet parts 50*b* are attached onto the respective fixed sheet parts 50*a* to align both ends. The detachable tape members as described above may be used for the attachment, or the sheet parts may be sewed with thread. The slide sheet parts 50*b* have a size enough to cover a center part 138*e* of the hammock 138 with the loose parts of the slide sheet parts 50*b* when the slide members 50 are attached to the hammock 138, to cover meshes 138*d* of the hammock 138.

By setting the attachment position and the size of the slide members 50 as described above, the fixed sheet parts 50*a* of the slide members 50 are fixed in a stretched state on the hammock 138, and parts of the slide sheet parts 50*b* above the fixed sheet parts 50*a*, which stick out of the fixed parts of the fixed sheet parts 50*a* with the first and second tape members 51 and 52, can slide in a horizontal direction. Thus, when the care-receiver is to be put on the hammock 138, the care-receiver gets on the slide sheet part 50*b* of the slide member 50, and the slide sheet part 50*b* is slid on the fixed sheet part 50*a*, to easily move the care-receiver to a predetermined position on the hammock 138. By moving the slide sheet part 50*b*, the care-receiver is properly moved on the hammock 138, to suppress pain and sore caused by bed sore. In addition, because the hammock has meshes, when the care-receiver directly puts on the meshes, the care-receiver's weight is applied onto the meshes 138*d*, and the meshes 138*d* cut into the care-receiver's body and cause pain. The slide members 50 provided prevents the care-receiver from directly touching the meshes 138*d*, and reduces pain and sore.

Because the slide members 50 are attached to both sides of the hammock 138 and slid to expose the meshes 138*d* in the center part 138*e*, water can be drained in bathing or shower described later. Because the slide members 50 are attached to the hammock 138 using detachable tape members, the slide members 50 are easily attached and detached, and can be easily washed and changed.

Figures 10A, 10B, 10C:
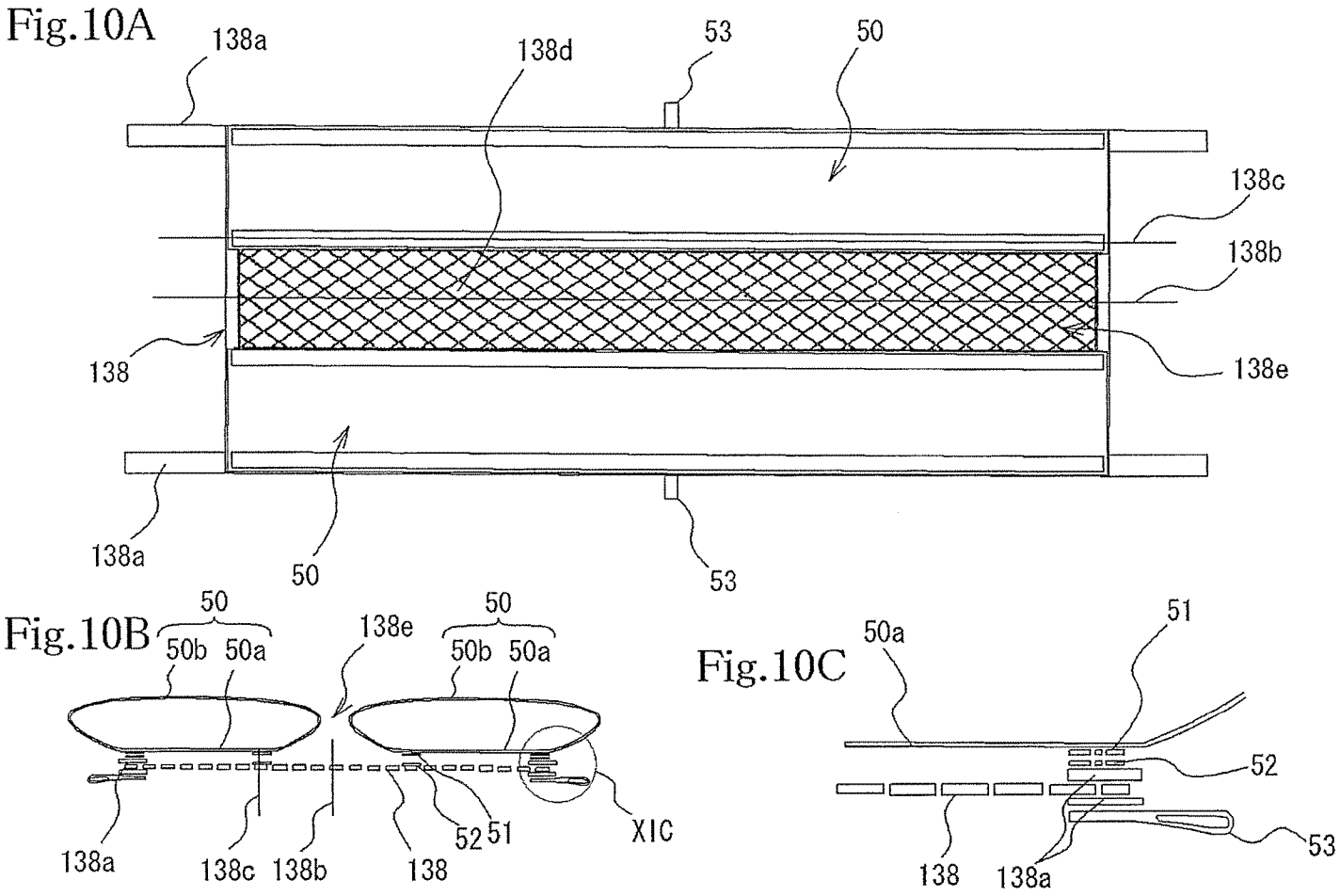
FIG. 10A is a top view illustrating a hammock having another shape.
FIG. 10B is a side view thereof as viewed from one side.

In the hammock illustrated in FIG. 10A, ears 53 are provided outside the belt members, and the hammock can be carried and attached to the bar-shaped members using the ears 53. A plurality of ears 53 may be provided. Although the above example shows the case where each slide member is formed of the fixed sheet part and the slide sheet part, the structure is not limited to the above structure, but the same effect can be obtained by forming a sheet member with a tube shape, and attaching the sheet member onto the hammock such that the lower part of the sheet member is fixed and the upper part thereof is slid.

In addition, although each slide member is formed of the fixed sheet part and the slide sheet part, the slide sheet part may be directly attached to the hammock, without using the fixed sheet part.

Figures 11A, 11B, 11C:
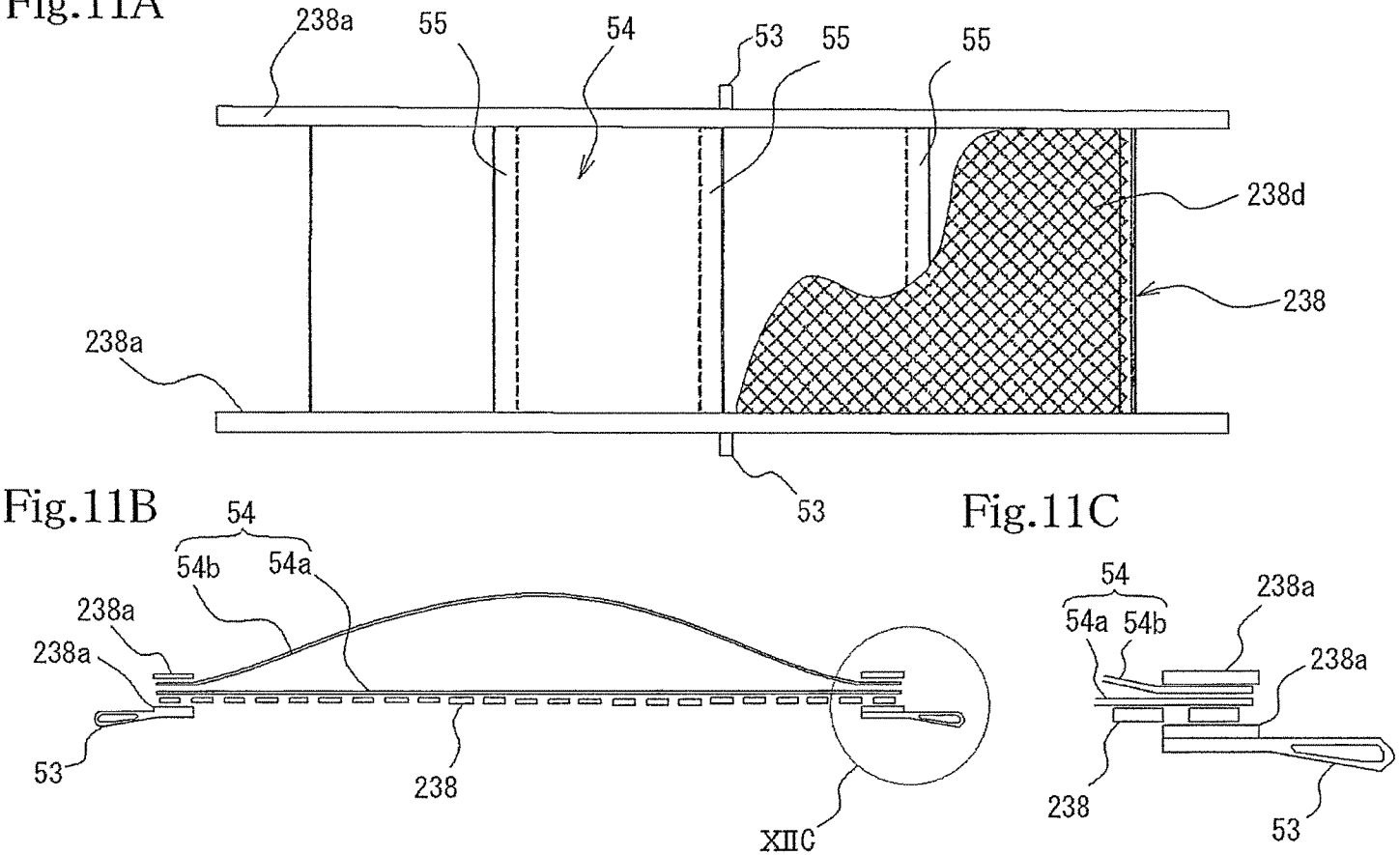
FIG. 11A is a top view illustrating a hammock having another shape.
FIG. 11B is a side view thereof as viewed from one side.
FIG. 11C is an enlarged view of an XIC part of FIG. 11B.

The following describes a hammock of another structure. As illustrated in FIG. 11A to FIG. 11C, as the hammock with this structure, a case is explained where a double sheet member 54 formed of a first sheet member 54*a* and a second sheet member 54*b* is provided on a side of the hammock 238, on which the care-receiver lies, and the double sheet member 54 are attached in a state of being divided into a plurality of parts. The double sheet member 54 is formed of the first sheet member 54*a* attached on the upper side of the hammock 238, and the second sheet member 54*b* attached to an upper side of the first sheet member 54*a*. The second sheet member 54*b* is formed to be larger than the first sheet member 54*a* in a width direction of the hammock 238. Both ends of the first sheet member 54*a* are aligned with both ends of the second sheet member 54*b* when attached, and thus the first sheet member 54*a* is attached in a stretched state. Because the second sheet member 54*b* formed in a larger size is attached with both ends thereof aligned with both ends of the hammock 238, the second sheet member 54*b* is attached in a loose state. The double sheet member 54 are divided into a plurality of parts and attached to the hammock. In this state, the divided double sheet members 54 are provided with overlapping parts 55, in which end parts of the divided double sheet members 54 in the longitudinal direction of the hammock overlap each other, to prevent meshes of the hammock 238 from being exposed. Belt members 238*a* are provided on both longitudinal ends of the hammock 238, the first sheet member 54*a*, and the second sheet member 54*b*.

By providing the double sheet member 54 obtained by superimposing sheet members having different sizes, the second sheet member 54*b* can be slid and moved on the first sheet member 54*a* by the difference in size. In this manner, when the care-receiver is put on the hammock 238, the care-receiver can be easily moved to a predetermined position on the hammock 238 by sliding the second sheet member 54*b*, without directly moving the care-receiver even when the care-receiver gets on the end of the hammock 238. In addition, sliding the second sheet member 54*b* suppresses pain and sore due to bedsore that is caused by moving the care-receiver on the hammock 238.

Because the hammock 238 has the meshes, when the care-receiver directly puts on the meshes, the care-receiver's weight is applied onto the meshes 238*d*, and the meshes 238*d* cut into the care-receiver's body and cause pain. The double sheet member 54 provided prevents the care-receiver from directly touching the meshes 238*d*, and reduces pain and sore. The double sheet member 54 divided into a plurality of parts is provided with the overlapping parts 55 in which end parts of the divided double sheet members overlap, and the overlapping parts 55 prevents the meshes 238*d* from touching the care-receiver. The overlapping parts 55 provided in the double sheet member 54 divided into a plurality of part enables water drainage when a shower is used on the double sheet member 54 as described later.

In the hammock 238 illustrated in FIG. 11A to FIG. 11C, the ears 53 are provided outside the belt members 238*a*, and the hammock can be carried and attached to the bar-shaped members using the ears 53. In this manner, a plurality of ears 53 may be provided. Although the above explanation shows the case where the care-receiver is moved by sliding using the double sheet member, the structure is not limited to the above structure, but a slidable second sheet member may be directly provided on the hammock.

In addition, the meshes of the hammock explained above may be removed, and the lifting member may be formed only of the belt members and the sliding members or the double sheet member. By adopting such a structure, meshes are removed, and a more lightweight and soft member is obtained, which provides the care-receiver with a comfortable feel during use. Also in this case, the slide members may be formed of only the slide sheet members, and the double sheet member may be formed of only the second sheet member forming the double sheet member.

Figure 12A:
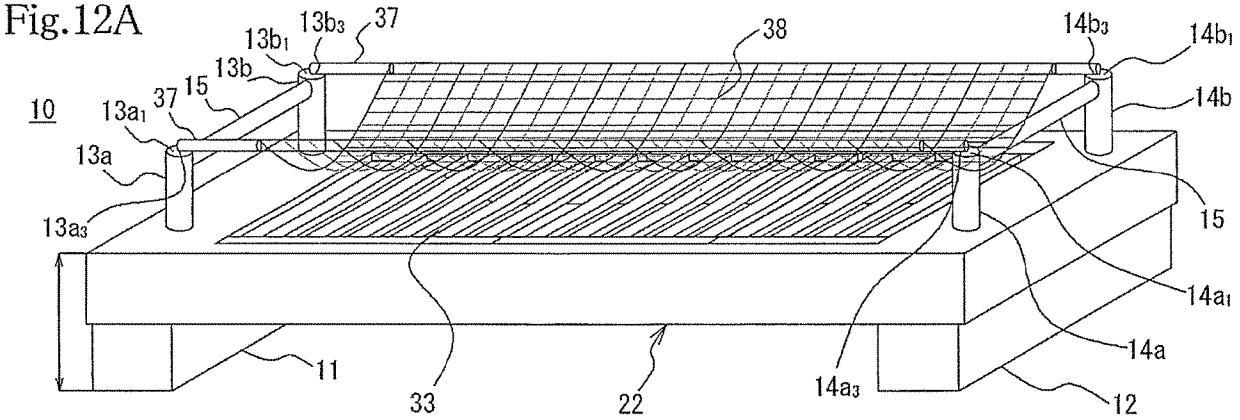
FIG. 12A is a perspective view illustrating a flow following FIG. 11B.

Next, a case is explained where a shower is used for the care-receiver, as a mode of use of the caregiving bed 10 according to Embodiment 1. First, as described above, the caregiving bed is changed to the state illustrated in FIG. 9B. Then, the mat 36 on the bed main body 22 is removed, as illustrated in FIG. 12A. The removal can be easily performed by using the elevator devices and the hammock.

Figure 12B:
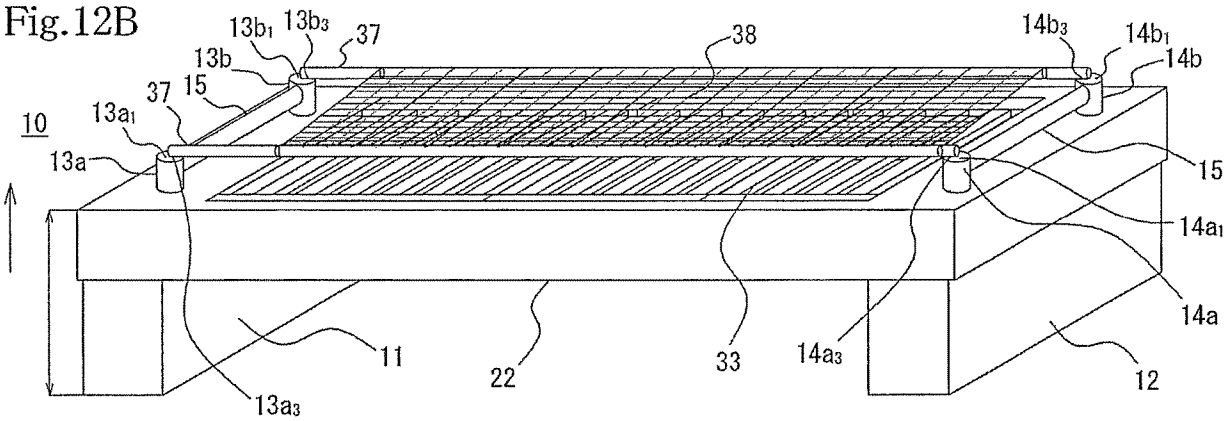
FIG. 12B is a perspective view illustrating a flow following FIG. 12A.

After all the mats 36 are removed, the bed main body 22 is raised again using the elevator devices 16, as illustrated in FIG. 12B. As the bed main body 22 is raised, the support columns 13*a*, 13*b*, 14*a*, and 14*b* of the support platforms 11 and 12 are relatively lowered, the bar-shaped members 37 and the hammock 38 are also lowered, and the care-receiver is placed on the latticed frame 33 of the bed main body 22. Then, the care-receiver can take a shower using a shower using a water supply tank or a small pump. The wastewater of the shower taken by the care-receiver flows into the water tank 28 provided inside the bed main body 22 through the frame 33, and can be drained from the water tank 28. The drainage state is the same as the state described above. The care-receiver in a state of lying on the frame can take a shower, with the hammock removed (see FIG. 7E). Because the hammock is divided into a plurality of parts, the caregiver can easily remove the hammock even in the state where the care-receiver is laid on the frame.

As described above, when the care-receiver take a shower on the latticed frame 33, the wastewater is prevented from adhering to the care-receiver. Specifically, when the care-receiver take a shower in the water tank 28, the wastewater of the shower is collected in the water tank, and may adhere to the care-receiver, which is not preferable for good hygiene. In particular, when excrement is washed away, it is preferable to avoid contact with the wastewater. The caregiving bed 10 according to Embodiment 1 can easily achieve this objective.

After the shower for the care-receiver is finished, the bed main body 22 is lowered again, and the hammock 38 is relatively raised to lift up the care-receiver. In this state, the mat 36 is placed on the frame 33 of the bed main body 22, and the bed main body 22 is raised to place the care-receiver on the mat 36. After the care-receiver is placed on the mat 36, the hammock 38 is removed. Although this removal is performed through a part under the care-receiver's body, because the hammock is divided into parts as described above, the removal can be easily performed by lifting up the part of the care-receiver from which the hammock is to be removed, or using the flexibility of the mat 36. The mode of use of the shower is finished as described above.

The water on the care-receiver's body after the shower can be wiped off at any time, for example, when the care-receiver is lifted up with the hammock, or when the care-receiver is placed on the mat. The water in the water tank 28 and the frame 33 may also be wiped off at the same time. A general cleaning of the water tank and the like is preferably performed when the care-receiver goes away from the caregiving bed 10.

Because the shower is used in the room, a water supply tank is used when the water supply facilities such as a faucet is distant from the caregiving bed. When the shower is used, for example, a water supply tank having a capacity of about 5 liters to 30 liters is installed, the water supply tank is provided with a small pump, whereby the care-receiver take a shower through the small pump. Using a water supply tank like this removes the need for laying pipes such as a water pipe.

The following describes a mode of use of the caregiving bed 10 according to Embodiment 1, when the care-receiver is bathed. A case will be explained of using the hammock 38 serving as the lifting member described above, in bathing in the caregiving bed 10 according to Embodiment 1. The way of use is similar to the above-described mode of use of the shower. Specifically, as described above with reference to FIG. 5 and FIG. 9, first, the bed main body 22 is raised, and the hammock 38 is inserted under the care-receiver laid on the mat 36 of the bed main body 22. Then, the hammock 38 is attached to the bar-shaped members 37, and the bar-shaped members 37 are attached to the attachment parts 13$a_3$, 13$b_3$, 14$a_3$, and 14$b_3$ of the upper end parts 13$a_1$, 13$b_1$, 14$a_1$, and 14$b_1$ of the support columns 13*a*, 13*b*, 14*a*, and 14*b* of the support platforms 11 and 12. Thereafter, the bed main body 22 is lowered, to lift up the care-receiver with the hammock 38. This work is the same as above.

Figure 13A:
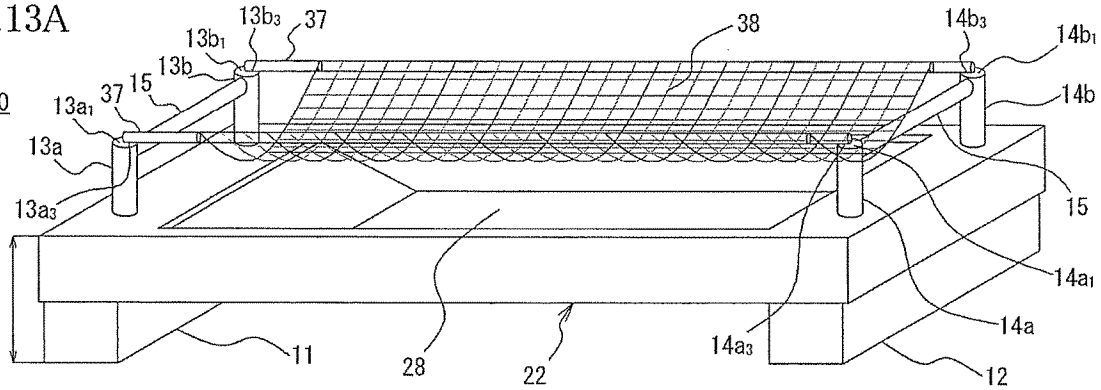
FIG. 13A is a perspective view illustrating a mode of use of the caregiving bed according to Embodiment 1, which is for bathing.

Thereafter, as illustrated in FIG. 13A, all the parts of the mat 36 and the latticed frame 33 placed on the bed main body 22 are removed, to expose the water tank 28 from the opening part 23*a* of the bed main body 22. In this state, the mat 36 and the frame 33 can be easily removed because they are divided into parts, and the lightweight frame 33 can also be easily removed by the caregiver. A sheet may be put onto the lower side of the mat, to prevent steam from going up from the bathtub.

Figure 13B:
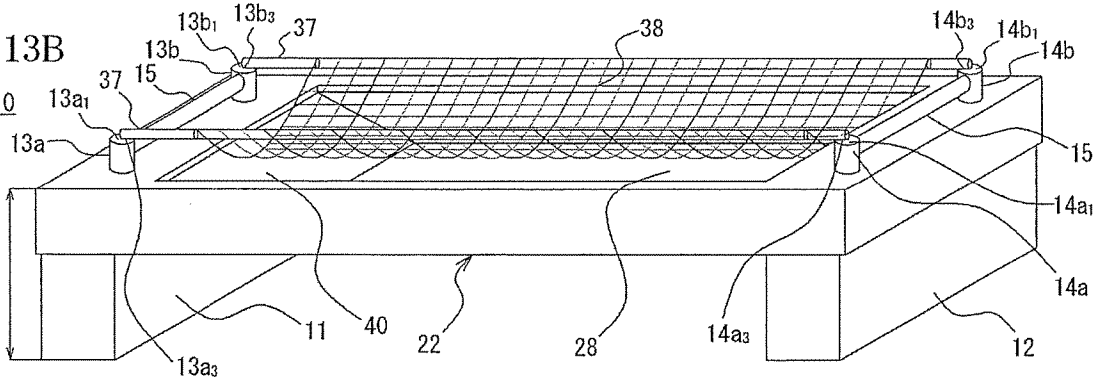
FIG. 13B is a perspective view illustrating a flow following FIG. 13A.

Next, a sheet member, for example, a water-resistant sheet 40 is spread to cover the surface of the inside of the water tank 28 (see FIG. 13B). The water tank 28 may be provided with attachment members (not illustrated) such as hooks, and the sheet may be attached to the attachment members. Because the water tank 28 is also used for disposing excrement as described above, a mental burden may be imposed on the care-receiver who bathes in the water tank even when the water tank 28 is kept clean. Such a burden can be lightened by providing a sheet or the like. After the sheet 40 is spread in the water tank 28, hot water is supplied to the water tank. The hot water may be poured with a simple pump, or may be carried from the household bath.

The sheet member is not limited to a sheet having a sheet shape, but may be provided with various shapes. For example, a structure (such as an armrest) that is usually formed in the water tank may be formed in the sheet member. It is therefore unnecessary to form projections or depressions in the water tank itself, and such structure reduces the manufacturing cost of the water tank, and facilitates cleaning of the water tank. Because the sheet member can be easily attached and detached, the sheet member can be easily changed, and the shape of the sheet member can be selected in accordance with the state of the care-receiver.

The sheet member is preferably subjected to an antibacterial treatment. Antibacterial treatment keeps the sheet member clean, and suppresses infection to the care-receiver and smell from the sheet member.

Figure 14A:
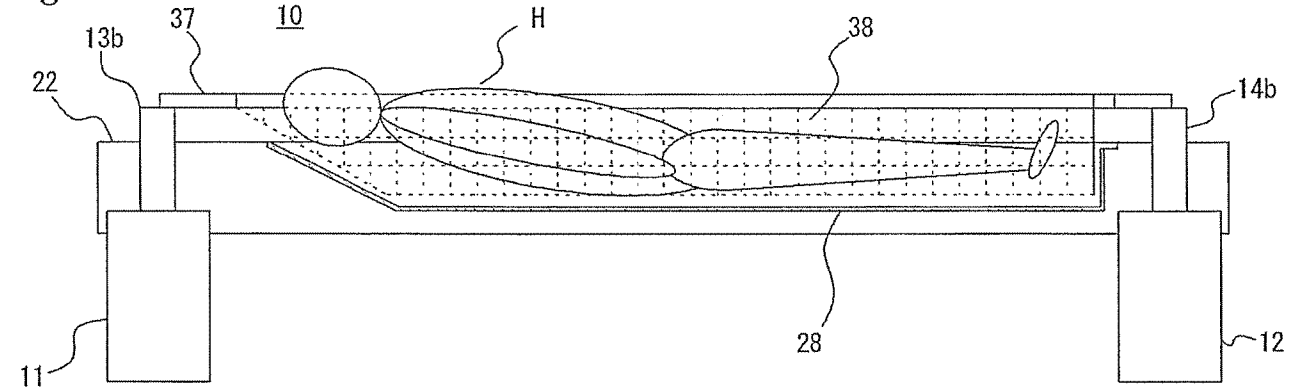
FIG. 14A is a side view of the bed, part of which is cross-sectioned, illustrating a state in which a care-receiver is bathed.
Figure 14B:
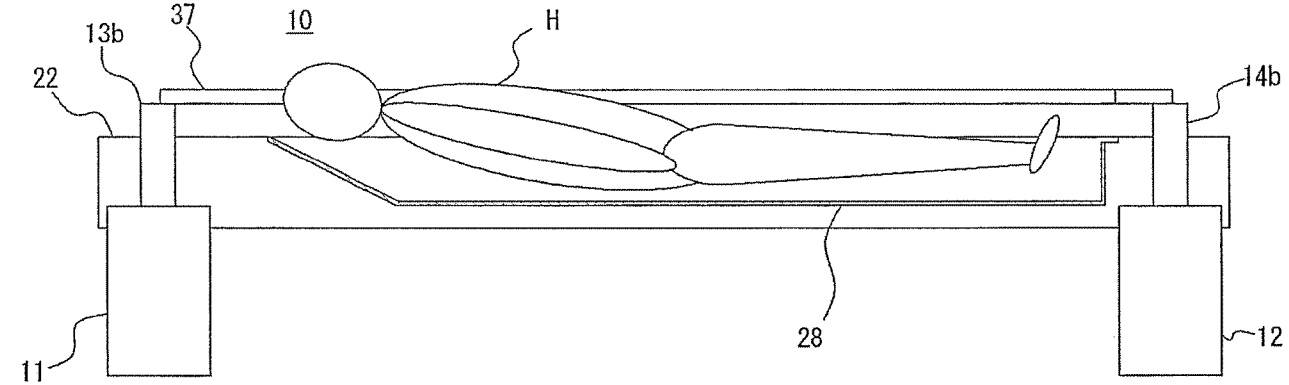
FIG. 14B is a diagram illustrating a state in which the hammock is removed from the state of FIG. 14A.

When the water level in the water tank 28 becomes a fixed level or more, the bed main body 22 is raised. By the raising, the water tank 28 of the bed main body 22 is raised, and the care-receiver put on the hammock 38 is lowered to enter the hot water in the water tank 28. In this state, although the care-receiver remains on the hammock 38, the care-receiver can be bathed without any problem when the depth of the hot water is sufficient (see FIG. 14A). The hammock may be removed in bathing (FIG. 14B). Because the care-receiver in bathing is in a floating state by buoyancy of water, the hammock can be easily removed and attached.

When bathing is finished, the bed main body 22 is lowered again to raise the hammock 38. Then, part of the sheet 40 spread in the water tank 28 is shifted or bent, whereby the hot water in the sheet 40 is flown into the water tank 28 and drained through the drain 31 of the water tank 28. The drainage is the same as that described above.

Thereafter, the opening part 23*a* of the bed main body 22 is covered with the frame 33, and the mat 36 is placed on the frame 33. Then, the bed main body 22 is raised to lower the hammock 38 and put the care-receiver on the mat 36. The following work is the same as that described above. In this manner, the care-receiver can be easily bathed.

Figure 15A:
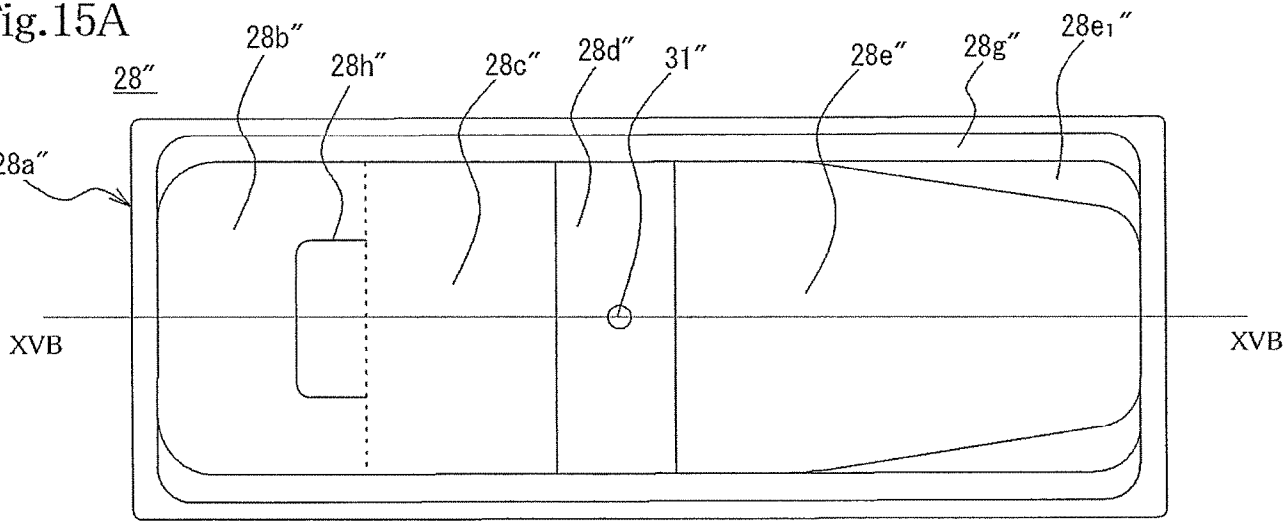
FIG. 15A is a top view illustrating a water tank having another shape.
Figure 15B:
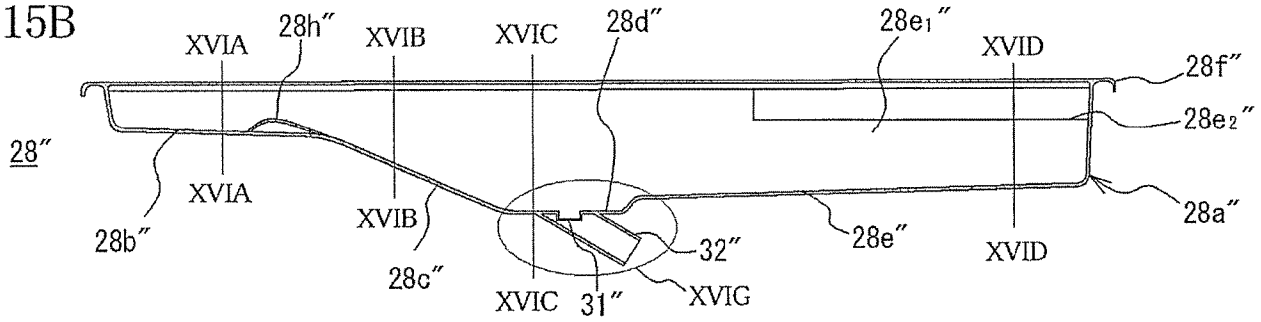
FIG. 15B is a cross-sectional view taken along line XVB-XVB of FIG. 15A.
Figure 16E:
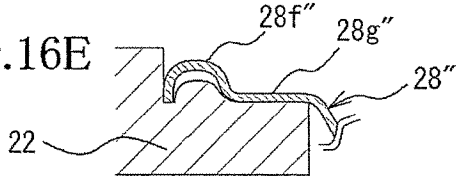
FIG. 16E is an enlarged view of an XVIE part in FIG. 16A.
Figure 16F:
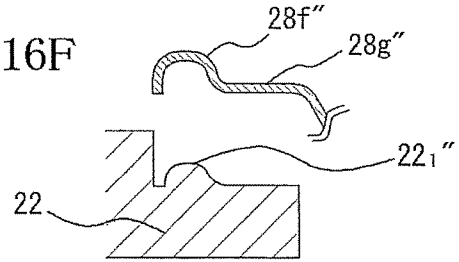
FIG. 16F is a cross-sectional view of a state in which the structure of FIG. 16E is divided.

Although the water tank 28 explained in Embodiment 1 has a box shape, the water tank is not limited to it, but may have a different shape. For example, the structure illustrated in FIG. 15 and FIG. 16 may be adopted. The water tank 28" illustrated in FIG. 15 and FIG. 16 includes a box-shaped water tank main body 28*a*" that is detachably provided inside the bed main body 22 and has an opened upper part to correspond to the opening part 23*a* of the pad part 23. The water tank main body 28*a*" includes a head placing part 28*b*", a backrest part 28*c*", a hip placing part 28*d*", and a leg placing part 28*e*", having respective predetermined depths and shapes. When the care-receiver in a lying state is put into the water tank 28" to use the water tank 28" as a bathtub, the head part of the care-receiver is placed on the head placing part 28*b*", the back of the care-receiver is placed on the backrest part 28*c*", the hip part of the care-receiver is placed on the hip placing part 28*d*", and the legs are placed on the leg placing part 28*e*". The hip placing part 28*d*" is disposed in substantially the center, the backrest part 28*c*" is disposed on one side of the hip placing part 28*d*" and inclined at a predetermined angle, and the head placing part 28*b*" is disposed to connect with the backrest part 28*c*". The leg placing part 28*e*" is disposed on the other side of the hip placing part 28*d*". In the structure, the head placing part 28*b*" is located in the highest position, and the hip placing part 28*d*" is located in the lowest position. Hook-shaped claw parts 28*f*" to be detachably attached to the bed main body 22 are formed in respective four corners of the water tank main body 28*a*". The bed main body 22 is provided with projections 22$_1$" (see FIG. 16F) to hook the claw portions 28*f*" to attach the water tank 28". This structure facilitates attachment and detachment of the water tank.

A step 28*g*" is formed inside each of the claw parts 28*f*" formed in a longitudinal direction of the upper surface of the water tank main body 28*a*", and the frame 33 can be placed on the steps 28*g*". It is therefore unnecessary to form a part for placing the frame 33 in the bed main body 22. The bottom part of each step 28*g*" is supported by the bed main body 22, whereby the strength of the water tank 28" and the frame 33 is enhanced. Because the steps 28*g*" are formed, overflow of hot water or the like from this part is prevented.

The head placing part 28*b*" is a part on which the care-receiver's head part is placed when the water tank 28" is used as a bathtub, and has an area enough to support the care-receiver's head in bathing and allow a shampoo. The head placing part 28*b*" is formed to be slightly inclined toward the center part of the water tank main body 28*a*", to prevent the hot water used for a shampoo from accumulating in the head part placing part 28*b*".

The backrest part 28*c*" is formed with a slope to support the back of the care-receiver. The slope has an angle that prevents the hot water collected in the water tank main body 28*a*" from flowing into the head placing part, or keeps the hot water in a position lower than the position of the care-receiver's ears, and allows the part of the care-receiver's body below the head to be soaked in the hot water, when the care-receiver uses the water tank 28" as a bathtub.

A neck placing part 28*h*" having a shape to receive the care-receiver's neck part is provided in a center part between the head placing part 28*b*" and the backrest part 28*c*". The neck placing part 28*h*" may be formed as one unitary piece with the water tank main body 28*a*", or formed as a separate member.

The hip placing part 28*d*" is provided in the lowest position in the water tank main body 28*a*", because the care-receiver's hip part is placed on the hip placing part 28*d*". The hip placing part 28*d*" is thus provided with a drain 31". A stair 28$d_1$" is formed between the hip placing part 28*d*" and the leg placing part 28*e*", such that the leg placing part 28*e*" is higher. In this manner, when the care-receiver is bathed, the care-receiver's hip part is hooked on the stair 28$d_1$" to prevent slipping, whereby the care-receiver is prevented from being submerged in the water.

The leg placing part 28*e*" is a part on which the care-receiver's leg part is placed, and is formed to be relatively long. The leg placing part 28*e*" is formed to be slightly inclined toward the hip placing part 28*d*". The placing part 28*e*" is provided with a narrowed part 28$e_1$" that narrows toward the part on which the care-receiver's toe is placed. The narrowed part 28$e_1$" is formed up to a predetermined height of the water tank main body 28*a*". The narrowed part 28$e_1$" provided as described above reduces the quantity of water to be used, and saves water. A top part 28$e_2$" of the narrowed part 28$e_1$" is formed with a height substantially equal to the height of the head placing part 28$e_1$", whereby the top part 28$e_2$" of the narrowed part 28$e_1$" is used as a yardstick. The quantity of the water to be supplied is set to a quantity that does not exceed the top part 28$e_2$", whereby the care-receiver's head part is prevented from being soaked in the hot water.

The narrowed part 28$e_1$" provided reduces the quantity of the hot water used for bathing, and produces the water-saving effect. The narrowed part 28$e_1$" also reduces the weight of the hot water applied to the water tank 28", thereby preventing breakage of the water tank 28". Because the weight applied to the water tank 28" is reduced, the manufacturing cost of the water tank 28" can be reduced, and the water tank 28" can be manufactured at low cost. The water tank may be formed of a sheet-like material having the above form. In this manner, a more inexpensive water tank can be provided, and the water tank can be easily changed. In such a case, because sufficient strength cannot be obtained with the sheet-like water tank, a structure such as the support plate member 30 (see FIG. 4) is preferably provided under the water tank.

Because the water tank 28" is used for care-receivers having various figures, the water tank 28" is preferably formed to fit various figures. Thus, the hip placing part 28*d*" is used as a yardstick, the leg placing part 28*e*" is formed to have a long side, whereby the water tank 28" can be used for tall care-receivers. The water tank 28" can also be used for short care-receivers, by forming the backrest part 28*c*" to be short. Although the position of the care-receiver's neck differs due to the difference in the care-receiver's height, and the position in which the neck placing part 28*h*" differs, this problem can be solved by disposing the neck placing part 28*h*" formed as a separate member in a predetermined position, or using a towel or the like. The backrest part 28*c*" is formed with a gentle slope, thereby enabling the care-receiver's whole body to be soaked in the hot water, regardless of the care-receiver's height.

The caregiving bed 10 is preferably low, in view of the mode of use for the care-receiver and the caregiver, such as movement of the care-receiver from a wheelchair and the general care of the caregiver. Because the caregiving bed 10 of Embodiment 1 can be raised and lowered, the most lowered state of the caregiving bed is preferably set low.

The bed main body 22 is therefore required to be formed thinner, and the water tank 28" disposed in the bed main body 22 is required to be formed thin. With the water tank 28" described above, the care-receiver in a bathed state can sufficiently be soaked in the hot water or the like, even with the water tank 28" formed thin. In the case where the height of the water tank is further reduced, the bathing of the care-receiver can be specialized to half body bathing, and the water tank can be used for care-receivers who are difficult to be subjected to whole body bathing, which puts a burden on the heart. Because the water tank for half body bathing can be formed further thinner, the height of the caregiving bed can be further reduced.

Figure 16G:
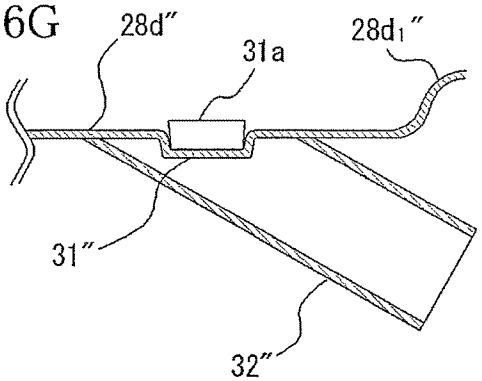
FIG. 16G is an enlarged view of an XVIG part of FIG. 15B.
Figure 16A:
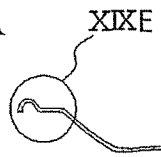
FIG. 16A is a cross-sectional view taken along line XVIA-XVIA in FIG. 15B.
Figure 16A:
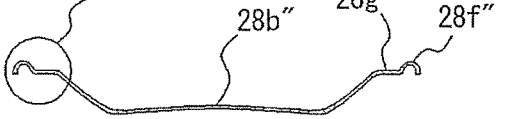
Figure 16B:
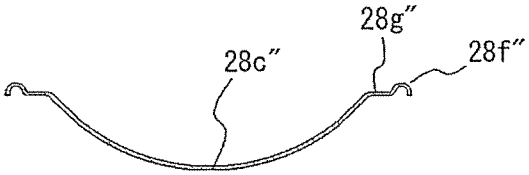
FIG. 16B is a cross-sectional view taken along line XVIB-XVIB in FIG. 15B.
Figure 16C:
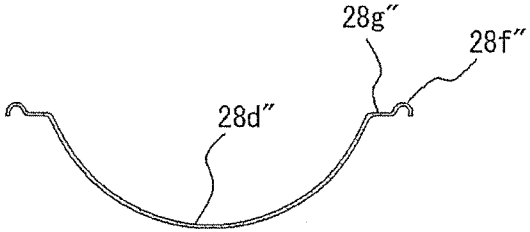
FIG. 16C is a cross-sectional view taken along line XVIC-XVIC of FIG. 15B.
Figure 16D:
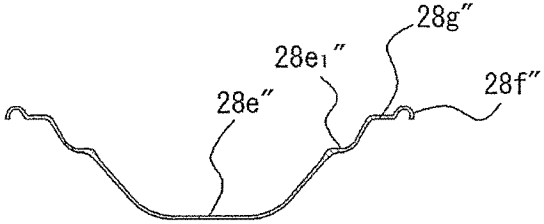
FIG. 16D is a cross-sectional view taken along line XVID-XVID of FIG. 15B.

A drainpipe 32" connected to a drain 31" can be slantly attached as illustrated in FIG. 16G, and formed with an L shape, whereby the bed main body 22 can be disposed in a lower state.

Figure 17B:
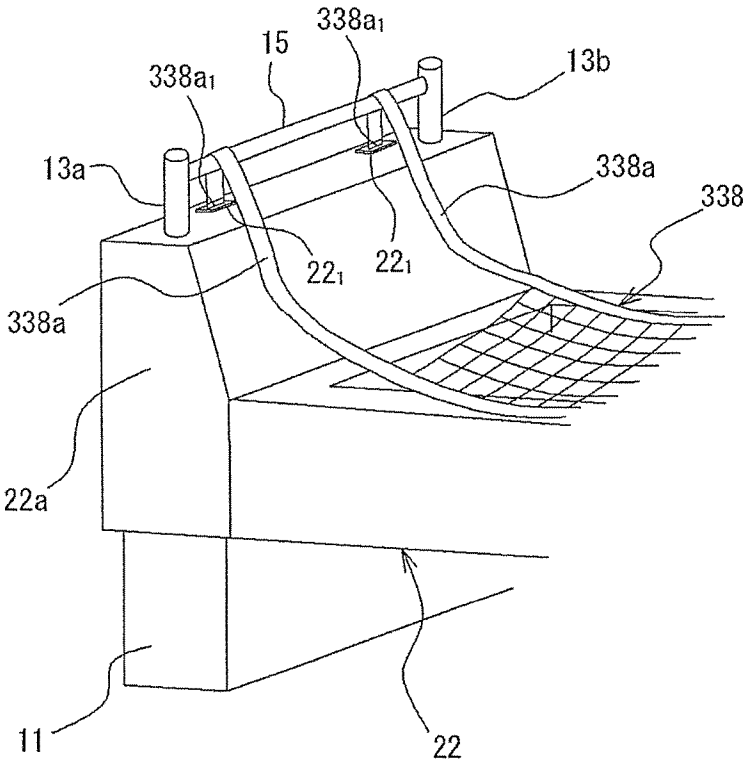
FIG. 17B is a perspective view illustrating a state in which the hammock is lowered.
Figure 17A:
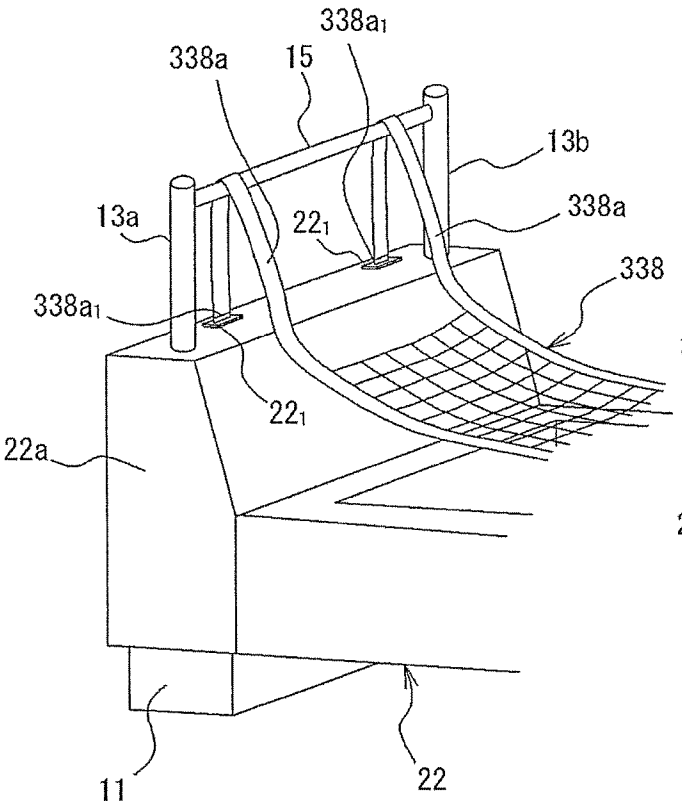
FIG. 17A is a perspective view illustrating a state in which another hammock is raised.

Another structure for lifting and bringing down the hammock will be explained hereinafter with reference to FIG. 17A and FIG. 17B. Although FIG. 17A and FIG. 17B illustrate one support platform as a representative, the other support platform has the same structure. In FIG. 17A and FIG. 17B, the bed main body 22 is provided with a headboard 22*a*. In this manner, the bed main body on the side of the other support platform may be provided with a footboard.

As illustrated in FIG. 17A, the hammock 338 is provided with belt members 338*a* that are longer than the length of the hammock 338 and disposed on both end parts of the hammock 338 along a longitudinal direction of the hammock 338. The belt members 338*a* extend across the upper side of the beam member 15 attached to extend between the support columns 13*a* and 13*b* of the support platform 11, and end parts 338$a_1$ of the belt members 338*a* are attached to respective pad part attachment parts 22$_1$ of the pad part 23 of the bed main body 22. The end parts 338$a_1$ are provided with attachment metal fittings. Each belt member 338*a* may be provided with a structure that enables adjustment of the length of the belt member 338*a*, such as a buckle.

When the hammock 338 is lifted, the bed main body 22 is lowered, to lower end parts 338$a_1$ of the belt members 338*a* of the hammock 338 attached to the bed main body 22. Together with the lowering, the support columns 13*a* and 13*b* provided in the support platform 11 are raised, and the beam member 15 attached to the support columns 13*a* and 13*b* is also raised. The end parts 338$a_1$ of the belt members 338*a* disposed via the beam member 15 are lowered, and parts of the belt members 338*a* extending across the beam member 15 between the end parts 338$a_1$ and the hammock 338 are raised. The hammock 338 can therefore be raised by a distance twice as long as the distance of lowering the bed main body 22. A similar process is performed for the case of bringing down the hammock 338. Specifically, as the bed main body 22 is raised, the beam member 15 attached to the support columns 13*a* and 13*b* is lowered. In this manner, the end parts of the belt members 338*a* attached to the bed main body 22 are raised, parts of the belt members 338*a* extending across the beam member 15 are lowered, and thus the hammock 338 can be brought down (see FIG. 17B).

The lifting of the hammock having this structure is not limited to the case where the support columns are raised and lowered together with the raising and lowering of the support platform, but is applicable to the case where the support columns do not move together with the raising and lowering of the support platform. In such a case, although the distance of movement of the hammock such as lifting is substantially the same as the distance of the raising and lowering of the support platform, the structure is simplified, and thus the caregiving bed can be provided at low cost. Although FIG. 17A and FIG. 17B illustrate the case where the bed main body is provided with a headboard, the structure is not limited to it, but may be applicable to a caregiving bed without a headboard as illustrated in FIG. 5.

On the other hand, in the case where the hammock 338 is provided with the belt members 338*a*, the end parts of the long belt members 338*a* are swung around in the attachment or detachment of the hammock 338, and may hit and injure the care-receiver or the caregiver, or may hit and break objects. The end parts of the belt members 338*a* are formed of metal, because the end parts are required to be securely attached to the bed main body 22 and have strength. The end parts formed of metal may cause injury and breakage with high probability. Thus, the belt members provided in the hammock is preferably formed as short as possible.

Figure 18C:
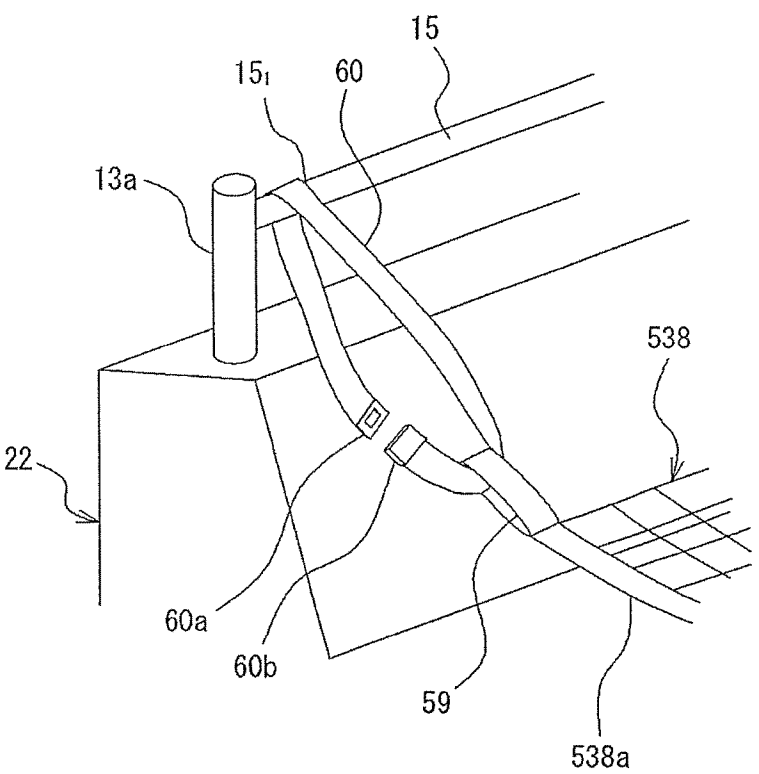
FIG. 18C is a perspective view illustrating a belt member of another hammock.
Figure 18A:
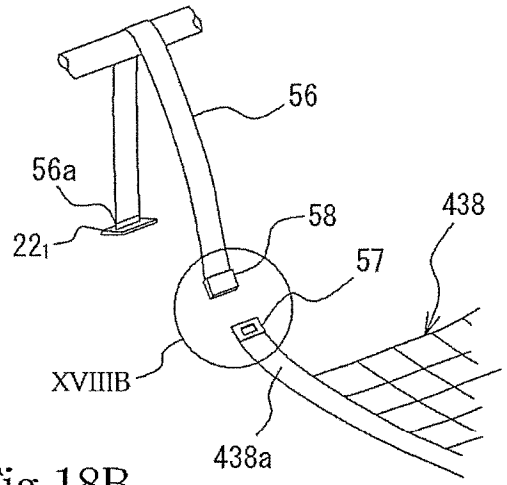
FIG. 18A is a perspective view illustrating another structure of the belt member of the hammock illustrated in FIG. 17.
Figure 18B:
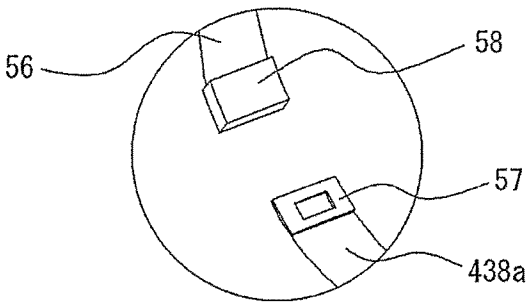
FIG. 18B is an enlarged view of a XVIIIB part of FIG. 18A.

A hammock 438 illustrated in FIG. 18A has a structure of including belt members 438*a* serving as lifting belt members provided in the hammock 438 are short, and belt members 56 serving as attachment belt members connected with the belt members 438*a* and attached to pad part attachment parts $\mathbf{22}_1$ of the bed main body 22. Each belt member 438*a* of the hammock 438 is connected with the corresponding separate belt member 56, by coupling a first coupling part 57 provided at an end part of each belt member 438*a* with a second coupling part 58 attached to an end part of each belt member 56 that is opposite to an end part 56*a* to be attached to the pad part attachment part $\mathbf{22}_1$ of the bed main body 22 (see FIG. 18B). The first coupling parts 57 and the second coupling parts 58 are formed of metal or the like. With the above structure, the belt members 438*a* provided in the hammock 438 can be formed short. Even when the first coupling parts 57 of the end parts of the belt members 438*a* are swung around during attachment and detachment of the hammock 438, the first coupling parts 57 only move within a narrow range and prevented from hitting the care-receiver or the like, and safety is enhanced.

In addition, the first coupling parts 57 and the second coupling parts 58 are configured to be attached and detached by a one-touch operation, and thus can be easily attached and detached. Commercial products can be used as the first coupling parts 57 and the second coupling parts 58.

A structure for further improving the safety of the belt members provided in the hammock will be explained hereinafter with reference to FIG. 18C. In the structure, although a hammock 538 is provided with belt members 538*a* serving as the lifting belt members, each end part of each of the belt members 538*a* is not provided with a metal coupling part, but provided with a ring part 59 formed by looping each end part of each belt member 538*a*, and a belt member 60 serving as the attachment belt member formed of a member separated from the hammock 538. Each belt member 60 is provided, at one end and the other end, with detachable metal connecting parts 60*a* and 60*b* to be coupled with each other. Each belt member 60 is used as a loop obtained by connecting the connecting parts 60*a* and 60*b*. Each belt member 60 may be provided with a structure for adjusting the length of the belt member 60 to be used. The adjustment may be performed with the connecting parts 60*a* and 60*b*, or a buckle provided in the belt member 60.

A method for attaching the hammock 538 is as follows. First, the belt members 60 in a belt-shaped state to which the connecting parts 60*a* and 60*b* are not connected are inserted through the respective ring parts 59 of the belt members 538*a* of the hammock 538, and the connecting parts 60*a* and 60*b* of each of the belt members 60 are connected. The attachment is thus finished. In the attachment, the belt members 60 may be attached to attachment part $\mathbf{15}_1$ provided in the beam member 15. When the hammock 538 is lifted, the bed main body 22 is lowered, and the beam member 15 attached to the support column 13*a* (illustration of the support column 13*b* is omitted) is raised. In this manner, the hammock 538 is pulled by the belt member 60, and the hammock 538 is lifted. In this manner, because the belt members 538*a* of the hammock 538 are not provided with metal members, safety is further enhanced.

Although FIG. 17A and FIG. 17B illustrate the case where the end parts $\mathbf{338}a_1$ of the belt members 338*a* of the hammock 338 are attached to the pad part attachment parts $\mathbf{22}_1$ formed in the pad part 22, the structure is not limited to it, but the end parts may be attached to the attachment part $\mathbf{15}_1$ provided in the beam member 15, as illustrated in FIG. $\mathbf{15}_1$. In this manner, the structure is more simplified than the structure in the case of providing the pad part 22 with the pad part attachment parts $\mathbf{22}_1$. Even when any defect occurs in the attachment part $\mathbf{15}_1$ of the beam member 15, only the beam member can be replaced while the caregiving bed is used without interruption.

Figure 19B:
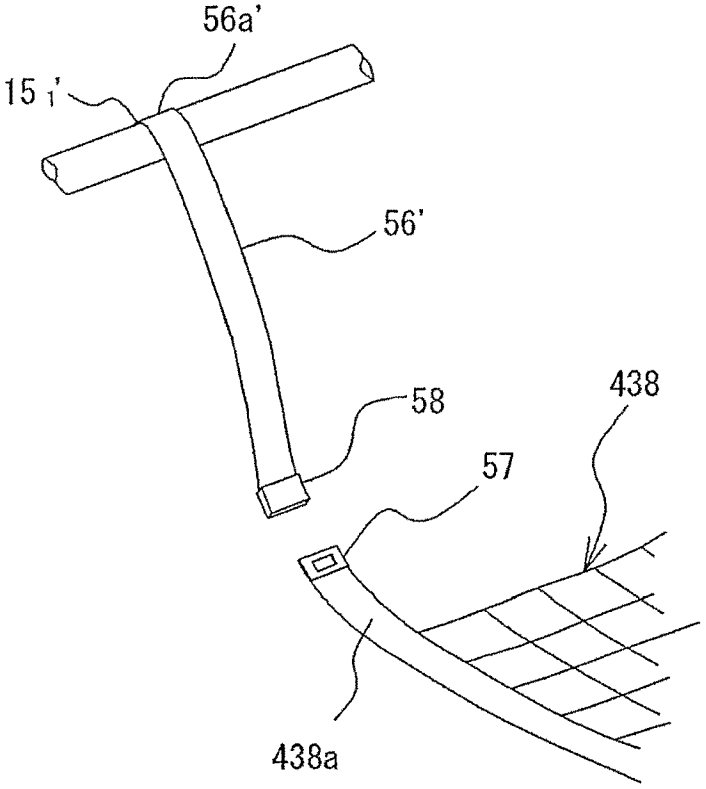
FIG. 19B is a diagram illustrating a structure of another belt member and corresponding to FIG. 18A.
Figure 19A:
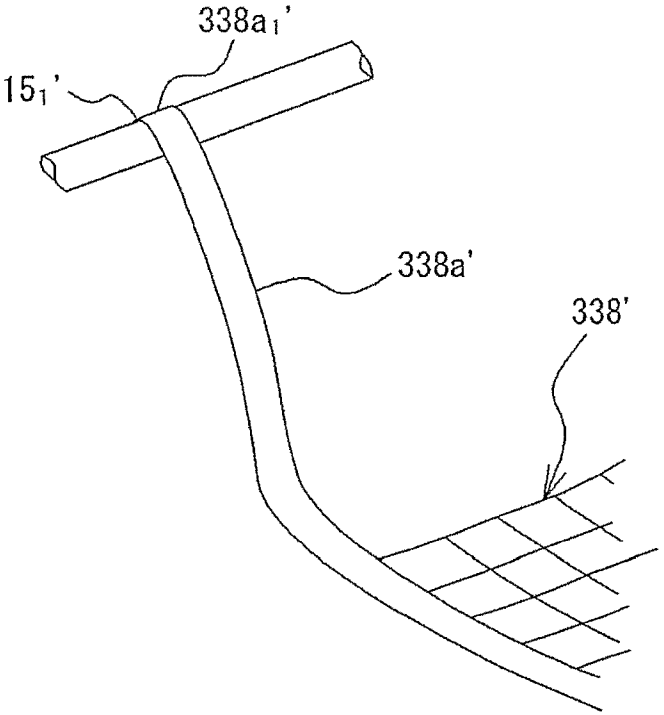
FIG. 19A is a diagram illustrating a structure of another belt member and corresponding to FIG. 18A.

In addition, as illustrated in FIG. 19B, during attachment of the belt members to the attachment part $\mathbf{15}_1$ of the beam member 15, each of the belt members may be divided into a belt member 56' and the belt member 438*a* of the hammock 438 as illustrated in FIG. 18A, and an end part 56*a*' of the belt member 56' may be attached to the attachment part $\mathbf{15}_1$ of the beam member 15. In this manner, each first coupling part 57 of the hammock 438 and the second coupling part 58 of each belt member 56' are configured to be attachable and detachable by a one-touch operation like the structure illustrated in FIG. 18B, and thus can be easily attached and detached.

Figure 20A:
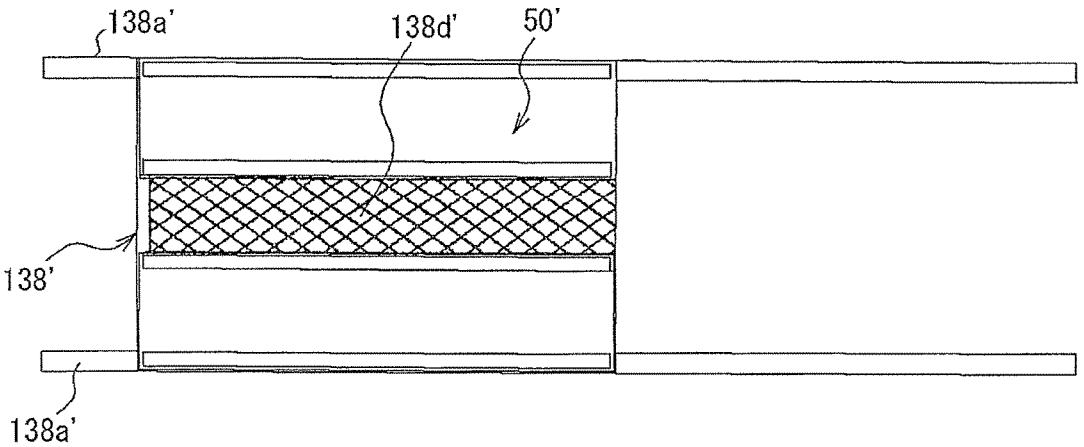
FIG. 20A is a diagram illustrating another hammock.
Figure 20B:
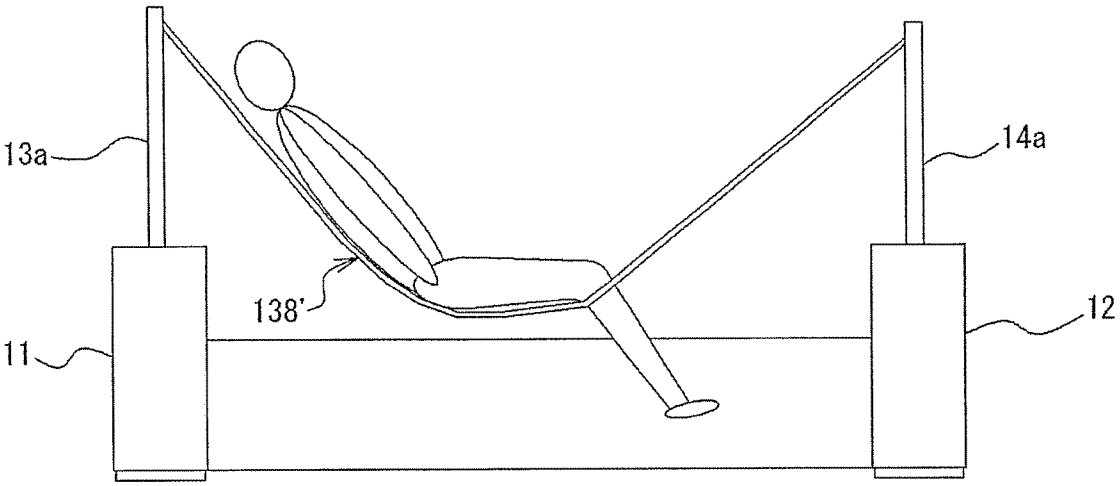
FIG. 20B is a schematic diagram illustrating a state of use of the hammock illustrated in FIG. 20A.

A hammock 138' as illustrated in FIG. 20A may be used. The hammock 138' illustrated in FIG. 20A is provided with meshes 138*d*' and slide members 50', on which the care-receiver H mounts, and the meshes 138*d*' and the slide members 50' have a length about half the length of the hammock 138'. Belt members 138*a*' provided on both ends of the hammock 138' have the same length as described above. With the hammock 138' having this structure, the care-receiver can be lifted in a sitting state as illustrated in FIG. 20B. This structure reduces the care-receiver's uneasiness in comparison with the case where the care-receiver is lifted in a lying state. Although FIG. 20 illustrates an example using the structure of the lifting member explained in FIG. 10, the structure is not limited to it, but may be a structure obtained by substantially halving the lifting member of another structure.

Although the above explanation shows the case where a hammock is used as the lifting member, the lifting member is not limited to it, but a sheet put on the mat may be used as the lifting member. In such a case, both longitudinal ends of the sheet are provided with belt members as used for the above hammock, to enable connection with the support columns and the bed main body. These structures are included also in common with the belt members used for the above hammock. In this manner, because the care-receiver can be lifted using the sheet that is used for the care-receiver, the work of laying the hammock under the care-receiver can be omitted. The sheet is required to be formed of a material and have a structure that enable supporting the care-receiver's weight when the care-receiver is lifted.

Embodiment 2

Next, a caregiving bed 10A according to Embodiment 2 will be explained hereinafter with reference to FIG. 21. The caregiving bed 10A according to Embodiment 2 is configured to recline the upper body part such that the care-receiver can easily have a meal and read books. When the caregiving bed is reclined by connecting the attachment parts 13$a_3$ and 13$b_3$ of the upper end parts 13$a_1$ and 13$b_1$ of the support columns 13*a* and 13*b* of one support platform 11 with an end part 33$_1$ of the latticed frame 33, which is close to the support columns, by connecting members 41, such as wires, ropes, and plate-shaped members. Constituent elements in common with the caregiving bed 10 of Embodiment 1 are denoted by like reference numerals, and detailed explanation thereof is omitted.

The upper end parts 13$a_1$ and 13$b_1$ of the support columns 13*a* and 13*b* are provided with the attachment parts 13$a_3$ and 13$b_3$ as described above, such that the bar-shaped members 37 are attachable. An end 41*a* of each of the connecting members 41 is provided with a loop that is attachable to one of projections of the attachment parts 13$a_3$ and 13$b_3$ of the upper end parts 13$a_1$ and 13$b_1$ of the support columns 13*a* and 13*b*, such as a loop that can be hooked on one of the projections, whereby the connecting members can be easily connected and hardly disengaged.

On the other hand, the end part 33$_1$ of the frame is provided with a structure that is connectable to the other ends of the connecting members 41, such as hanging projections or through holes, and the other ends 41*b* of the connecting members 41 are connected to the parts. As the structure of the other ends of the connecting members 41, for example, each of the connecting members 41 is provided with a loop, through which the hanging projection extends through, or a hook that is connectable with the through hole (see Part A in FIG. 21B).

Figure 21A:
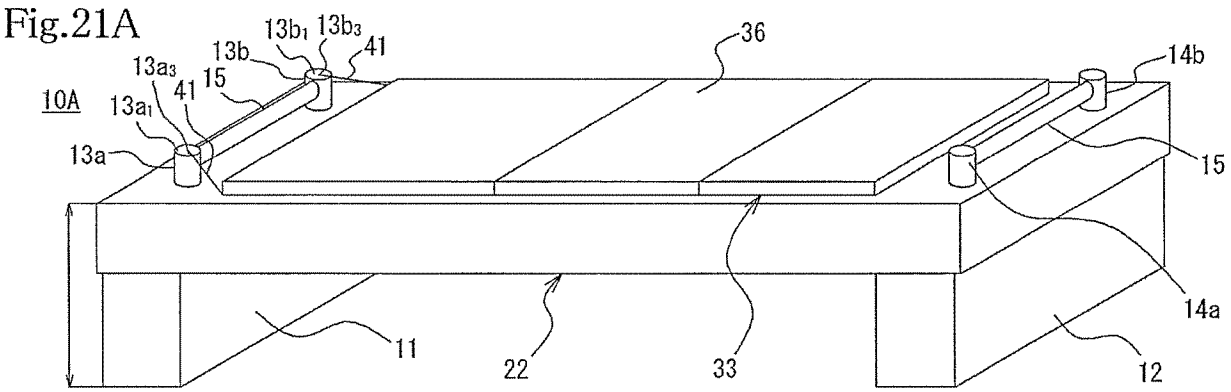
FIG. 21A is a perspective view illustrating the procedure of a mode of use of the reclining of a caregiving bed according to Embodiment 2.
Figure 21B:
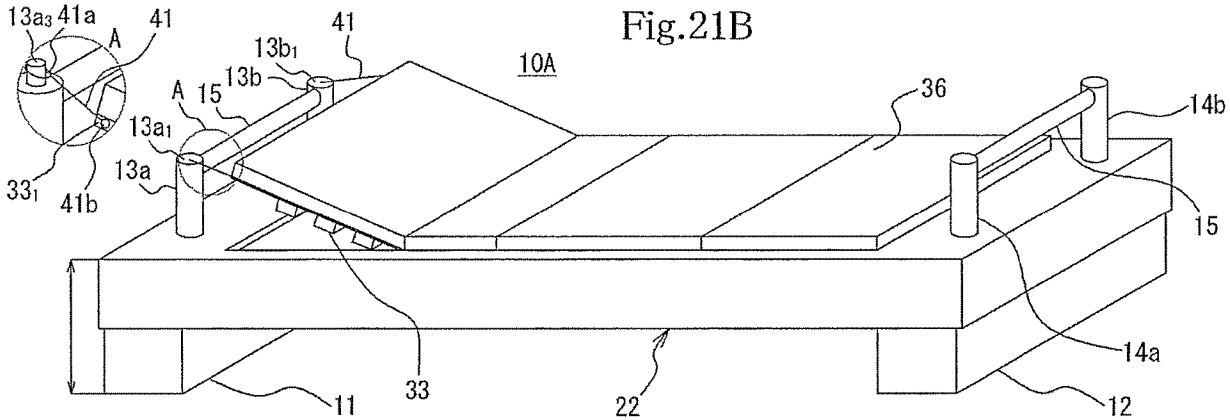
FIG. 21B is a perspective view illustrating a flow following FIG. 21A.

A method for using the reclining mechanism will be explained hereinafter with reference to FIG. 21. First, as illustrated in FIG. 21A, the bed main body 22 is disposed in an upper position by the elevator devices 16, and the attachment parts 13$a_3$ and 13$b_3$ of the upper end parts 13$a_1$ and 13$b_1$ of the support columns 13*a* and 13*b* are connected to the end part 33$_1$ of the frame 33 with the connecting members 41. In this operation, because the upper end parts 13$a_1$ and 13$b_1$ of the support columns 13*a* and 13*b* are brought close to the frame 33 of the bed main body 22 by disposing the bed main body 22 in an upper position, the connecting members 41 can be easily attached.

Next, the bed main body 22 is moved to a low position. In this operation, because the support columns 13*a* and 13*b* are moved upward, the connecting members 41 connected to the upper end parts 13$a_1$ and 13$b_1$ of the support columns 13*a* and 13*b* are moved upward. With the raising, because the connecting members 41 are also moved upward, the end part 33$_1$ of the frame connected to the other ends 41*b* of the connecting members 41 is also moved upward, and the frame 33 is inclined such that the side of the frame 33 connected with the connecting members 41 is located in an upper position. On the other hand, because, the other side of the frame 33 is provided in the bed main body 22 and moved downward, the frame 33 can be more inclined than the distance of movement of the elevator devices 16. The mat 36 placed on the frame 33 is bent along the slope of the frame 33 (see FIG. 21B).

The reclining of the caregiving bed 10A is finished by the above operation. The caregiving bed can be reclined while the care-receiver is kept laid on the bed main body 22, or the care-receiver may be moved to another place and returned onto the bed main body again after the reclining.

Figure 22B:
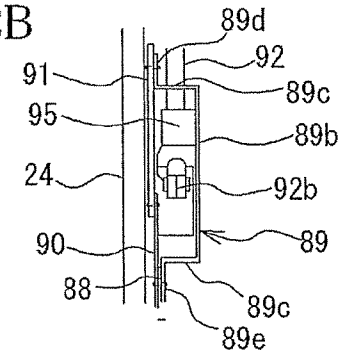
FIG. 22B is an enlarged view of a part of an upper surface of the caregiving bed.
Figure 22C:
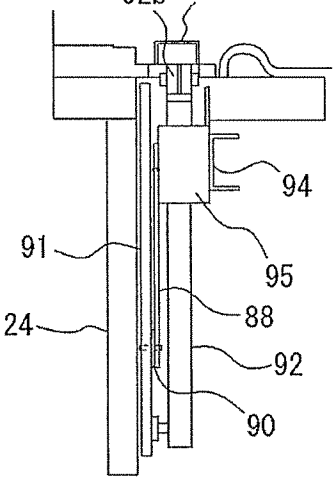
FIG. 22C is an enlarged back view of part thereof.

A structure of another reclining mechanism will be explained hereinafter with reference to FIG. 22 to FIG. 24. In this reclining method, a reclining mechanism 84 having a reclining actuator 85 is provided inside the bed main body 22. The actuator used herein does not work together with the actuators used for the elevator devices in the support platforms. Although a pair of reclining mechanisms explained herein are provided on respective sides in the bed main body and opposed to each other, only one reclining mechanism will be explained as a representative, because the reclining mechanisms have the same structure.

As illustrated in FIG. 22A to FIG. 22C and FIG. 23, the reclining mechanism includes an actuator 85 having a bar-shaped operating post 87 that is put in and out by driving means 86, a link beam 88 formed of a plate-shaped member that is rotatably coupled with an end part 87*a* of the operating post 87, a fixing member 89 attached to the frame 33 and coupled with a rotatable end part 88*a* of the link beam 88, which is opposite to the side of the link beam 88 coupled with the operating post 87, a link plate 90 that is rotatably coupled with the end part 87*a* of the operating post 87 together with the link beam 88, a cam plate 91 formed of a substantially triangular plate-shaped member having a first vertex part 91*c* coupled with an end part 90*a* of the link plate 90 located opposite to the side coupled with the operating post 87, a second vertex part 91*c*, and a third vertex part 91*d*, a shaft 92 that is coupled with a movement groove 91*a* formed in the cam plate 91 and is movable with rotation of the cam plate 91, and a frame 33*a* that is reclined with movement of the shaft 92. The frame 33*a* is provided with an arm member 93 that is vertically movable and has a curved part.

The following describes each of the above elements. First, the fixing member 89 is formed of a fixing part 89*a* that is attached to the lower side of the frame 33*a* provided with the arm member 93 to be reclined, a rectangular side surface part 89*b* obtained by extending the fixing part, bent parts 89*c* obtained by bending the short sides of the side surface part 89*b* at right angles, a pair of first attachment part 89*d* and a second attachment part 89*e* that are further bent from the bent parts 89*c* at right angles. The side surface part 89*b* is formed to project toward the inside of the bed main bed 22. A U-shaped base member 94 extending to a position adjacent to the support platform 11 is attached to a part of the side surface part 89*b* of the fixing member 89 inside the bed main body 22. The actuator 85 is fixed on a part of the base member 94 close to the support platform 11.

One end of the link beam 88 coupled with the end part 87*a* of the operating post 87 of the actuator 85 is rotatably coupled with the operating post 87, and the other end thereof is rotatably attached to the first attachment part 89*d* of the fixing member 89, which is located on the side distant from the support platform 11. The link beam 88 is a member that supports the end part 87*a* of the operating post 87 such that the end part 87*a* is movable. One end of the link plate 90 coupled with the end part 87*a* of the operating post 87 of the actuator 85 is rotatably coupled with the operating post 87, and the other end thereof is rotatably coupled with the cam plate 91. The link plate 90 is a member that transmits movement of the operating post 87 that is put in and out to the cam plate 91. The cam plate 91 has a substantially triangular shape, and is rotatably attached to the second attachment part 89*e* of the fixing member 89 located on the side of the fixing member 89 close to the support platform 11. The link plate 90 is coupled with the second vertex part 91*c* of the cam plate 91.

The cam plate 91 is provided with the arc-shaped movement groove 91*a* to connect the two vertexes, that is, the first and third vertex parts 91*b* and 91*d*, other than the second vertex part 91*c* coupled with the link plate 90. The cam plate 91 is attached to the second attachment part 89*e* at a position located toward the support platform 11 from the movement groove 91*a* of the first vertex part 91*b* formed in a position close to the frame 33*a* among the vertex parts of the cam plate 91, and the position serves as a cam fulcrum 91*e* serving as the fulcrum of rotation of the cam plate 91. The cam plate 91 is rotated on the cam fulcrum 91*e* serving as the axis. The cam plate 91 is provided with the bar-shaped shaft 92 that reclines the arm member 93 provided on the frame 33.

One end of the shaft 92 is provided with a moving shaft 92*a* that is movable in the movement groove 91*a* and located inside the movement groove 91*a* of the third vertex part 91*d* close to the support platform 11. Because the cam plate 91 is movable, the moving shaft 92*a* is movable in the movement groove 91*a*. The other end of the shaft 92 is provided with a roller 92*b* to push up the arm member 93. The shaft 92 is provided to be inserted through a guide hole formed in a guide member 95 that is attached to a projecting part of the fixing member 89 opposite to the side to which the base member 94 is attached.

Figure 22A:
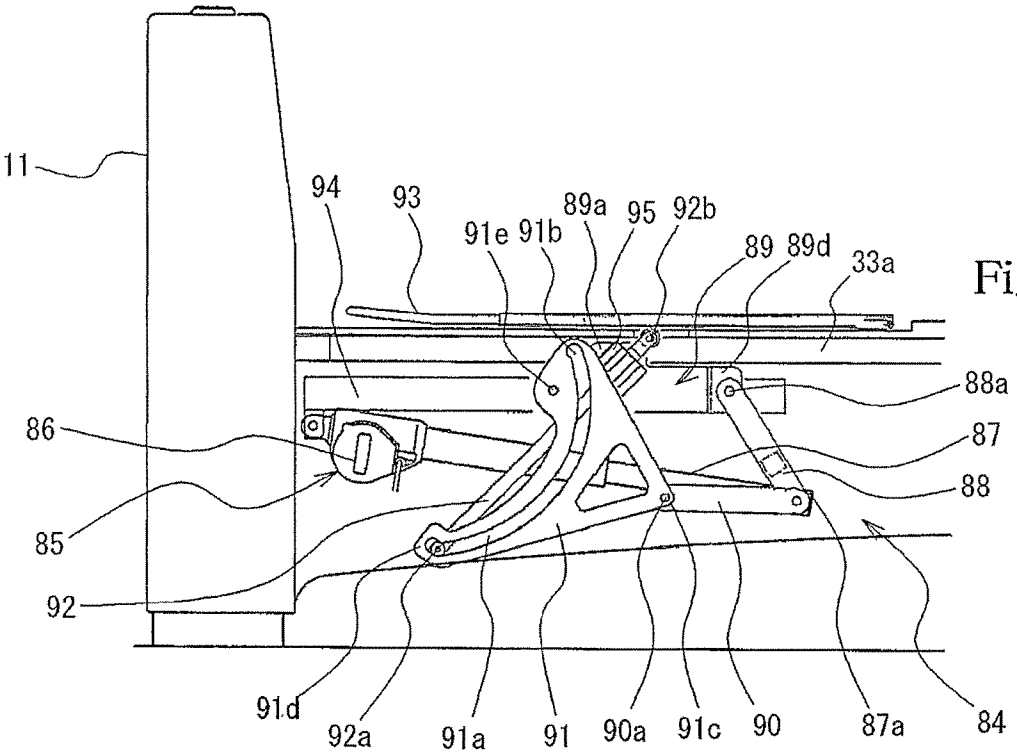
FIG. 22A is a side view illustrating another reclining structure and a state in which the caregiving bed is not reclined.

The following describes the operation of the reclining mechanism. First, when the caregiving bed is not reclined, the operating post 87 of the actuator 85 projects in a state as illustrated in FIG. 22A. Specifically, by projection of the operating post 87 of the actuator 85, the link plate 90 coupled with the end part 87*a* of the operating post 87 pulls one end of the cam plate 91, whereby the cam plate 91 is rotated on the cam fulcrum 91*e* serving as an axis. In this manner, the moving shaft 92*a* of the shaft 92 moving in the movement groove 91*a* formed in the cam plate 91 is disposed in the lowest position. In this manner, the shaft 92 itself is also lowered, and the roller 92*b* that pushes up the arm member 93 is also lowered, and reclining is not performed.

Figure 23:
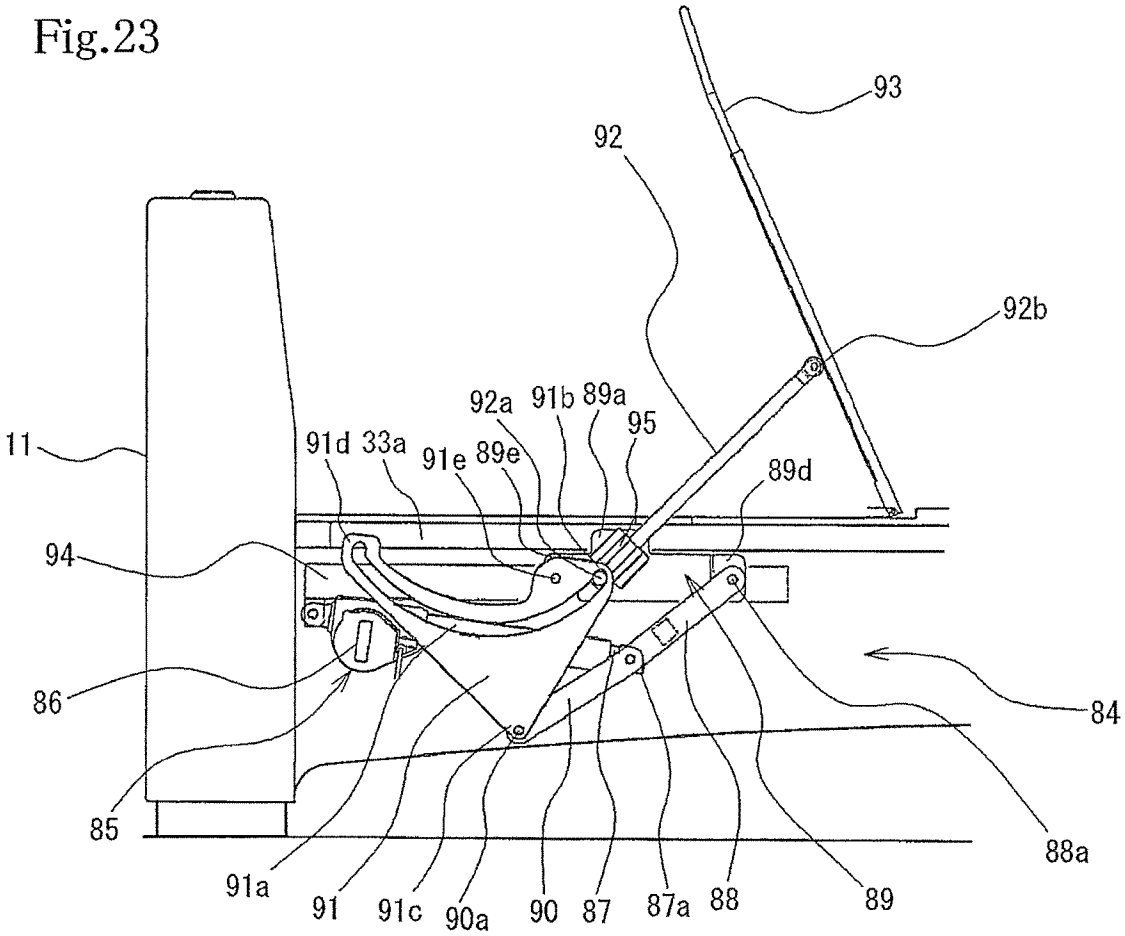
FIG. 23 is a side view of the reclining structure of FIG. 22 in a state in which reclining is performed.

When the reclining is performed, the driving means 86 of the actuator 85 is driven to retract the operating post 87, as illustrated in FIG. 23. By the retraction of the operating post 87, the link plate 90 presses one end of the cam plate 91, whereby the cam plate 91 is rotated on the cam fulcrum 91*e* of the cam plate 91 serving as the axis. By rotation of the cam plate 91, the movement groove 91*a* formed in the cam plate 91 is also moved, and the moving shaft 92*a* of the shaft 92 supported in the movement groove 91*a* is moved along the movement groove 91*a*. By the movement of the moving shaft 92*a*, the shaft 92 itself is also moved upward along the guide hole in the guide member 95, and the arm member 93 is pushed up by the roller 92*b* provided on the other end of the shaft 92 to achieve reclining.

In this operation, the roller 92*b* is rotated to smoothly raise the arm member 93. A guide rail that guides the roller 92*b* may be provided on the lower side of the arm member 93, to accurately move the roller 92*b*. Because the shaft 92 is moved along the guide hole in the guide member 95 attached to the fixing member 89, the shaft 92 is moved in a straight line, and stable reclining can be performed.

Figure 24A:
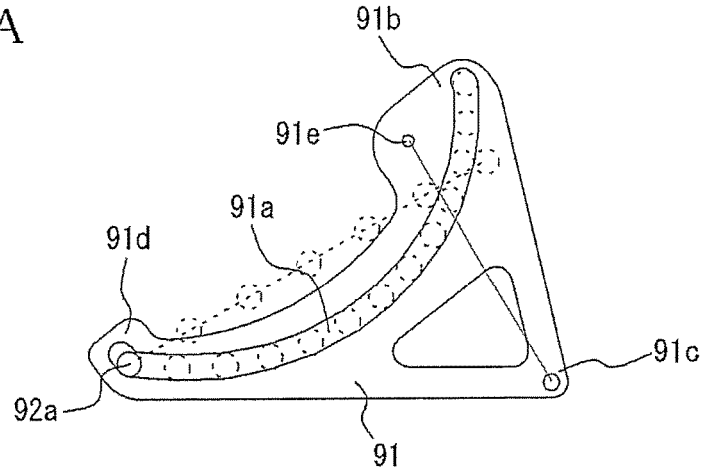
FIG. 24A to FIG. 24C are enlarged side views illustrating relation between a movement groove of a cam plate of the reclining structure and a moving axis of a shaft.
Figure 24B:
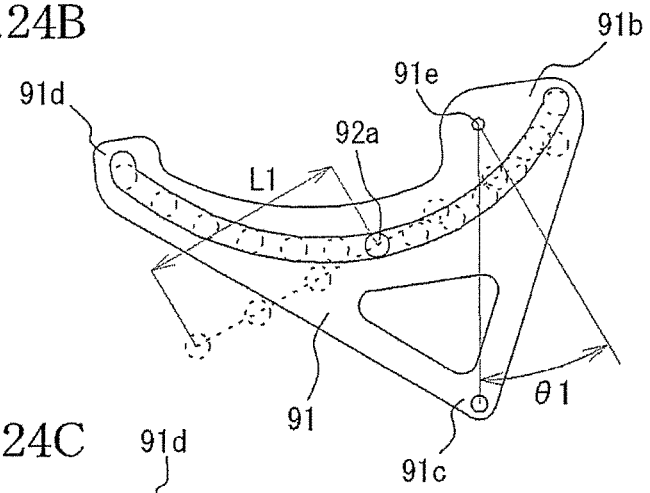
Figure 24C:
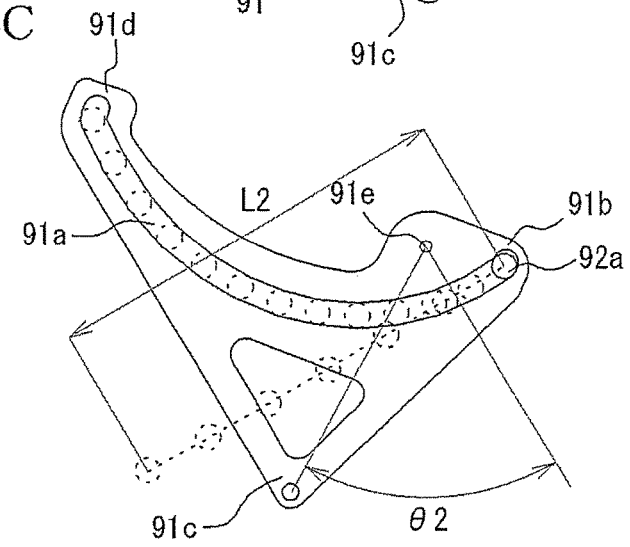

The relation between the movement groove 91*a* of the cam plate 91 and the moving shaft 92*a* of the shaft 92 will be explained hereinafter with reference to FIG. 24A to FIG. 24C. In a state where the caregiving bed is not reclined, the moving shaft 92*a* of the shaft 92 is disposed in the lowest position (the third vertex part 91*d*), as illustrated in FIG. 24A. Then, when reclining is performed and the cam plate 91 is rotated by a predetermined angle θ1, for example, 30° on the cam fulcrum 91*e* serving as the axis as illustrated in FIG. 24B, the moving shaft 92*a* is moved in the arc-shaped movement groove 91*a* and gradually moved obliquely upward (distance L1) from the initial position, as the cam plate 91 moves. Thereafter, when the retraction of the operating post 87 is finished and rotation of the cam plate 91 is stopped after the cam plate 91 is rotated by a predetermined angle θ1, for example, 60° (see FIG. 24C), the moving shaft 92*a* is moved to the first vertex part 91*b* being the other vertex part of the movement groove 91*a*, and moved obliquely upward by a distance L2 (L1<L2) from the initial position to be disposed in the highest position. In this operation, the arm member 93 provided in the frame 33*a* is reclined to the most inclined state (see FIG. 23).

By adopting the above structure, because the reclining mechanisms 84 are based on the fixing member 89 attached to the frame 33*a*, the reclining mechanisms 84 can be easily attached even in a small space, by attaching the fixing member 89. In addition, the reclining mechanisms 84 can be attached to the caregiving bed as an option.

Although the above explanation shows the case of using the reclining mechanisms having a pair of actuators provided on respective sides of the bed main body, the structure is not limited to it, but may be a structure in which reclining mechanisms excluding the actuators are provided on respective sides of the bed main body, only one actuator is attached to the center part of the bed main body, and the reclining mechanisms on both sides of the bed main body are operated by the operation of the actuator. In this manner, because the reclining mechanisms on both sides are operated by the operation of the same actuator, both sides can be uniformly reclined to provide the care-receiver with a sense of security.

The following describes the caregiving bed 10A using another reclining method. Although the following explanation shows the part close to one support platform 11 as a representative, the part close to the other support platform 12 is provided with the same structure. Illustration of constituent elements, such as the water tank, other than the necessary constituent elements are omitted. The method has a structure in which a support column 13*a*' (illustration of a support column 13*b*' is omitted) provided in the support platform 11 is formed to have a long side, and the bar-shaped member 37 is put on an attachment part 13$a_3$' of an upper end part 13$a_1$' of the support column 13*a*', as illustrated in FIG. 25A. A first coupling part 61*a* provided in the bar-shaped member 37 is coupled to a second coupling part 61*b* provided in the frame 33*a* to be reclined and close to the care-receiver's head part, with a coupling member 61 formed of a wire, a rope, or a metal bar-shaped member. The frame 33*a* to be reclined is configured to be partly bent. The upper end part 13$a_1$' of the support column 13*a*' in this state has a height of about 1.5 m to 2.5 m from the floor.

Figure 25B:
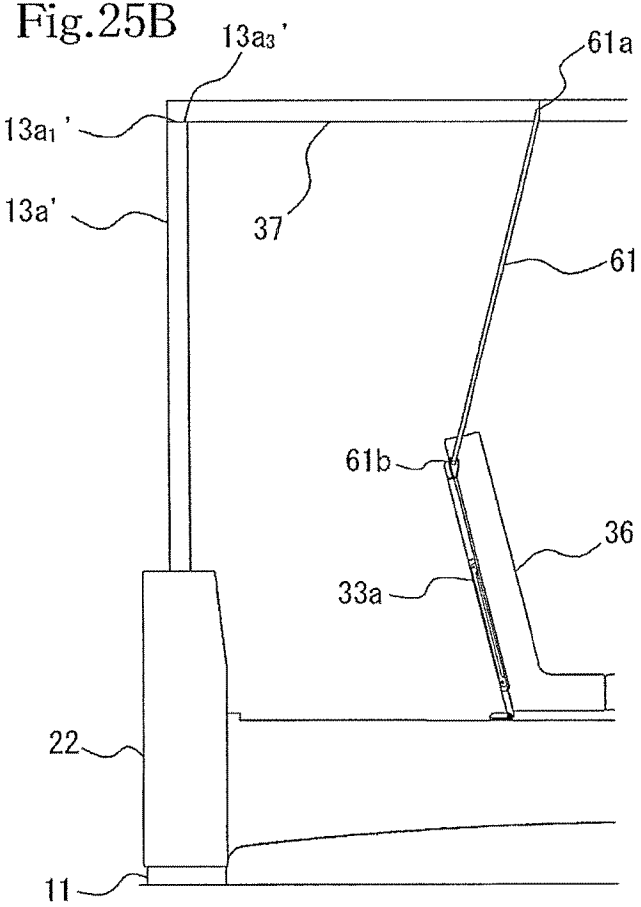
FIG. 25B is a side view illustrating the reclining structure in a raised state.
Figure 25A:
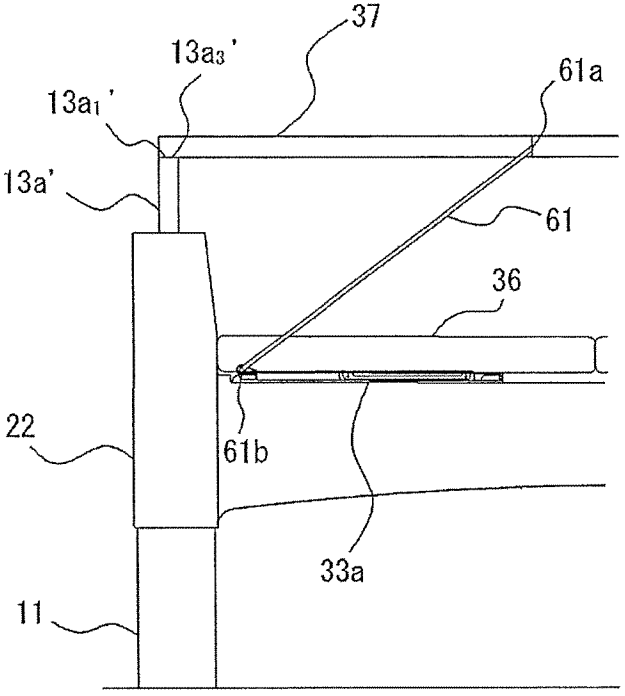
FIG. 25A is a side view of another reclining structure in a flat state.

When reclining is performed, the bed main body 22 is raised in a state where the care-receiver lies on the mat 36 to bring the bed main body 22 close to the bar-shaped member 37, as illustrated in FIG. 25B. In this state, the first coupling part 61*a* of the bar-shaped member 37 is coupled with the second coupling part 61*b* of the frame 33*a*, with the coupling member 61. Thereafter, the bed main body 22 is lowered and brought away from the bar-shaped member 37, and the frame 33*a* is pulled by the coupling member 61 coupled to the bar-shape member 37 to perform reclining. Because the support column 13*a*' connected with the bar-shaped member 37 is raised simultaneously with the lowering of the bed main body 22, reclining can be performed even when the bed main body 22 is raised or lowered by a short distance. Because the reclining structure is a simple structure of simply coupling the bar-shaped member 37 to the frame 33*a* with the coupling member 61, reclining can be performed by a stable operation. The simple structure also reduces the manufacturing cost, and provides an inexpensive caregiving bed. A beam for maintaining strength may be provided between the bar-shaped members 37.

The coupling members 61 may be formed of string members such as wires and ropes, and the first coupling parts 61*a* of the bar-shaped members 37 may be provided with a winding device such as a winch. In this manner, reclining can be performed by operating the winding device, without raising or lowering the bed main body. The structure using the winding device is achieved by forming each support column long, and extending a bar-shaped member between the support columns. The reclining structure using the winding device may be provided alone, or may be used together with the reclining structure using the raising and lowering of the bed main body. In this manner, reclining can be performed using each of the structures separately, or the reclining structure using the winding device may be used as an assistant of the reclining structure using the raising and lowering of the bed main body.

Figure 26:
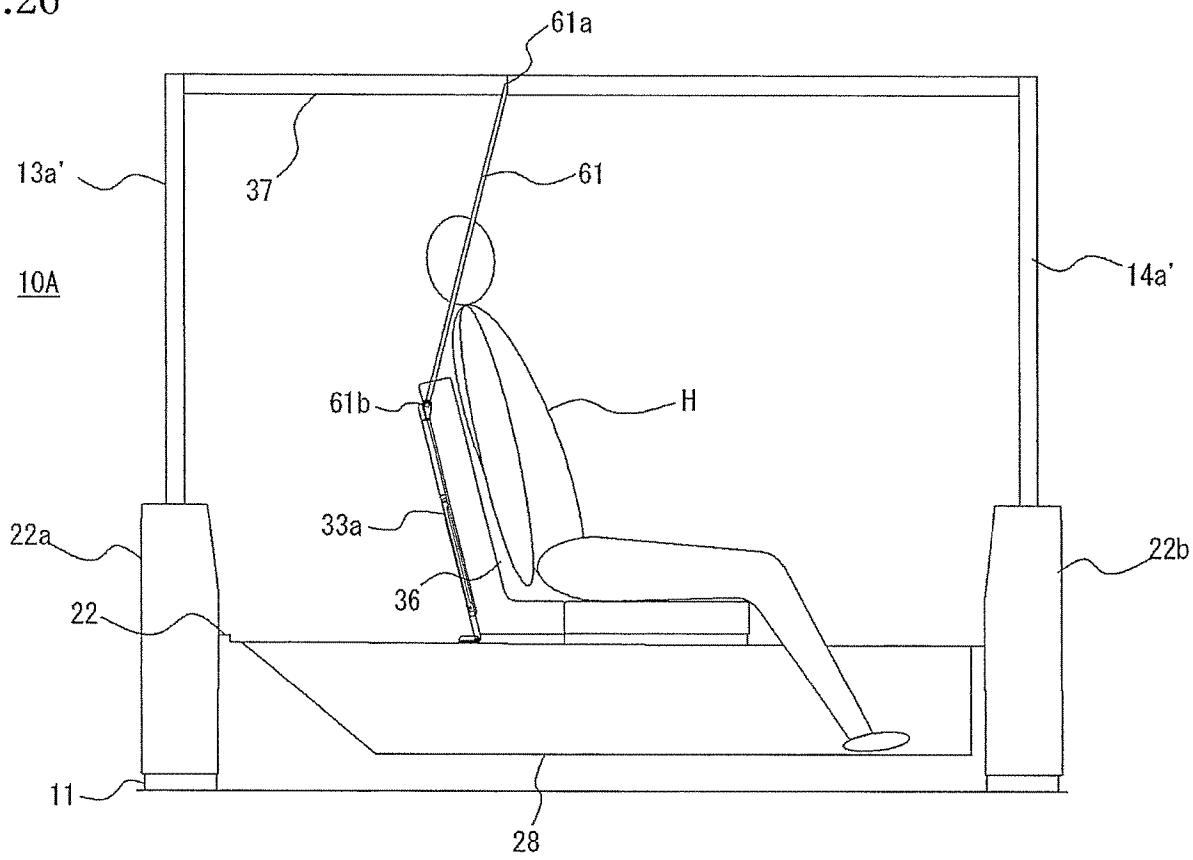
FIG. 26 is a diagram illustrating an example of a mode of use of the reclining structure.

As illustrated in FIG. 26, the caregiving bed 10A can be reclined in a state where the mat 36*c* and the frame 33*c* (see FIG. 2) for the care-receiver's leg part are removed, to enable the care-receiver to sit with the legs put down to the water tank 28, that is, in a state of sitting on a chair. In related art, because the care-receiver in the reclined bed is in the state where the legs are stretched on the bed, the care-receiver has much difficulty in eating a meal or the like. Although the care-receiver can bend the care-receiver's legs to sit cross-legged on the bed, it is difficult for care-receivers who do not have full use of their legs to sit cross-legged, and sitting cross-legged for a long time may numb the care-receiver's legs. The structure that enables the care-receiver to sit like sitting on a chair enables the care-receiver to easily have a meal and sit on the bed for a long time. Thus, with the caregiving bed according to Embodiment 2, detachment and attachment of the mat and the frame are performed in combination with reclining, whereby the care-receiver can sit on the bed like sitting on a chair. Although FIG. 26 shows the case of using the reclining method illustrated in FIG. 25, the structure is not limited to it, but the other reclining methods described above may be used.

The caregiving bed of the present invention is configured in consideration of safety for the care-receiver and the caregiver. An example of the safety structure included in the caregiving bed will be explained hereinafter with reference to FIG. 27A to FIG. 27D. In the safety structure, a gap G1 between a side surface of the support platform 11 and side surfaces of the bed main body 22 is configured to fall within a predetermined length when the bed main body is lowered, to prevent the toe or the like from entering spaces under the side surfaces 24, 25, and 27 (side surface 26 is not illustrated) of the bed main body 22 on the side provided with the support platform 11. Specifically, as illustrated in FIG. 27A to FIG. 27D, the gap G1 between a side surface of the support platform 11 and the side surfaces 24, 25, and 27 of the bed main body 22 is formed to have a length of, for example, 20 mm or less.

In addition, when the bed main body 22 is lowered, the toe or the like may be caught in any of the spaces under the side surfaces 24, 25, and 27 of the bed main body 22. To prevent this, a fixed space G2 is formed between the floor surface on which the caregiving bed is placed and the side surfaces 24, 25, and 27 of the bed main body 22. Specifically, as illustrated in FIG. 27A to FIG. 27D, the height of the gap G2 from the floor surface to the under parts of the side surfaces 24, 25, and 27 of the bed main body 22 is configured to be, for example, 30 mm or more, in the state where the bed main body 22 is lowered. The gap formed as described above prevents the caregiver and the care-receiver from being injured with one's toe or instep being caught.

Figure 27A:
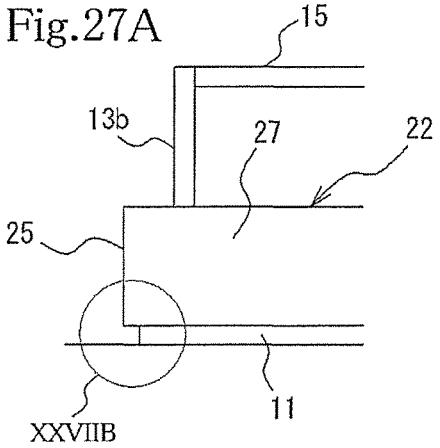
FIG. 27A to FIG. 27F are diagrams illustrating a safety structure of the caregiving bed.
Figure 27B:
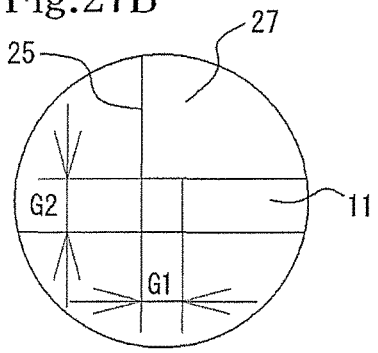
Figure 27C:
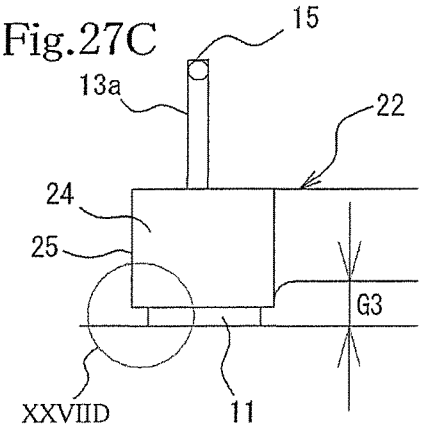
Figure 27D:
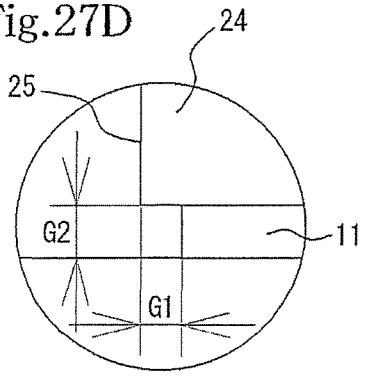

The space under a part of the side surface 24 of the bed main body 22 without the support platform 11 has no part that blocks entering of the toe, the toe may enter the inner part of the space, and the instep may be caught as well as the toe. To prevent this, as illustrated in FIG. 27C, the part of the side surface 24 of the bed main body 22 without the support platform 11 is provided with a gap G3 having a predetermined height, for example, 80 mm or more, between the lower surface of the side surface 24 of the bed main body and the floor surface, in the state where the bed main body 22 is lowered.

Figure 27E:
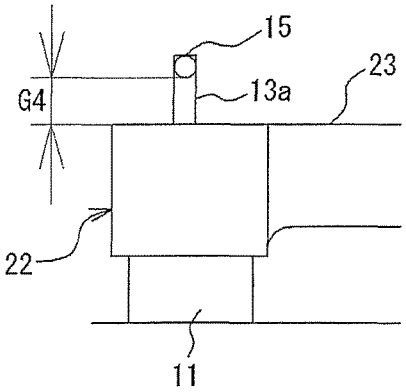
Figure 27F:
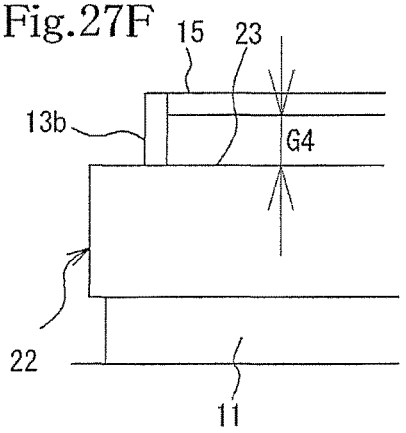

In addition, the caregiving bed of the present invention has the structure in which the support columns 13*a* and 13*b* (the part including the support columns 14*a* and 14*b* is not illustrated) and the beam member 15 are raised and lowered in a direction opposite to a direction of raising and lowering of the bed main body 22. In this manner, in the state where the bed main body 22 is raised, the beam member 15 is lowered, and the gap between the beam member 15 and the pad part 23 of the bed main body 22 is most narrowed. In this state, when the care-receiver's head is caught between the beam member 15 and the bed main body 22, the care-receiver may be injured. To prevent this, as illustrated in FIG. 27E and FIG. 27F, a gap G4 having a predetermined width, for example, 30 cm or more, is formed between the beam member 15 and the pad part 23 of the bed main body 22 in the state where the beam member 15 is lowered. This structure prevents the care-receiver's head from being caught when the bed main body is lowered. Although FIG. 27E and FIG. 27F illustrate a distance from the upper surface of the bed main body to the beam member as the gap G4, a distance from the upper surface of the headboard to the beam member serves as the gap G4 in the case where the bed main body is provided with the headboard.

In the caregiving bed described above, a plurality of actuators are used to raise, lower, and recline the bed main body. Thus, it is necessary to control these actuators to safely use the caregiving bed. To achieve this, the caregiving bed is provided with a control unit Co that controls operations of the actuators. A safety device of the caregiving bed will be explained hereinafter with reference to the block diagram of FIG. 28.

Figure 28:
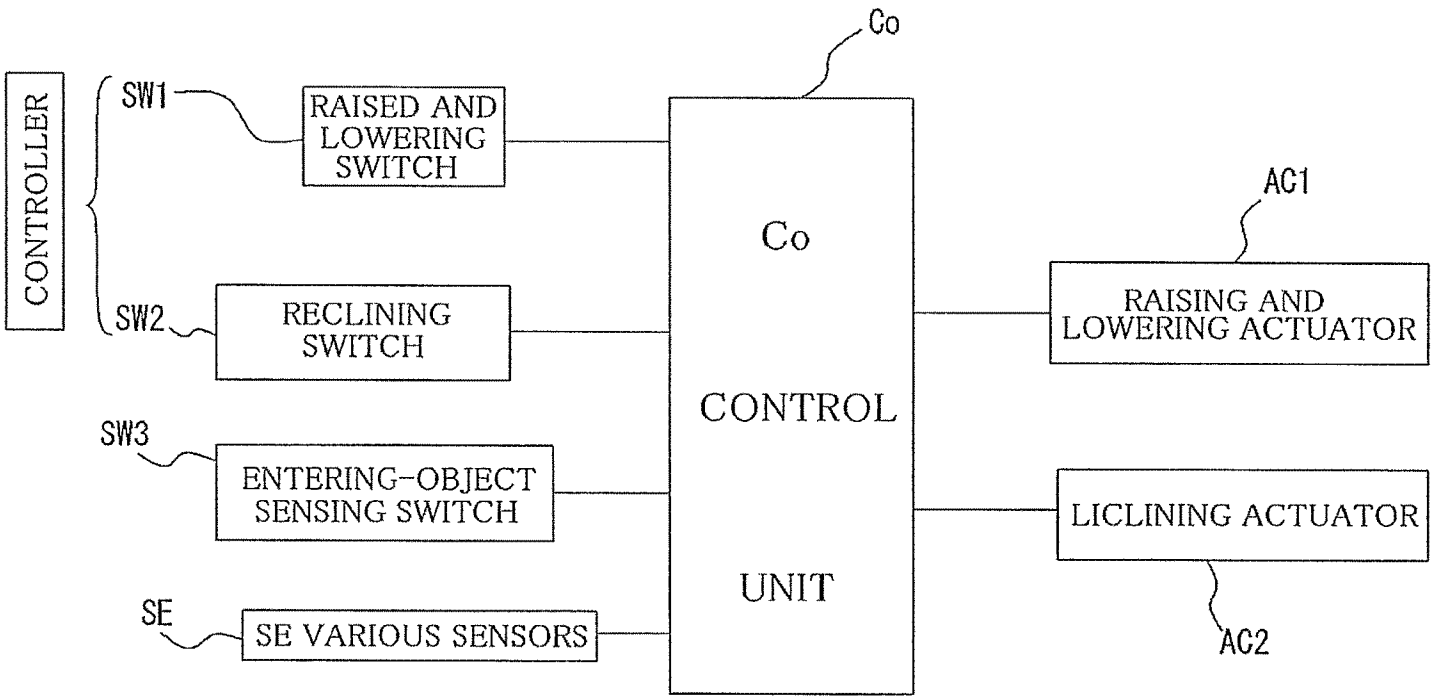
FIG. 28 is a block diagram illustrating a safety device.

Each of the actuators included in the caregiving bed is basically operated by the caregiver by pressing switches of a controller located at hand, such as a raising and lowering switch SW1 and a reclining switch SW2. FIG. 28 illustrates a raising and lowering actuator (the actuator 16 illustrated in FIG. 3) as AC1, and a reclining actuator (the actuator 85 or the like illustrated in FIG. 23) as AC2. In this structure, the operations of the actuators AC1 and AC2 are controlled by the control unit Co such that the actuators AC1 and AC2 operate only while the respective switches SW1 and SW2 are pressed, and the actuators AC1 and AC2 are immediately stopped when pressing of the respective switches is stopped. Specifically, the actuators are not operated automatically or by the force of inertia.

The actuator AC1 for raising and lowering the bed main body 22 and the reclining actuator AC2 are controlled so as not to operate simultaneously. Specifically, when the raising and lowering switch SW1 and the reclining switch SW2 of the controller are pressed simultaneously, the actuators AC1 and AC2 are controlled such that neither of the actuators AC1 and AC2 is operated. An unsafe operation is suppressed in this manner.

To enhance safety in raising, lowering, and reclining the bed main body, the caregiving bed has a mechanism to maintain the raising, lowering, or reclining state of the bed main body, when the power source is shut off due to power failure or falling of the plug out of the socket. As the maintaining mechanism, the caregiving bed may be provided with a gear brake mechanism such as a worm gear, or a mechanism such as an oil hydraulic cylinder and a pneumatic cylinder. In this manner, because the raising, lowering, or reclining state of the bed main body can be maintained even when the operation of each actuator is stopped, abrupt movement of the bed main body and the reclining mechanism is prevented even if power supply from the power source is stopped, and safety is enhanced. These mechanisms may be integrated into the actuators serving as the elevator devices in the support platforms, the transmission mechanisms connected to the actuators, and the reclining mechanisms, or may be attached as separate mechanisms.

The actuators AC1 and AC2 operate together with various sensors SE provided in the caregiving bed. For example, in the case where the caregiving bed is used as a bathtub, when the reclining actuator AC2 is operated in a state where the frame 33 is removed, the shaft 92 (see FIG. 23) projects and may be dangerous. To prevent this, the caregiving bed is configured such that the actuator AC2 used for reclining cannot be operated in the state where the frame is removed. In this case, the lower part of the frame or the pad part of the bed main body may be provided with a sensor or a switch that senses whether the frame is located.

The caregiving bed may have a structure in which the frame can be removed only in a state where the reclining mechanism is lowered. In this case, the caregiving bed may have a structure in which each of the bed main body and the frame has a lock mechanism such as a claw or a hook, the sensors SE sense whether the reclining mechanism is in the lowered state, to open and close the lock mechanism. In addition to the lock mechanism, the caregiving bed may be provided with a notification mechanism that sounds a buzzer or the like when caregiver is removing the frame in the state where the reclining mechanism is not in a lowered position, to notify the caregiver.

As another safety device, the caregiving bed is controlled to stop the operations of the actuators AC1 and AC2, when the sensors SE sense that an excessive load is applied onto the operations of the actuators while the actuators AC1 and AC2 are operating. In addition, the caregiving bed is controlled to stop the actuator AC1 or AC2, when the raising/lowering distance of the bed main body or the distance of movement of the reclining mechanism is not changed even when the switch SW1 or SW2 of the controller is pressed. This structure prevents the care-receiver and the caregiver from being injured, and suppresses a malfunction of the caregiving bed.

To prevent entering of any object when the reclining mechanism or the bed main body is lowered, the caregiving bed is controlled to stop the operations of the actuators when entering of any object is sensed. For example, the caregiving bed is controlled to stop the reclining actuator AC2, when the sensors sense that any object enters between the frame and the bed main body while the reclining mechanism is lowered. As devices for sensing entering of any object, a plurality of sensors SE may be disposed, or a plurality of switches SW3 such as push switches or leaf switches may be disposed on at least one of the side of the frame abutting on the bed main body, and the side of the bed main body abutting on the frame.

In the same manner, the actuator AC1 can be stopped when the sensors sense entering of any object while the bed main body is lowered. In this case, the entering of any object can be sensed by sensors SE or switches SW3 that are similar to the above and disposed on lower sides of the side surfaces of the bed main body.

Figure 29A:
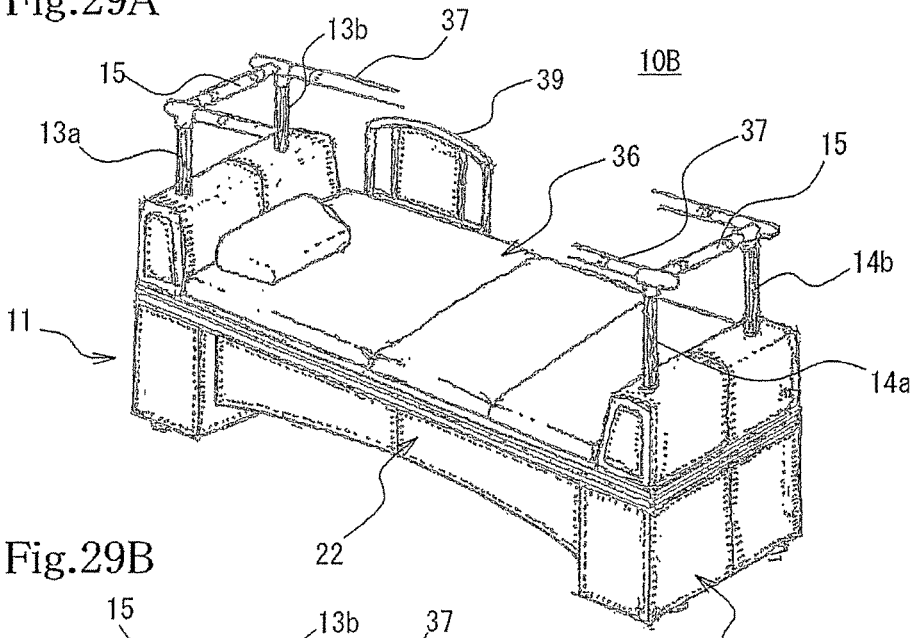
FIG. 29A and FIG. 29B are perspective views illustrating a modification of the caregiving bed.
Figure 29B:
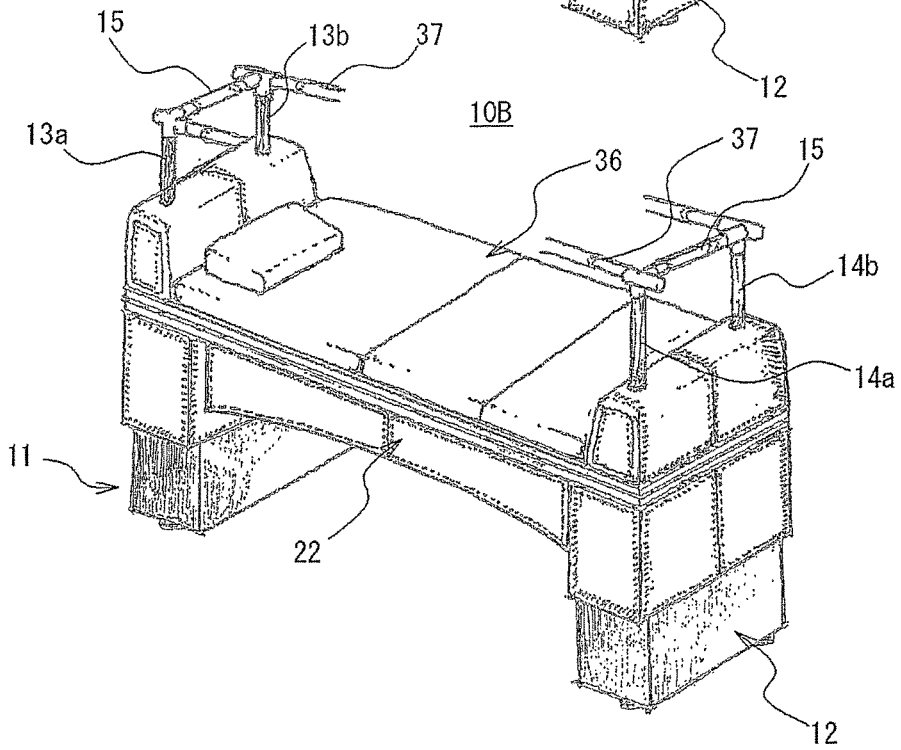
Figure 30A:
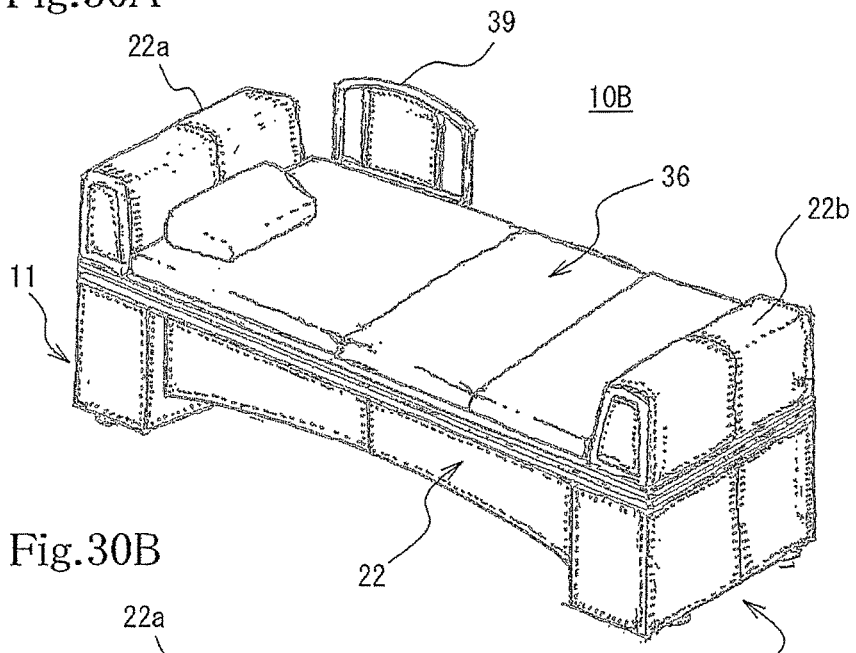
FIG. 30A and FIG. 30B are perspective views illustrating another mode of use of the modification of the caregiving bed.
Figure 30B:
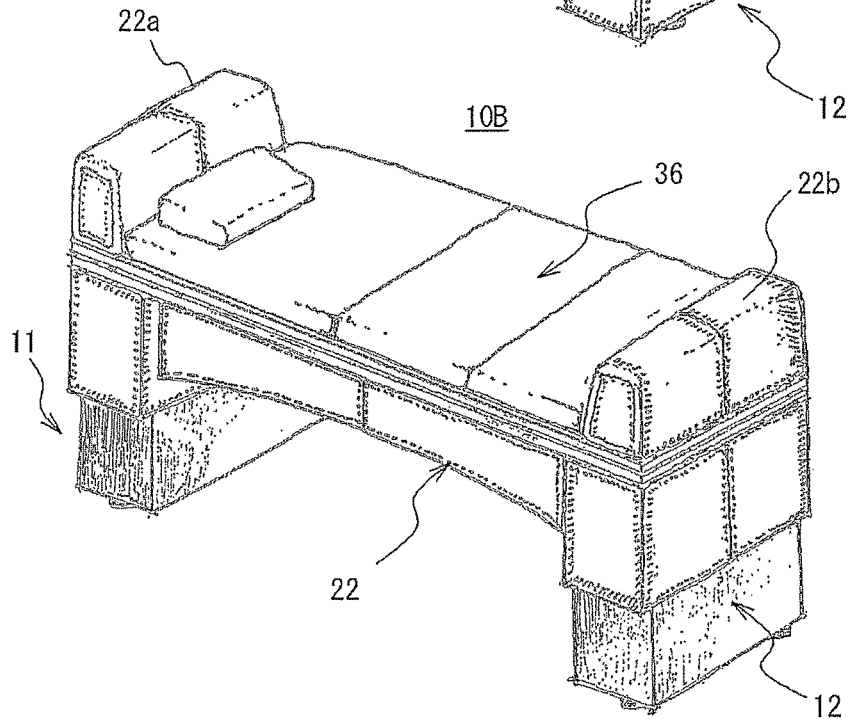
Figure 31:
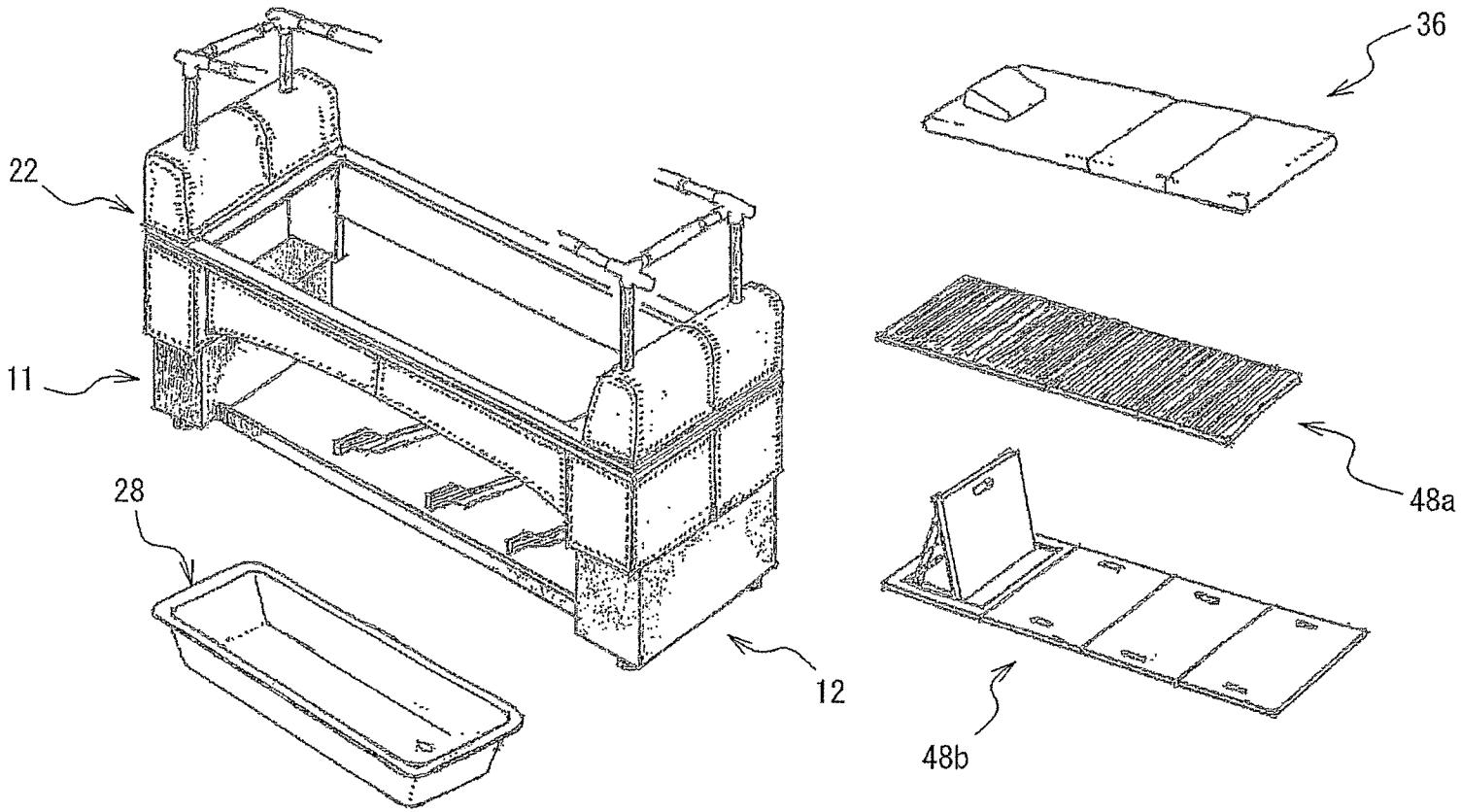
FIG. 31 is an exploded view of the modification of the caregiving bed.

FIG. 29 and FIG. 30 illustrate another modification of the caregiving bed. A caregiving bed 10B illustrated in FIG. 29 has a structure in which the bed main body 22 is provided with a headboard 22*a* and a footboard 22*b* that are covered with a luxury material such as leather. FIG. 29A illustrates the bed main body 22 in a lowered state, and FIG. 29B illustrates the bed main body 22 in a raised state. FIG. 30A illustrates a state where parts of the support columns 13*a*, 13*b*, 14*a*, and 14*b* exposed from the bed main body are removed. FIG. 30A illustrates the bed main body 22 in the lowered state, and FIG. 30B illustrates the bed main body 22 in the raised state. Also in this case, the bed main body is covered with leather. FIG. 31 is an exploded view of the caregiving bed 10B. FIG. 31 illustrates two types of lid members 48*a* and 48*b* that cover the water tank. One lid member 48*a* has a plate-like shape, and is divided into a plurality of parts. The other lid member 48*b* has a reclining function, and is also divided into a plurality of parts.

The external appearance of the caregiving bed 10B can be formed of a material other than leather, for example, any of wood, metal, and synthetic resin, or a combination thereof including leather. Such material provides the caregiving bed with a warm appearance and a sense of luxury. Thus, the caregiving bed can be placed as interior furniture without discomfort, and provides the care-receiver and the caregiver with ease. Japanese cypress and Japanese cedar can be used as the wood material, and it is possible to use the wood material impregnated or coated with resin. The material may be subjected to surface treatment with leather or the like. A synthetic resin material may be subjected to general-purpose processing, such as processing to provide the synthetic material with the woodgrain.

Figure 32:
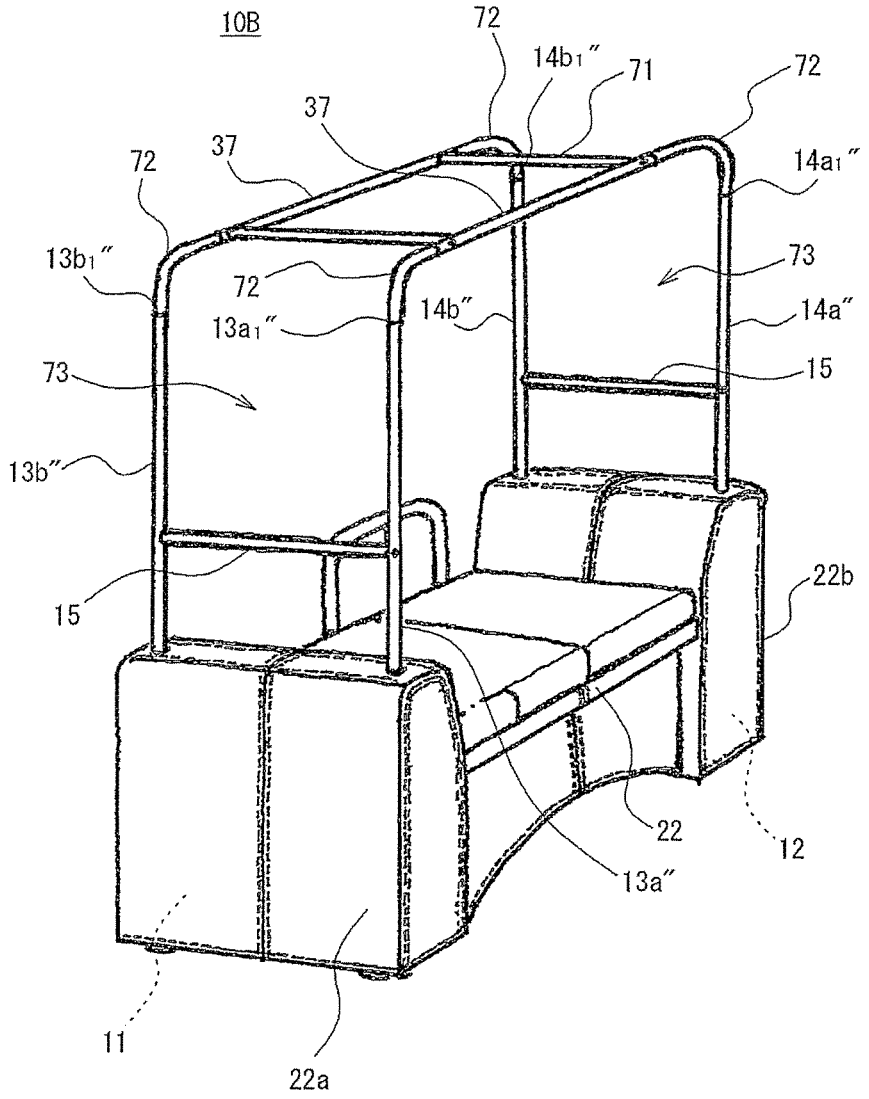
FIG. 32 is a perspective view of a modification of the caregiving bed with another shape.

As another structure of the caregiving bed 10B, as illustrated in FIG. 32, the caregiving bed 10B may have a structure in which support columns 13*a*", 13*b*", 14*a*", and 14*b*" provided in the support platforms 11 and 12 (illustrated with dotted lines because they are covered with the bed main body 22 in FIG. 32) are formed to be long, and the bar-shaped members 37 extend between attachment parts (illustration thereof is omitted) of upper end parts $\mathbf{13}a_1$", $\mathbf{13}b_1$", $\mathbf{14}a_1$", and $\mathbf{14}b_1$" of the support columns 13*a*", 13*b*", 14*a*", and 14*b*". The upper end parts $\mathbf{13}a_1$", $\mathbf{13}b_1$", $\mathbf{14}a_1$", and $\mathbf{14}b_1$" of the support columns 13*a*", 13*b*", 14*a*", and 14*b*" in the structure are configured to have a height of about 1.5 m to 2.5 m from the floor. Beams 71 for maintaining the strength are provided between the bar-shaped members 37 and in parallel with the beam members 15. Because this structure forms a space 73 between the long support columns 13$a$", 13$b$", 14$a$", and 14$b$", functions such as a television, a mirror, and a shelf can be added to the space 73, to provide the care-receiver with a cultural daily life.

The above support columns and the bar-shaped members may also be provided with rehabilitation tools. For example, a rope that the care-receiver can hold when the care-receiver stands up may be suspended from the bar-shaped members provided above, and the care-receiver may be put in rehabilitation using the rope. The rehabilitation may be performed together with the raising and lowering of the bed main body, according to the exercise function of the care-receiver. The support columns and the bar-shaped members may also be provided with a device for moving the care-receiver to a wheelchair, such as a lifting device that lifts the care-receiver. Such devices enable easy movement of the care-receiver from the caregiving bed to a wheelchair, or from a wheelchair to the caregiving bed.

Connecting parts 72 that connect the support columns 13$a$", 13$b$", 14$a$", and 14$b$" with the bar-shaped members 37 are processed to have a curved shape, to enhance safety and obtain good external appearance. Part or all of the long support columns 13$a$", 13$b$", 14$a$", and 14$b$", the bar-shaped members 37, the beams 71, and the beam members 15 may be covered with leather or quilting, or subjected to chromium plating, to obtain higher safety and good external appearance.

Figure 33:
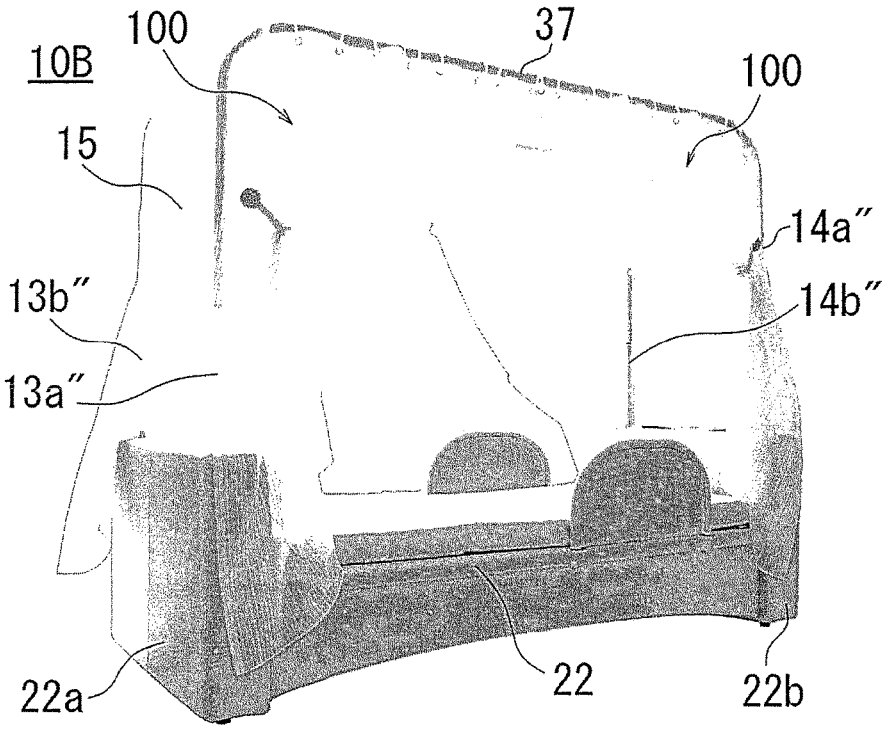
FIG. 33 is a perspective view of a modification of the caregiving bed with another shape.

Because the support columns 13$a$", 13$b$", 14$a$", and 14$b$" are formed to be long and the bar-shaped members 37 are disposed in a high position, a curtain 100 or the like can be attached to the bar-shaped members 37, as illustrated in FIG. 33, to secure a private space for the care-receiver.

In the case of adopting a structure with the long support columns and in which the support columns are not operated together with the raising and lowering of the bed main body by the elevator devices, earthquake-resistant members may be provided between the ceiling and the long support columns and the bar-shaped members, such as telescopic bar-shaped members that can be fixed with a predetermined length. In this manner, earthquake-resistant measures can be taken to prevent shaking in disasters such as an earthquake.

In the above modes of use, the caregiving bed may include no elevator devices, in the case where the lifting member or the reclining mechanisms are not used, and in the case where the care-receiver wishes to use a mode of use that does not require the raising and lowering of the bed main body. In particular, the caregiving bed for the care-receiver of a low care level is not required to include any special function. Without the elevator devices, the caregiving bed can be introduced at low cost. It is preferable for the care-receiver of a low care level to excrete and bathe in the toilet and the bath as much as possible. Because the support platforms and the bed main body are separated from each other as described above, only the support platforms can be replaced when the elevator devices are required.

Because the caregiving bed is placed in the room of a house or a nursing facility, a large caregiving bed is difficult to carry into the room as it is. Thus, the caregiving bed is configured to be easily assembled from its components in the room.

The caregiving bed of the present invention enables addition of many functions to the bed in the state of being used as an ordinary bed, according to the care situations for the care-receiver as described above, and enables easy change and addition of the constituent elements.

REFERENCE SIGNS LIST

10, 10A, and 10B: Caregiving bed
11: Support platform
11$a$: Upper surface
11$a_1$: Upper-surface through hole
11$a_2$: Opening
11$b$, 11$c$, 11$d$, and 11$e$: Side surface
11$f$: Bottom surface 11$f_1$: Leg
12: Support platform
13$a$, 13$b$, 13$a$', and 13$a$": Support column
13$a_1$, 13$b_1$, 13$a_1$', and 13$a_1$": Upper end part
13$a_2$ and 13$b_2$: First fulcrum
13$a_3$, 13$b_3$, and 13$a_3$': Attachment part
14$a$ and 14$b$: Support column
14$a_1$ and 14$b_1$: Upper end part
14$a_3$ and 14$b_3$: Attachment part
15: Beam member
15$_1$: Attachment part
16: Elevator device (actuator)
17: Operating part
18: Extending member
18$_1$: Second fulcrum
19: Transmission mechanism
20: Fixing member
20$_1$: Central portion
21: Rotational member
22: Bed main body
22$_1$: Pad-part attachment part
22$_1$": Projection
22$a$: Headboard
22$b$: Footboard
23: Pad part
23$a$: Opening part
23$b$: Pad-part through hole
23$c$: Lower part
24, 25, 26, and 27: Side surface part
28: Water tank
28$a$: Inclined part
28": Water tank
28$a$": Water tank main body
28$b$": Head placing part
28$c$": Backrest part
28$d$": Hip placing part
28$d_1$: Stair
28$e$": Leg placing part
28$e_1$: Narrowed part
28$e_2$: Top part 28$f$": Claw part
28$g$": Step
28$h$": Neck placing part
29: Support fixing part
30: Support plate member
31: Drain
31$a$: Plug member
31": Drain
32: Drainpipe
32": Drainpipe
33 (33$a$, 33$b$, 33$c$), 33', and 33"; Frame
33$_1$: End part
33$b$': Opening part
34: Locking part
35: Lattice part
36 (36$a$, 36$b$, and 36$c$): Mat
37: Bar-shaped member (suspension member)
38, 138, 138', 238, 338, 438, and 538: Hammock (lifting member)
38$a$: Loop
39: Fence
40: Sheet
41: Connecting member (suspension member)
41$a$: One end

41*b*: The other end
48*a* and 48*b*: Lid member
50 and 50': Slide member
50*a*: Fixed sheet part
50*b*: Slide sheet part
51: First tape member
52: Second tape member
53: Ear
54: Double sheet member
54*a*: First sheet member
54*b*: Second sheet member
55: Overlapping part
56: Belt member (suspension member)
56*a*: End part
57: First coupling part
58: Second coupling part
59: Ring part
60: Belt member (suspension member)
60*a*: Connecting part
61: Coupling member
61*a*: First coupling part
61*b*: Second coupling part
71: Beam
72: Connecting part
73: Space
84: Reclining mechanism
85: Actuator
86: Driving means
87: Operating post
87*a*: End part
88: Link beam
88*a*: End part
89: Fixing member
89*a*: Fixing part
89*b*: Side surface part
89*c*: Bent part
89*d*: First attachment part
89*e*: Second attachment part
90: Link plate
90*a*: End part
91: Cam plate
91*a*: Moving groove
91*b*, 91*c*, and 91*d*: First to third vertex parts
91*e*: Cam fulcrum
92: Shaft
92*a*: Moving shaft
92*b*: Roller
93: Arm member
94: Base member
95: Guide member
100: Curtain
138*a*, 138*a'*, 238*a*, 338*a*, 438*a*, and 538*a*: Belt member (suspension member)
138*b*: Center line
138*c*: Axis line
138*d*, 138*d'*, and 238*d*: Meshes
138*e*: Center part
338*a*$_1$: End part
AC1 and AC2: Actuator
Co: Control unit
g, G1, G2, G3, and G4: Gap
H: Care-receiver
SE: Sensor
SW1: Raising and lowering switch
SW2: Reclining switch
SW3: Switches
T: Drainage tank
L1 and L2: Distance
θ1 and θ2: Predetermined angle

The invention claimed is:

1. A caregiving bed comprising:

a bed main body;

one support platform and another support platform supporting both longitudinal ends of the bed main body, the bed main body including a rectangular pad part having a predetermined area and thickness allowing a care-receiver to lie thereon, each of the one and the other support platforms being provided with support columns projecting from the bed main body, an amount of projection of the support columns from the bed main body changing in response to the bed main body being raised or lowered, the upper part of the support columns being provided with an attachment part to which a suspension member is detachably attached, the caregiving bed being provided with one or more elevator devices to raise and lower the bed main body and the support columns, and one or more transmission devices to raise and lower the support columns in the reverse direction when the bed main body is raised or lowered, the one or more transmission devices being operatively connected to the one or more elevator devices such that a distance between at least one end of the one or more transmission devices and a top surface of the bed main body changes in response to movement of the one or more elevator devices, and a distance between the pad part and the attachment part decreasing when the bed main body is raised by the elevator devices, whereas the distance between the pad part and the attachment part increasing when the bed main body is lowered.

2. The caregiving bed according to claim 1, wherein the suspension member is a pair of belt members forming a lifting member to lift up the care-receiver;

the belt members are attached along a longitudinal direction between the attachment part of the one support platform and the attachment part of the other support platform; and a distance between the bed main body and the lifting member decreases when the bed main body is raised by the elevator devices, whereas the distance between the bed main body and the lifting member increases when the bed main body is lowered.

3. The caregiving bed according to claim 2, wherein the pad part has an opening part, the opening part is provided with a box-shaped water tank detachably supported and fixed to the pad part, the water tank being opened to the opening part and having a bottom part provided with a drain that is openable and closable, and a frame that is divided into a plurality of parts is detachably disposed on the water tank to cover the opening part, and a mat is detachably placed on the frame.

4. The caregiving bed according to claim 1, wherein the suspension member is a pair of bar-shaped members detachably attached to at least one lifting member to lift up the care-receiver, the bar-shaped members are attached to extend in a longitudinal direction between the attachment part of the one support platform and the attachment part of the other support platform, and a distance between the bed main body and the lifting member decreases when the bed main body is raised by the elevator devices, whereas the distance between the bed main body and the lifting member increases when the bed main body is lowered.

5. The caregiving bed according to claim 4, wherein the pad part has an opening part, the opening part is provided with a box-shaped water tank detachably supported and fixed to the pad part, the water tank being opened to the opening part and having a bottom part provided with a drain that is openable and closable, and a frame that is divided into a plurality of parts is detachably disposed on the water tank to cover the opening part, and a mat is detachably placed on the frame.

6. The caregiving bed according to claim 1, wherein the pad part has an opening part, the opening part is provided with a box-shaped water tank detachably supported and fixed to the pad part, the water tank being opened to the opening part and having a bottom part provided with a drain that is openable and closable, and a frame that is divided into a plurality of parts is detachably disposed on the water tank to cover the opening part, and a mat is detachably placed on the frame.

7. The caregiving bed according to claim 1, wherein the pad part is provided with a detachable frame that is divided into a plurality of parts, and a mat is detachably placed on the frame, the suspension member is a connection member attached to the support columns provided in one of the pair of support platforms, an opposite side of the connection member that is opposed to a side attached to the support columns is attached to both side end parts of the frame, and when the bed main body is lowered by the elevator devices, the support columns, to which the connection member is attached, are raised with respect to the bed main body, and the connection member pulls up the frame to incline the frame.

8. The caregiving bed according to claim 1, wherein the pad part is provided with a detachable frame that is divided into a plurality of parts, and a mat is detachably placed on the frame, and reclining mechanisms that incline part of the frame and enable reclining are provided on both side surfaces of the bed main body.

9. The caregiving bed according to claim 1, wherein the bed main body is provided with a headboard and a footboard covering the one and the other support members, upper surfaces of the headboard and the footboard have an equal height and are higher than a surface of the pad part, and the support columns pass through the upper surfaces of the headboard and the footboard.

10. The caregiving bed according to claim 1, wherein the support columns are formed to have a long side, bar-shaped members connecting the support columns of the one support platform with the support columns of the other support platform are attached to the attachment parts of the long support columns along a longitudinal direction, and daily commodities are placed on the long support columns and the bar-shape members.

11. The caregiving bed according to claim 1, further comprising:

a safety device provided with a control unit controlling operation of the elevator devices; and at least one sensor inputting a signal to stop the elevator devices to the safety device.

12. The caregiving bed according to claim 1, wherein the each of the support columns extends through an opening in a corresponding one of the one support platform or the other support platform.

13. The caregiving bed according to claim 1, wherein a width of at least one of the one support platform or the other support platform is greater than a distance between adjacent support columns of the support columns.

14. The caregiving bed according to claim 1, wherein each elevator device of the one or more elevator devices is partially enclosed within the one support platform or the other support platform.

15. The caregiving bed according to claim 1, further comprising an extending member mechanically connecting a first elevator device of the one or more elevator devices to a first transmission device of the one or more transmission devices, wherein the first transmission device is between a first support column of the support columns and the extending member.

16. The caregiving bed according to claim 15, a length of the extending member remains constant in response to movement of the first elevator device.

17. The caregiving bed according to claim 15, wherein the extending member extends through an opening in the one support platform.

18. The caregiving bed according to claim 1, wherein the bed main body further comprises a side surface part configured to at least partially enclose the one support platform.

19. A caregiving bed comprising:

a bed main body; and one support platform and another support platform supporting both longitudinal ends of the bed main body, the bed main body including a rectangular pad part having a predetermined area and thickness allowing a care-receiver to lie thereon, each of the one and the other support platforms being provided with support columns projecting through the bed main body, an amount of projection of the support columns from the bed main body changing in response to the bed main body being raised or lowered, the upper part of the support columns being provided with an attachment part to which a suspension member is detachably attached, the caregiving bed being provided with one or more elevator devices to raise and lower the bed main body and the support columns, and one or more transmission devices to raise and lower the support columns in synchronization with the bed main body in the reverse direction when the bed main body is raised or lowered, the one or more transmission devices being operatively connected to the one or more elevator devices such that a distance between at least one end of the one or more transmission devices and a top surface of the bed main body changes in response to movement of the one or more elevator devices in response to movement of the one or more elevator devices, and a distance between the pad part and the attachment part decreasing when the bed main body is raised by the elevator devices, whereas the distance between the pad part and the attachment part increasing when the bed main body is lowered.

* * * * *